US011421302B2

(12) United States Patent
Oishi et al.

(10) Patent No.: US 11,421,302 B2
(45) Date of Patent: Aug. 23, 2022

(54) FREE-CUTTING COPPER ALLOY AND METHOD FOR PRODUCING FREE-CUTTING COPPER ALLOY

(71) Applicant: Mitsubishi Materials Corporation, Tokyo (JP)

(72) Inventors: Keiichiro Oishi, Osaka (JP); Kouichi Suzaki, Osaka (JP); Hiroki Goto, Osaka (JP); Shinji Tanaka, Osaka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

(21) Appl. No.: 16/483,858

(22) PCT Filed: Feb. 21, 2018

(86) PCT No.: PCT/JP2018/006203
§ 371 (c)(1),
(2) Date: Aug. 6, 2019

(87) PCT Pub. No.: WO2019/035224
PCT Pub. Date: Feb. 21, 2019

(65) Prior Publication Data

US 2020/0181748 A1 Jun. 11, 2020

(30) Foreign Application Priority Data

Aug. 15, 2017 (WO) ..... PCT/JP2017/029369
Aug. 15, 2017 (WO) ..... PCT/JP2017/029371
(Continued)

(51) Int. Cl.
*C22F 1/08* (2006.01)
*C22C 9/04* (2006.01)
*C22F 1/00* (2006.01)

(52) U.S. Cl.
CPC ..... *C22C 9/04* (2013.01); *C22F 1/002* (2013.01); *C22F 1/08* (2013.01)

(58) Field of Classification Search
CPC .... C22C 9/04; C22F 1/002; C22F 1/08; C22F 1/008
See application file for complete search history.

(56) References Cited

U.S. PATENT DOCUMENTS 4,055,445 A 10/1977 Pops
5,865,910 A 2/1999 Bhargava
(Continued)

FOREIGN PATENT DOCUMENTS

CA 2582972 A1 4/2006
EP 1045041 A1 10/2000
(Continued)

OTHER PUBLICATIONS

JP2013104071 machine translation (Year: 2021).*
(Continued)

*Primary Examiner* — Robert S Jones, Jr.
*Assistant Examiner* — Jiangtian Xu
(74) *Attorney, Agent, or Firm* — Merchant & Gould P.C.

(57) ABSTRACT

This free-cutting copper alloy comprises 76.0-78.7% Cu, 3.1-3.6% Si, 0.40-0.85% Sn, 0.05-0.14% P, and at least 0.005% to less than 0.020% Pb, with the remainder comprising Zn and inevitable impurities. The composition satisfies the following relations: $75.0 \leq f1 = Cu + 0.8 \times Si - 7.5 \times Sn + P + 0.5 \times Pb \leq 78.2$; $60.0 \leq f2 = Cu - 4.8 \times Si - 0.8 \times Sn - P + 0.5 \times Pb \leq 61.5$; and $0.09 \leq f3 = P/Sn \leq 0.30$. The area percentage (%) of respective constituent phases satisfies the following relations: $30 \leq \kappa \leq 65$; $0 \leq \gamma \leq 2.0$; $0 \leq \beta \leq 0.3$; $0 \leq \mu \leq 2.0$; $96.5 \leq f4 = \alpha + \kappa$; $99.4 \leq f5 = \alpha + \kappa + \gamma + \mu$; $0 \leq f6 = \gamma + \mu \leq 3.0$; and $35 \leq f7 = 1.05 \times \kappa + 6 \times$
(Continued)

$\gamma^{1/2}+0.5\times\mu\leq 70$. κ phase is present in α phase, the long side of the γ phase is at most 50 μm, and the long side of the μ phase is at most 25 μm.

12 Claims, 3 Drawing Sheets

(30) Foreign Application Priority Data

Aug. 15, 2017 (WO) ..... PCT/JP2017/029373
Aug. 15, 2017 (WO) ..... PCT/JP2017/029374
Aug. 15, 2017 (WO) ..... PCT/JP2017/029376

(56) References Cited

U.S. PATENT DOCUMENTS

| | | | |
|---|---|---|---|
| 2002/0159912 | A1 | 10/2002 | Oishi |
| 2007/0062615 | A1 | 3/2007 | Oishi |
| 2007/0169854 | A1 | 7/2007 | Oishi |
| 2007/0169855 | A1 | 7/2007 | Oishi |
| 2009/0297390 | A1 | 12/2009 | Hidenobu et al. |
| 2013/0276938 | A1 | 10/2013 | Oishi |
| 2013/0315660 | A1 | 11/2013 | Oishi |
| 2013/0319581 | A1 | 12/2013 | Oishi |
| 2014/0251488 | A1 | 9/2014 | Oishi et al. |
| 2016/0068931 | A1 | 3/2016 | Xu et al. |
| 2017/0062615 | A1 | 3/2017 | Wang |
| 2017/0211169 | A1 | 7/2017 | Hanaoka et al. |

FOREIGN PATENT DOCUMENTS

| | | | | |
|---|---|---|---|---|
| EP | 2634275 | A1 | | 9/2013 |
| JP | 07-508560 | A | | 9/1995 |
| JP | 2000-119774 | A | | 4/2000 |
| JP | 2000-119775 | A | | 4/2000 |
| JP | 2004-263301 | A | | 9/2004 |
| JP | 2008-516081 | A | | 5/2008 |
| JP | 2008-214760 | | | 9/2008 |
| JP | 2009-509031 | A | | 3/2009 |
| JP | 2013-104071 | A | | 5/2013 |
| JP | 2013104071 | | * | 5/2013 |
| JP | 2016-511792 | A | | 4/2016 |
| WO | 94/01591 | A1 | | 1/1994 |
| WO | 2006/016442 | A1 | | 2/2006 |
| WO | 2006/016624 | A2 | | 2/2006 |
| WO | 2007/034571 | A1 | | 3/2007 |
| WO | 2008/081947 | A1 | | 7/2008 |
| WO | 2012/057055 | A1 | | 5/2012 |
| WO | 2013/065830 | A1 | | 5/2013 |
| WO | 2015/166998 | A1 | | 11/2015 |
| WO | 2018/034280 | A1 | | 2/2018 |
| WO | 2018/034281 | A1 | | 2/2018 |
| WO | 2018/034282 | A1 | | 2/2018 |
| WO | 2018/034283 | A1 | | 2/2018 |
| WO | 2018/034284 | A1 | | 2/2018 |
| WO | 2019/035225 | A1 | | 2/2019 |
| WO | 2019/035226 | A1 | | 2/2019 |

OTHER PUBLICATIONS

JP2013104071 translation (Year: 2021).*
Office Action issued in Indian Patent Application 201917005548 dated Jan. 6, 2021.
Office Action issued in U.S. Appl. No. 16/324,684 dated Dec. 22, 2020.
Extended European Search Report issued in co-pending application 18846602.3 completed on Jun. 15, 2020 and dated Jun. 26, 2020.
Office Action issued in co-pending related U.S. Appl. No. 16/325,029 dated Oct. 27, 2020.
Office Action issued in co-pending U.S. Appl. No. 16/274,622 dated Aug. 26, 2019.
International Search Report issued in application PCT/JP2018/006203 dated May 15, 2018.
International Search Report issued in application PCT/JP2017/029369 dated Nov. 7, 2017.
International Search Report issued in application PCT/JP2017/029376 dated Nov. 7, 2017.
Office Action issued in Japanese patent application No. 2017-567267 dated Apr. 3, 2018, (Machine translation obtained by Global Dossier on Dec. 14, 2018).
International Search Report issued in application PCT/JP2017/029371 dated Nov. 7, 2017.
Office Action issued in Japanese patent application No. 2017-567265 dated Apr. 3, 2018, (Machine translation obtained by Global Dossier on Dec. 14, 2018).
International Search Report issued in application PCT/JP2017/029374 dated Nov. 7, 2017.
Office Action issued in Japanese patent application No. 2017-567262 dated Apr. 10, 2018 (Machine translation obtained by Global Dossier on Dec. 13, 2018).
International Search Report issued in application PCT/JP2017/029373 dated Nov. 7, 2017.
International Search Report issued in application PCT/JP2018/006245 dated May 15, 2018.
International Search Report issued in application PCT/JP2018/006218 dated May 15, 2018.
Office Action issued in Japanese patent application No. 2018-530923 dated Aug. 7, 2018 (Machine translation obtained by Global Dossier on May 8, 2019).
Opposition issued in Japanese patent application No. 2017-567267 on Mar. 5, 2019 (w/machine translation).
Opposition issued in Japanese patent application No. 2017-567265 on Mar. 27, 2019 (w/machine translation).
Opposition issued in Japanese patent application No. 2017-567266 on Mar. 27, 2019 (w/machine translation).
Genjiro Mima, Masaharu Hasegawa, Journal of the Japan Copper and Brass ResearchAssociation, 2 (1963), p. 62-77 (w/partial translation).
JCBAT204 : 2005 "Lead-less free-cutting brass bar", Japan Copper and Brass Association technical standard (w/machine translation).

* cited by examiner

FREE-CUTTING COPPER ALLOY AND METHOD FOR PRODUCING FREE-CUTTING COPPER ALLOY

This is a National Phase Application in the United States of International Patent Application No. PCT/JP2018/006203 filed Feb. 21, 2018, which claims priority on International Patent Application Nos. PCT/JP2017/029369, PCT/JP2017/029371, PCT/JP2017/029373, PCT/JP2017/029374, and PCT/JP2017/029376, filed Aug. 15, 2017. The entire disclosures of the above patent applications are hereby incorporated by reference.

TECHNICAL FIELD

The present invention relates to a free-cutting copper alloy having excellent corrosion resistance, high strength, high-temperature strength, good ductility and impact resistance, in which the lead content is significantly reduced, and a method of manufacturing the free-cutting copper alloy. In particular, the present invention relates to a free-cutting copper alloy used in devices such as faucets, valves, or fittings for drinking water consumed by a person or an animal every day as well as valves, fittings and the like for electrical uses, automobiles, machines, and industrial plumbing used in harsh environments where liquid flows fast, and a method of manufacturing the free-cutting copper alloy.

Priority is claimed on PCT International Patent Application Nos. PCT/JP2017/29369, PCT/JP2017/29371, PCT/JP2017/29373, PCT/JP2017/29374, and PCT/JP2017/29376, filed on Aug. 15, 2017, the content of which is incorporated herein by reference.

BACKGROUND ART

Conventionally, as a copper alloy that is used in devices for drinking water and valves, fittings, pressure vessels and the like for electrical use s, automobiles, machines, and industrial plumbing, a Cu—Zn—Pb alloy including 56 to 65 mass % of Cu, 1 to 4 mass % of Pb, and a balance of Zn (so-called free-cutting brass), or a Cu—Sn—Zn—Pb alloy including 80 to 88 mass % of Cu, 2 to 8 mass % of Sn, 2 to 8 mass % of Pb, and a balance of Zn (so-called bronze: gunmetal) was generally used.

However, recently, Pb's influence on a human body or the environment is a concern, and a movement to regulate Pb has been extended in various countries. For example, a regulation for reducing the Pb content in drinking water supply devices to be 0.25 mass % or lower has come into force from January, 2010 in California, the United States and from January, 2014 across the United States. Also, with respect to the amount of Pb that leaches into drinking water and the like, it is said that a regulation for limiting the amount of Pb to about 0.05 mass % will come into force in the future considering its influence on infants and the like. In countries other than the United States, a movement of the regulation has become rapid, and the development of a copper alloy material corresponding to the regulation of the Pb content and containing a further reduced amount of Pb has been required.

In addition, in other industrial fields such as automobiles, machines, and electrical and electronic apparatuses industries, for example, in ELV Directives and RoHS Directives of the Europe, free-cutting copper alloys are exceptionally allowed to contain 4 mass % Pb. However, as in the field of drinking water, strengthening of regulations on Pb content including elimination of exemptions has been actively discussed.

Under the trend of the strengthening of the regulations on Pb in free-cutting copper alloys, copper alloys that includes Bi or Se having a machinability improvement function instead of Pb, or Cu—Zn alloys including a high concentration of Zn in which the amount of β phase is increased to improve machinability have been proposed.

For example, Patent Document 1 discloses that corrosion resistance is insufficient with mere addition of Bi instead of Pb, and proposes a method of slowly cooling a hot extruded rod to 180° C. after hot extrusion and further performing a heat treatment thereon in order to reduce the amount of β phase to isolate β phase.

In addition, Patent Document 2 discloses a method of improving corrosion resistance by adding 0.7 to 2.5 mass % of Sn to a Cu—Zn—Bi alloy to precipitate γ phase of a Cu—Zn—Sn alloy.

However, the alloy including Bi instead of Pb as disclosed in Patent Document 1 has a problem in corrosion resistance. In addition, Bi has many problems in that, for example, Bi may be harmful to a human body as with Pb, Bi has a resource problem because it is a rare metal, and Bi embrittles a copper alloy material. Further, even in cases where β phase is isolated to improve corrosion resistance by performing slow cooling or a heat treatment after hot extrusion as disclosed in Patent Documents 1 and 2, corrosion resistance is not improved at all in a harsh environment.

In addition, even in cases where γ phase of a Cu—Zn—Sn alloy is precipitated as disclosed in Patent Document 2, this γ phase has inherently lower corrosion resistance than α phase, and corrosion resistance is not improved at all in a harsh environment. In addition, in Cu—Zn—Sn alloys, γ phase including Sn has a low machinability improvement function, and thus it is also necessary to add Bi having a machinability improvement function.

On the other hand, regarding copper alloys including a high concentration of Zn, β phase has a lower machinability function than Pb. Therefore, such copper alloys cannot be replacement for free-cutting copper alloys including Pb. In addition, since the copper alloy includes a large amount of β phase, corrosion resistance, in particular, dezincification corrosion resistance or stress corrosion cracking resistance is extremely poor. In addition, these copper alloys have a low strength under high temperature (for example, 150° C.), and thus cannot realize a reduction in thickness and weight, for example, in automobile components used under high temperature near the engine room when the sun is blazing, or in plumbing pipes used under high temperature and high pressure.

Further, Bi embrittles copper alloy, and when a large amount of β phase is contained, ductility deteriorates. Therefore, copper alloy including Bi or a large amount of β phase is not appropriate for components for automobiles or machines, or electrical components or for materials for drinking water supply devices such as valves. Regarding brass including γ phase in which Sn is added to a Cu—Zn alloy, Sn cannot improve stress corrosion cracking, strength under normal temperature and high temperature is low, and impact resistance is poor. Therefore, the brass is not appropriate for the above-described uses.

On the other hand, for example, Patent Documents 3 to 9 disclose Cu—Zn—Si alloys including Si instead of Pb as free-cutting copper alloys.

The copper alloys disclosed in Patent Documents 3 and 4 have an excellent machinability without containing Pb or containing only a small amount of Pb that is mainly realized by superb machinability-improvement function of γ phase. Addition of 0.3 mass % or higher of Sn can increase and promote the formation of γ phase having a function to improve machinability. In addition, Patent Documents 3 and 4 disclose a method of improving corrosion resistance by forming a large amount of γ phase.

In addition, Patent Document 5 discloses a copper alloy including a small amount (0.02 mass % or less) of Pb having excellent machinability that is realized by simply defining the total area of γ phase and κ phase. Here, Sn functions to form and increase γ phase such that erosion-corrosion resistance is improved.

Further, Patent Documents 6 and 7 propose a Cu—Zn—Si alloy casting. The documents disclose that in order to refine crystal grains of the casting, extremely small amounts of P and Zr are added, and the P/Zr ratio or the like is important.

In addition, in Patent Document 8, proposes a copper alloy in which Fe is added to a Cu—Zn—Si alloy is proposed. Further, Patent Document 9, proposes a copper alloy in which Sn, Fe, Co, Ni, and Mn are added to a Cu—Zn—Si alloy.

Here, in Cu—Zn—Si alloys, it is known that, even when looking at only those having Cu concentration of 60 mass % or higher, Zn concentration of 30 mass % or lower, and Si concentration of 10 mass % or lower as described in Patent Document 10 and Non-Patent Document 1, 10 kinds of metallic phases including matrix α phase, β phase, γ phase, δ phase, ε phase, ζ phase, η phase, κ phase, μ phase, and χ phase, in some cases, 13 kinds of metallic phases including α', β', and γ' in addition to the 10 kinds of metallic phases are present. Further, it is empirically known that, as the number of additive elements increases, the metallographic structure becomes complicated, or a new phase or an intermetallic compound may appear. In addition, it is also empirically known that there is a large difference in the constitution of metallic phases between an alloy according to an equilibrium diagram and an actually produced alloy. Further, it is well known that the composition of these phases may change depending on the concentrations of Cu, Zn, Si, and the like in the copper alloy and processing heat history.

Apropos, γ phase has excellent machinability but contains high concentration of Si and is hard and brittle. Therefore, when a large amount of γ phase is contained, problems arise in corrosion resistance, ductility, impact resistance, high-temperature strength (high temperature creep), and the like in a harsh environment. Therefore, use of Cu—Zn—Si alloys including a large amount of γ phase is also restricted like copper alloys including Bi or a large amount of β phase.

Incidentally, the Cu—Zn—Si alloys described in Patent Documents 3 to 7 exhibit relatively satisfactory results in a dezincification corrosion test according to ISO-6509. However, in the dezincification corrosion test according to ISO-6509, in order to determine whether or not dezincification corrosion resistance is good or bad in water of ordinary quality, the evaluation is merely performed after a short period of time of 24 hours using a reagent of cupric chloride which is completely unlike water of actual water quality. That is, the evaluation is performed for a short period of time using a reagent which only provides an environment that is different from the actual environment, and thus corrosion resistance in a harsh environment cannot be sufficiently evaluated.

In addition, Patent Document 8 proposes that Fe is added to a Cu—Zn—Si alloy. However, Fe and Si form an Fe—Si intermetallic compound that is harder and more brittle than γ phase. This intermetallic compound has problems like reduced tool life of a cutting tool during cutting and generation of hard spots during polishing such that the external appearance is impaired. In addition, since Si is consumed when the intermetallic compound is formed, the performance of the alloy deteriorates.

Further, in Patent Document 9, Sn, Fe, Co, and Mn are added to a Cu—Zn—Si alloy. However, each of Fe, Co, and Mn combines with Si to form a hard and brittle intermetallic compound. Therefore, such addition causes problems during cutting or polishing as disclosed by Document 8. Further, according to Patent Document 9, β phase is formed by addition of Sn and Mn, but β phase causes serious dezincification corrosion and causes stress corrosion cracking to occur more easily.

RELATED ART DOCUMENT

Patent Document

[Patent Document 1] JP-A-2008-214760
[Patent Document 2] WO2008/081947
[Patent Document 3] JP-A-2000-119775
[Patent Document 4] JP-A-2000-119774
[Patent Document 5] WO2007/034571
[Patent Document 6] WO2006/016442
[Patent Document 7] WO2006/016624
[Patent Document 8] JP-T-2016-511792
[Patent Document 9] JP-A-2004-263301
[Patent Document 10] U.S. Pat. No. 4,055,445 specification
[Patent Document 11] WO2012/057055
[Patent Document 12] JP-A-2013-104071

Non-Patent Document

[Non-Patent Document 1] Genjiro MIMA, Masaharu HASEGAWA, Journal of the Japan Copper and Brass Research Association, 2 (1963), pages 62 to 77

SUMMARY OF THE INVENTION

Problem that the Invention is to Solve

The present invention has been made in order to solve the above-described problems of the conventional art, and an object thereof is to provide a free-cutting copper alloy having excellent corrosion resistance in a harsh environment in terms of water quality and in a liquid which flows fast, impact resistance, ductility, and strength under normal temperature and high temperature, and a method of manufacturing the free-cutting copper alloy. In this specification, unless specified otherwise, corrosion resistance refers to dezincification corrosion resistance. In addition, a hot worked material refers to a hot extruded material, a hot forged material, or a hot rolled material. High temperature properties refer to high temperature creep and tensile strength at about 150° C. (100° C. to 250° C.).

Cooling rate refers to an average cooling rate in a given temperature range.

Means for Solving the Problem

In order to achieve the object by solving the problems, a free-cutting copper alloy according to the first aspect of the present invention includes:

76.0 mass % to 78.7 mass % of Cu;
3.1 mass % to 3.6 mass % of Si;

0.40 mass % to 0.85 mass % of Sn;

0.05 mass % to 0.14 mass % of P;

0.005 mass % or higher and lower than 0.020 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$75.0 \leq f1 = [Cu] + 0.8 \times [Si] - 7.5 \times [Sn] + [P] + 0.5 \times [Pb] \leq 78.2,$$

$$60.0 \leq f2 = [Cu] - 4.8 \times [Si] - 0.8 \times [Sn] - [P] + 0.5 \times [Pb] \leq 61.5, \text{ and}$$

$$0.09 \leq f3 = [P]/[Sn] \leq 0.30$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$30 \leq (\kappa) \leq 65,$$

$$0 \leq (\gamma) \leq 2.0,$$

$$0 \leq (\beta) \leq 0.3,$$

$$0 \leq (\mu) \leq 2.0,$$

$$96.5 \leq f4 = (\alpha) + (\kappa),$$

$$99.4 \leq f5 = (\alpha) + (\kappa) + (\gamma) + (\mu),$$

$$0 \leq f6 = (\gamma) + (\mu) \leq 3.0, \text{ and}$$

$$35 \leq f7 = 1.05 \times (\kappa) + 6 \times (\gamma)^{1/2} + 0.5 \times (\mu) \leq 70$$

are satisfied,

κ phase is present in α phase, the length of the long side of γ phase is 50 μm or less, and the length of the long side of μ phase is 25 μm or less.

According to the second aspect of the present invention, the free-cutting copper alloy according to the first aspect further includes:

one or more element(s) selected from the group consisting of 0.01 mass % to 0.08 mass % of Sb, 0.02 mass % to 0.08 mass % of As, and 0.01 mass % to 0.10 mass % of Bi.

A free-cutting copper alloy according to the third aspect of the present invention includes:

76.5 mass % to 78.3 mass % of Cu;

3.15 mass % to 3.5 mass % of Si;

0.45 mass % to 0.77 mass % of Sn;

0.06 mass % to 0.13 mass % of P;

0.006 mass % to 0.018 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$75.5 \leq f1 = [Cu] + 0.8 \times [Si] - 7.5 \times [Sn] + [P] + 0.5 \times [Pb] \leq 77.7,$$

$$60.2 \leq f2 = [Cu] - 4.8 \times [Si] - 0.8 \times [Sn] - [P] + 0.5 \times [Pb] \leq 61.3, \text{ and}$$

$$0.10 \leq f3 = [P]/[Sn] \leq 0.27$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$33 \leq (\kappa) \leq 60,$$

$$0 \leq (\gamma) \leq 1.5,$$

$$0 \leq (\beta) \leq 0.1,$$

$$0 \leq (\mu) \leq 1.0,$$

$$97.5 \leq f4 = (\alpha) + (\kappa),$$

$$99.6 \leq f5 = (\alpha) + (\kappa) + (\gamma) + (\mu),$$

$$0 \leq f6 = (\gamma) + (\mu) \leq 2.0, \text{ and}$$

$$38 \leq f7 = 1.05 \times (\kappa) + 6 \times (\gamma)^{1/2} + 0.5 \times (\mu) \leq 65$$

are satisfied,

κ phase is present in α phase, the length of the long side of γ phase is 40 μm or less, and the length of the long side of μ phase is 15 μm or less.

According to the fourth aspect of the present invention, in the free-cutting copper alloy according to any one of the first to third aspects of the present invention, a total amount of Fe, Mn, Co, and Cr as the inevitable impurities is lower than 0.08 mass %.

According to the fifth aspect of the present invention, in the free-cutting copper alloy according to any one of the first to fourth aspects of the present invention, an amount of Sn in κ phase is 0.43 mass % to 0.90 mass %, and an amount of P in κ phase is 0.06 mass % to 0.22 mass %.

According to the sixth aspect of the present invention, in the free-cutting copper alloy according to any one of the first to fifth aspects of the present invention, a Charpy impact test value when a U-notched specimen is used is 12 J/cm$^2$ to 45 J/cm$^2$, and a creep strain after holding the copper alloy at 150° C. for 100 hours in a state where a load corresponding to 0.2% proof stress at room temperature is applied is 0.4% or lower.

Incidentally, the Charpy impact test value is a value obtained when a specimen with a U-shaped notch is used.

According to the seventh aspect of the present invention, the free-cutting copper alloy according to any one of the first to fifth aspects of the present invention is a hot worked material having a tensile strength S (N/mm$^2$) of 550 N/mm$^2$ or higher, an elongation E (%) of 12% or higher, a Charpy impact test value I (J/cm$^2$) when a specimen with a U-shaped notch is used is 12 J/cm$^2$ to 45 J/cm$^2$, and $650 \leq f8 = S \times \{(E+100)/100\}^{1/2}$ or $665 \leq f9 = S \times \{(E+100)/100\}^{1/2} + I$ is satisfied.

According to the eighth aspect of the present invention, the free-cutting copper alloy according to any one of the first to seventh aspects of the present invention is for use in a water supply device, an industrial plumbing component, a device that comes in contact with liquid, a pressure vessel, a fitting, or an automobile component or an electric appliance component that comes in contact with liquid.

The method of manufacturing a free-cutting copper alloy according to the ninth aspect of the present invention is a method of manufacturing the free-cutting copper alloy according to any one of the first to eighth aspects of the present invention which includes:

any one or both of a cold working step and a hot working step; and an annealing step that is performed after the cold working step or the hot working step, wherein in the annealing step, the copper alloy is held under any one of the following conditions (1) to (4):

(1) the copper alloy is held at a temperature of 525° C. to 575° C. for 20 minutes to 8 hours;

(2) the copper alloy is held at a temperature of 515° C. or higher and lower than 525° C. for 100 minutes to 8 hours;

(3) the maximum reaching temperature is 525° C. to 610° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and subsequently the copper alloy is cooled in a temperature range from 460° C. to 400° C. at an average cooling rate of 2.5° C./min to 500° C./min.

The method of manufacturing a free-cutting copper alloy according to the tenth aspect of the present invention is a method of manufacturing the free-cutting copper alloy according to any one of the first to sixth aspects of the present invention which includes:

a casting step; and an annealing step that is performed after the casting step, wherein in the annealing step, the copper alloy is held under any one of the following conditions (1) to (4):

(1) the copper alloy is held at a temperature of 525° C. to 575° C. for 20 minutes to 8 hours;

(2) the copper alloy is held at a temperature of 515° C. or higher and lower than 525° C. for 100 minutes to 8 hours;

(3) the maximum reaching temperature is 525° C. to 610° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and subsequently, the copper alloy is cooled in a temperature range from 460° C. to 400° C. at an average cooling rate of 2.5° C./min to 500° C./min.

The method of manufacturing a free-cutting copper alloy according to the eleventh aspect of the present invention is a method of manufacturing the free-cutting copper alloy according to any one of the first to eighth aspects of the present invention which includes:

a hot working step, wherein the material's temperature during hot working is 600° C. to 740° C., and in the process of cooling after hot plastic working, the material is cooled in a temperature range from 575° C. to 525° C. at an average cooling rate of 0.1° C./min to 2.5° C./min and subsequently is cooled in a temperature range from 460° C. to 400° C. at an average cooling rate of 2.5° C./min to 500° C./min.

The method of manufacturing a free-cutting copper alloy according to the twelfth aspect of the present invention is a method of manufacturing the free-cutting copper alloy according to any one of the first to eighth aspects of the present invention which includes:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied.

Advantage of the Invention

According to the aspects of the present invention, a metallographic structure in which the amount of μ phase that is effective for machinability is reduced as much as possible while minimizing the amount of γ phase that has an excellent machinability-improving function but has poor corrosion resistance, ductility, impact resistance and high-temperature strength (high temperature creep), and also, κ phase, which is effective to improve strength, machinability, ductility, and corrosion resistance, is present in α phase is defined. Further, a composition and a manufacturing method for obtaining this metallographic structure are defined. Therefore, according to the aspects of the present invention, it is possible to provide a free-cutting copper alloy having excellent machinability, corrosion resistance in a harsh environment including fast-flowing liquid, cavitation resistance, erosion-corrosion resistance, normal-temperature strength, high temperature strength, and wear resistance, and a method of manufacturing the free-cutting copper alloy.

BEST MODE FOR CARRYING OUT THE INVENTION

Figure 1:
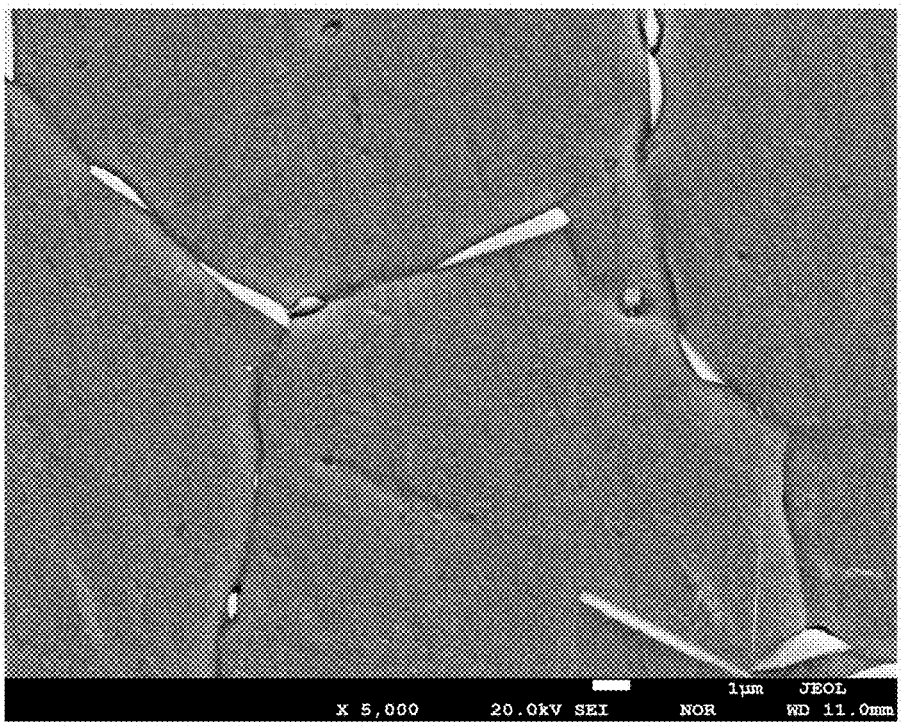
FIG. 1 is an electron micrograph of a metallographic structure of a free-cutting copper alloy (Test No. T05) according to Example 1.

Below is a description of free-cutting copper alloys according to the embodiments of the present invention and the methods of manufacturing the free-cutting copper alloys.

The free-cutting copper alloys according to the embodiments are for use in devices such as faucets, valves, or fittings to supply drinking water consumed by a person or an animal every day, components for electrical uses, automobiles, machines and industrial plumbing such as valves, or fittings, or devices, components, pressure vessels, or fittings that come in contact with liquid.

Here, in this specification, an element symbol in parentheses such as [Zn] represents the content (mass %) of the element.

In the embodiment, using this content expressing method, a plurality of composition relational expressions are defined as follows.

Composition Relational Expression $f1=[Cu]+0.8\times[Si]-7.5\times[Sn]+[P]+0.5\times[Pb]$ Composition Relational Expression $f2=[Cu]-4.8\times[Si]-0.8\times[Sn]-[P]+0.5\times[Pb]$ Composition Relational Expression $f3=[P]/[Sn]$ Further, in the embodiments, in constituent phases of metallographic structure, an area ratio of α phase is represented by (α)%, an area ratio of β phase is represented by (13)%, an area ratio of γ phase is represented by (γ) %, an area ratio of κ phase is represented by (κ)%, and an area ratio of μ phase is represented by (μ)%. Constituent phases of metallographic structure refer to α phase, γ phase, κ phase, and the like and do not include intermetallic compound, precipitate, non-metallic inclusion, and the like. In addition, κ phase present in α phase is included in the area ratio of α phase. α' phase is included in α phase. The sum of the area ratios of all the constituent phases is 100%.

In the embodiments, a plurality of metallographic structure relational expressions are defined as follows.

Metallographic Structure Relational Expression $f4=(\alpha)+(\kappa)$

Metallographic Structure Relational Expression $f5=(\alpha)+(\kappa)+(\gamma)+(\mu)$ Metallographic Structure Relational Expression $f6=(\gamma)+(\mu)$ Metallographic Structure Relational Expression $f7=1.05\times(\kappa)+6\times(\gamma)^{1/2}+0.5\times(\mu)$ A free-cutting copper alloy according to the first embodiment of the present invention includes: 76.0 mass % to 78.7 mass % of Cu; 3.1 mass % to 3.6 mass % of Si; 0.40 mass % to 0.85 mass % of Sn; 0.05 mass % to 0.14 mass % of P; 0.005 mass % or more and less than 0.020 mass % of Pb; and a balance including Zn and inevitable impurities. The composition relational expression f1 is in a range of 75.078.2, the composition relational expression f2 is in a range of $60.0\leq f2\leq 61.5$, and the composition relational expression f3 is in a range of $0.09\leq f3\leq 0.30$. The area ratio of κ phase is in a range of $30\leq(\kappa)\leq 65$, the area ratio of γ phase is in a range of $0\leq(\gamma)\leq 2.0$, the area ratio of β phase is in a range of $0\leq(\beta)\leq 0.3$, and the area ratio of μ phase is in a range of $0\leq(\mu)\leq 2.0$. The metallographic structure relational expression f4 is $96.5\leq f4$, the metallographic structure relational expression f5 is $99.4\leq f5$, the metallographic structure relational expression f6 is in a range of $0\leq f6\leq 3.0$, the metallographic structure relational expression f7 is in a range of $35\leq f7\leq 70$. κ phase is present in α phase. The length of the long side of γ phase is 50 μm or less, and the length of the long side of μ phase is 25 μm or less.

A free-cutting copper alloy according to the second embodiment of the present invention includes: 76.5 mass % to 78.3 mass % of Cu; 3.15 mass % to 3.5 mass % of Si; 0.45 mass % to 0.77 mass % of Sn; 0.06 mass % to 0.13 mass % of P; 0.006 mass % to 0.018 mass % of Pb; and a balance including Zn and inevitable impurities. The composition relational expression f1 is in a range of $75.5\leq f1\leq 77.7$, the composition relational expression f2 is in a range of $60.2\leq f2\leq 61.3$, and the composition relational expression f3 is in a range of $0.1\leq f3\leq 0.27$. The area ratio of κ phase is in a range of $33\leq(\kappa)\leq 60$, the area ratio of γ phase is in a range of $0\leq(\gamma)\leq 1.5$, the area ratio of β phase is $0\leq(\beta)\leq 0.1$, and the area ratio of μ phase is in a range of $0\leq(\mu)\leq 1.0$. The metallographic structure relational expression f4 is $97.5\leq f4$, the metallographic structure relational expression f5 is $99.6\leq f5$, the metallographic structure relational expression f6 is in a range of $0\leq f6\leq 2.0$, and the metallographic structure relational expression f7 is in a range of $38\leq f7\leq 65$. κ phase is present in α phase. The length of the long side of γ phase is 40 μm or less and the length of the long side of μ phase is 15 μm or less.

In addition, the free-cutting copper alloy according to the first embodiment of the present invention may further include one or more element(s) selected from the group consisting of 0.01 mass % to 0.08 mass % of Sb, 0.02 mass % to 0.08 mass % of As, and 0.01 mass % to 0.10 mass % of Bi.

In the free-cutting copper alloy according to the first and second embodiments of the present invention, it is preferable that a total amount of Fe, Mn, Co, and Cr as the inevitable impurities is lower than 0.08 mass %.

Further, in the free-cutting copper alloy according to the first and second embodiments of the present invention, it is preferable that the amount of Sn in κ phase is 0.43 mass % to 0.90 mass %, and it is preferable that the amount of P in κ phase is 0.06 mass % to 0.22 mass %.

In addition, in the free-cutting copper alloy according to the first or second embodiment of the present invention, it is preferable that a Charpy impact test value when a U-notched specimen is used is 12 J/cm$^2$ to 45 J/cm$^2$, and it is preferable that a creep strain after holding the copper alloy at 150° C. for 100 hours in a state where 0.2% proof stress (load corresponding to 0.2% proof stress) at room temperature is applied is 0.4% or lower.

Regarding a relation between a tensile strength S (N/mm$^2$), an elongation E (%), a Charpy impact test value I (J/cm$^2$) in the free-cutting copper alloy (hot worked material) having undergone hot working according to the first or second embodiment of the present invention, it is preferable the tensile strength S is 550 N/mm$^2$ or higher, the elongation E is 12% or higher, the Charpy impact test value I (J/cm$^2$) when a U-notched specimen is used is 12 J/cm$^2$ to 45 J/cm$^2$, and the value of $f8=S\times\{(E+100)/100\}^{1/2}$, which is the product of the tensile strength (S) and the value of {(Elongation (E)+100)/100} raised to the power 1/2, is 650 or higher or $f9=S\times\{(E+100)/100\}^{1/2}+I$, which is the sum of f8 and I, is 665 or higher.

The reason why the component composition, the composition relational expressions f1, f2, and f3 and the metallographic structure, the metallographic structure relational expressions f4, f5, f6, and 7, and the mechanical properties are defined as above is explained below.

<Component Composition>

(Cu)

Cu is a main element of the alloys according to the embodiments. In order to achieve the object of the present invention, it is necessary to add at least 76.0 mass % or higher amount of Cu. When the Cu content is lower than 76.0 mass %, the proportion of γ phase is higher than 2% although depending on the contents of Si, Zn, and Sn and the manufacturing process, stress corrosion cracking resistance, impact resistance, cavitation resistance, erosion-corrosion resistance, ductility, normal-temperature strength, and high-temperature creep deteriorate in addition to deterioration in dezincification corrosion resistance. In some cases, β phase may also appear. Accordingly, the lower limit of the Cu content is 76.0 mass % or higher, preferably 76.5 mass % or higher, and more preferably 76.8 mass % or higher.

On the other hand, when the Cu content is higher than 78.7 mass %, the effects on corrosion resistance, cavitation resistance, erosion-corrosion resistance, and strength are saturated, and the proportion of κ phase may become excessively high. In addition, μ phase having a high Cu concentration, in some cases, ζ phase and χ phase are more likely to precipitate. As a result, machinability, impact resistance, ductility, and hot workability may deteriorate although depending on the conditions of the metallographic structure. Accordingly, the upper limit of the Cu content is 78.7 mass % or lower, preferably 78.3 mass % or lower, if ductility and impact resistance are important, preferably 78.0 mass % or lower, and more preferably 77.7 mass % or lower.

(Si)

Si is an element necessary for obtaining most of excellent properties of the alloy according to the embodiment. Si contributes to the formation of metallic phases such as κ phase, γ phase, or μ phase. Si improves machinability, corrosion resistance, stress corrosion cracking resistance, cavitation resistance, erosion-corrosion resistance, wear resistance, normal-temperature strength, and high temperature properties of the alloy according to the embodiment. Regarding machinability, inclusion of Si scarcely improves machinability of α phase. However, due to the presence of a phase such as γ phase, κ phase, or μ phase that is formed by inclusion of Si and is harder than α phase, excellent machinability can be obtained without including a large amount of Pb. However, as the proportion of the metallic phase such as γ phase or μ phase increases, ductility and impact resistance deteriorate. Corrosion resistance in a harsh environment starts to deteriorate. Further, a problem in high temperature creep properties for withstanding long-term use arises. On the other hand, κ phase is useful for improving machinability, strength, cavitation resistance, and wear resistance. However, the amount of κ phase is excessive, ductility, impact resistance, and workability deteriorate and, in some cases, machinability also deteriorates. Therefore, it is necessary to define κ phase, γ phase, μ phase, and β phase to be in an appropriate range.

In order to solve these problems of a metallographic structure and to satisfy all the properties, it is necessary to contain 3.1 mass % or higher amount of Si although depending on the contents of Cu, Zn, Sn, and the like. The lower limit of the Si content is preferably 3.15 mass % or higher, more preferably 3.17 mass % or higher, and still more preferably 3.2 mass % or higher. It may look as if the Si content should be reduced in order to reduce the proportion of γ phase or μ phase having a high Si concentration. However, as a result of a thorough study on a mixing ratio between Si and another element and the manufacturing process, it was found that it is necessary to define the lower limit of the Si content as described above. In addition, although depending on other elements, the composition relational expressions, and the manufacturing process, once the Si content exceeds about 3%, it is possible to make elongated acicular κ phase appear in α phase. When the Si content is about 3.1 mass % to 3.15 mass %, the amount of acicular κ phase increases. Hereinafter, κ phase present in α phase will also be referred to as κ1 phase. Due to the presence of κ phase in α phase, α phase is strengthened, and tensile strength, high-temperature strength, machinability, cavitation resistance, erosion-corrosion resistance, corrosion resistance, impact resistance, and wear resistance can be improved without deterioration of ductility.

On the other hand, when the Si content is excessively high, the amount of κ phase increases excessively, which causes deterioration in machinability in addition to ductility and impact resistance. Therefore, the upper limit of the Si content is 3.6 mass % or lower and preferably 3.5 mass % or lower. When ductility or impact resistance is important, the upper limit of the Si content is preferably 3.45 mass % or lower and more preferably 3.4 mass % or lower.

(Zn)

Zn is a main element of the alloy according to the embodiments together with Cu and Si and is required for improving machinability, corrosion resistance, strength, and castability. Zn is included in the balance, but to be specific, the upper limit of the Zn content is about 20.5 mass % or lower, and the lower limit thereof is about 16.5 mass % or higher.

(Sn)

Sn significantly improves dezincification corrosion resistance in a harsh environment, cavitation resistance, and erosion-corrosion resistance, and improves stress corrosion cracking resistance, machinability, and wear resistance. In a copper alloy including a plurality of metallic phases (constituent phases), there is a difference in corrosion resistance between the respective metallic phases. Even if the two phases that remain in the metallographic structure are α phase and κ phase, corrosion begins from a phase having lower corrosion resistance and progresses. Sn improves corrosion resistance of α phase having the highest corrosion resistance and improves corrosion resistance of κ phase having the second highest corrosion resistance at the same time. The amount of Sn distributed in κ phase is about 1.4 times the amount of Sn distributed in α phase. That is, the amount of Sn distributed in κ phase is about 1.4 times the amount of Sn distributed in α phase. As the amount of Sn in κ phase is more than α phase, corrosion resistance of κ phase improves more. Because of the larger Sn content in κ phase, there is little difference in corrosion resistance between α phase and κ phase. Alternatively, at least a difference in corrosion resistance between α phase and κ phase is reduced. Therefore, the corrosion resistance of the alloy significantly improves.

However, addition of Sn promotes the formation of γ phase or β phase. Sn itself does not have an excellent machinability function, but improves the machinability of the alloy by forming γ phase having excellent machinability. On the other hand, γ phase deteriorates alloy's corrosion resistance, ductility, impact resistance, and high temperature properties, and weakens the strength. When the Sn content is about 0.5%, the amount of Sn distributed in γ phase is about 7 times to 15 times the amount of Sn distributed in α phase. That is, the amount of Sn distributed in γ phase is about 7 times to 15 times the amount of Sn distributed in α phase. γ phase including Sn improves corrosion resistance slightly more than γ phase not including Sn, which is insufficient. This way, addition of Sn to a Cu—Zn—Si alloy promotes the formation of γ phase although the corrosion resistance of κ phase and α phase is improved. Therefore, unless a mixing ratio between the essential elements of Cu, Si, P, and Pb is appropriately adjusted and an appropriate control of a metallographic structure state including the manufacturing process is performed, addition of Sn merely slightly improves the corrosion resistance of κ phase and α phase. Instead, an increase in γ phase causes deterioration in alloy corrosion resistance, ductility, impact resistance, high temperature properties, and tensile strength.

By increasing the Sn concentration in α phase and κ phase, α phase and κ phase are strengthened, and cavitation resistance, erosion-corrosion resistance, and wear resistance can be improved. Further, elongated κ phase present in α phase strengthens α phase and functions more effectively on these properties.

In addition, if κ phase contains Sn, machinability of κ phase improves. This effect is further improved by addition of P and Sn.

This way, corrosion resistance, cavitation resistance, erosion-corrosion resistance, wear resistance, normal-temperature strength, high temperature properties, impact resistance, and machinability are significantly affected by how Sn is utilized. If Sn is misused, an increase in γ phase causes deterioration of these properties.

By performing a control of a metallographic structure including the relational expressions and the manufacturing process described below, a copper alloy having excellent properties can be prepared. In order to exhibit the above-described effect, the lower limit of the Sn content is necessarily 0.40 mass % or higher, preferably 0.45 mass % or higher, and more preferably 0.48 mass % or higher.

On the other hand, when the Sn content is higher than 0.85 mass %, the proportion of γ phase increases regardless of any adjustment to the mixing ratio of the composition or to the manufacturing process. Also, the amount of solid solution of Sn in κ phase becomes excessively large, and the effects on cavitation resistance and erosion-corrosion resistance become saturated. The presence of an excess amount of Sn in κ phase deteriorates toughness of κ phase, and reduces alloy's ductility and impact resistance. The upper limit of the Sn content is 0.85 mass % or lower, preferably 0.77 mass % or lower, and more preferably 0.70 mass % or lower.

(Pb)

Inclusion of Pb improves the machinability of the copper alloy. About 0.003 mass % of Pb is solid-solubilized in the matrix, and when the Pb content exceeds 0.003 mass %, Pb is present in the form of Pb particles having a diameter of about 1 μm. The machinability of the alloy according to the embodiment is basically improved using the machinability-improvement function of κ phase that is harder than α phase, and is further improved due to a different action such as soft Pb particles. The alloy according to the embodiment has high machinability, for example, by containing Sn in κ phase, securing an appropriate amount of κ phase, making κ1 phase to be present in α phase. Therefore, even a small amount of Pb can exhibit a sufficient effect. When the Pb content is 0.005 mass % or higher, the effect is exhibited. The Pb content is preferably 0.006 mass % or higher.

Pb is harmful to a human body, and the alloy according to the embodiment contains a large amount of κ phase and it is difficult to contain 0% of γ phase. Therefore, as the Pb content increases, the influence on ductility, impact resistance, normal-temperature strength, and high temperature properties increases. The alloy according to the embodiment already has high machinability, and in consideration of influence on human body and the like, containing Pb in the amount lower than 0.020 mass % is sufficient. The Pb content is preferably 0.018 mass % or lower.

(P)

P improves dezincification corrosion resistance in a strict environment, machinability, cavitation resistance, erosion-corrosion resistance, and wear resistance. In particular, this effect becomes significant by adding Sn and P together.

The amount of P distributed in κ phase is about 2 times the amount of P distributed in α phase. That is, the amount of P distributed in κ phase is about 2 times the amount of P distributed in α phase. In addition, p has a significant effect of improving the corrosion resistance of α phase. However, when P is added alone, an effect of improving the corrosion resistance of κ phase is low. In cases where P is present together with Sn, the corrosion resistance of κ phase can be improved. However, P does not substantially improve the corrosion resistance of γ phase. In addition, the effect of P on machinability improvement is further improved by adding P and Sn together.

In order to exhibit the above-described effects, the lower limit of the P content is 0.05 mass % or higher, preferably 0.06 mass % or higher, and more preferably 0.07 mass % or higher.

On the other hand, in cases where the P content is higher than 0.14 mass %, the effect of improving corrosion resistance is saturated. In addition, impact resistance and ductility deteriorate due to an increase in the P concentration in κ phase, and machinability also deteriorates. A compound of P and Si is more likely to be formed, too. Therefore, the upper limit of the P content is 0.14 mass % or lower, preferably 0.13 mass % or lower, and more preferably 0.12 mass % or lower.

(Sb, As, Bi)

As in the case of P and Sn, both Sb and As significantly improve dezincification corrosion resistance and stress corrosion cracking resistance, in particular, in a strict environment.

In order to improve corrosion resistance due to addition of Sb, it is necessary to add 0.01 mass % or higher of Sb, and it is preferable to add 0.015 mass % or higher of Sb. On the other hand, even if the Sb content is higher than 0.08 mass %, the effect of improving corrosion resistance is saturated, and the proportion of γ phase increases instead. The Sb content is 0.08 mass % or lower, preferably 0.06 mass % or lower.

In order to improve corrosion resistance due to addition of As, it is necessary to add 0.02 mass % or higher of As, and it is preferable to add 0.025 mass % or higher. On the other hand, even if the As content is higher than 0.08 mass %, the effect of improving corrosion resistance is saturated. Therefore, the As content is 0.08 mass % or lower, preferably 0.06 mass % or lower.

By adding Sb alone, the corrosion resistance of α phase is improved. Sb is a low melting point metal having a higher melting point than Sn and exhibits similar behavior to Sn. The amount of Sn distributed in γ phase or κ phase is larger than the amount of Sn distributed in α phase, and thus the corrosion resistance of κ phase is improved. However, Sb has substantially no effect of improving the corrosion resistance of γ phase, and addition of an excess amount of Sb may increase the proportion of γ phase. Therefore, in order to use Sb, the proportion of γ phase is preferably 2.0% or lower.

Among Sn, P, Sb, and As, As strengthens the corrosion resistance of α phase. Even in cases where κ phase is corroded, the corrosion resistance of α phase is improved, and thus As functions to prevent the corrosion of α phase that occurs in a chain reaction. However, in either a case where As is added alone or a case where As is added together with Sn, P, and Sb, the effect of improving the corrosion resistance of κ phase and γ phase is low.

In cases where both Sb and As are added, even when the total content of Sb and As is higher than 0.10 mass %, the effect of improving corrosion resistance is saturated, and ductility and impact resistance deteriorate. Therefore, the total content of Sb and As is preferably 0.10 mass % or lower.

Bi further improves the machinability of the copper alloy. To that end, it is necessary to add 0.01 mass % or higher of Bi, and it is preferable to add 0.02 mass % or higher of Bi. On the other hand, harmfulness of Bi to a human body is not verified. However, from the viewpoint of an effect on impact resistance and high temperature properties, the upper limit of the Bi content is 0.10 mass % or lower, preferably 0.05 mass % or lower.

(Inevitable Impurities)

Examples of the inevitable impurities in the embodiment include Al, Ni, Mg, Se, Te, Fe, Mn, Co, Ca, Zr, Cr, Ti, In, W, Mo, B, Ag, and rare earth elements.

Conventionally, a free-cutting copper alloy is not mainly formed of a good-quality raw material such as electrolytic copper or electrolytic zinc but is mainly formed of a recycled copper alloy. In a subsequent step (downstream step, machining step) of the related art, almost all the members and components are machined, and a large amount of copper alloy is wasted at a proportion of 40 to 80%. Examples of the wasted copper alloy include chips, ends of an alloy material, burrs, runners, and products having manufacturing defects. This wasted copper alloy is the main raw material. If chips and the like are insufficiently separated, alloy becomes contaminated by Pb, Fe, Mn, Se, Te, Sn, P, Bi, Sb, As, Ca, Al, Zr, Ni, or rare earth elements of other free-cutting copper alloys. In addition, the chips include Fe, W, Co, Mo, and the like that originate in tools. The wasted materials include plated product, and thus are contaminated with Ni, Cr, and Sn. Mg, Fe, Te, Se, Cr, Ti, Co, In, and Ni are mixed into pure copper-based scrap. From the viewpoints of reuse of resources and costs, scrap such as chips including these elements is used as a raw material to the extent that such use does not have any adverse effects to the properties at least.

Empirically speaking, a large part of Ni that is mixed into the alloy comes from a scrap and the like, and Ni may be contained in an amount lower than 0.06 mass %, but it is preferable if the content is 0.05 mass % or lower.

Element like Fe, Mn, Co, or Cr forms an intermetallic compound with Si and, in some cases, forms an intermetallic compound with P and affect machinability, corrosion resistance, and other properties. Although depending on the content of Cu, Si, Sn, or P and the relational expression f1 or f2, Fe is likely to combine with Si, and inclusion of Fe may consume the same amount of Si as that of Fe and promotes the formation of a Fe—Si compound that adversely affects machinability. Therefore, the amount of each of Fe, Mn, Co, and Cr is preferably 0.05 mass % or lower and more preferably 0.04 mass % or lower. Further, Fe tends to form an intermetallic compound with P, which does not only result in consumption of P, but also deterioration in machinability caused by such intermetallic compound. Thus, the total content of Fe, Mn, Co, and Cr is preferably lower than 0.08 mass %. This total amount (the total amount of Fe, Mn, Co, and Cr) is more preferably lower than 0.07 mass %, and still more preferably lower than 0.06 mass % if possible in terms of raw material procurement.

On the other hand, it is not necessary to particularly limit the content of Ag because, in general, Ag can be considered as Cu and does not substantially affect various properties. However, the Ag content is preferably lower than 0.05 mass %.

Te and Se themselves have free-cutting nature, and can be mixed into an alloy in a large amount although it is rare. In consideration of influence on ductility or impact resistance, the content of each of Te and Se is preferably lower than 0.03 mass % and more preferably lower than 0.02 mass %.

The amount of each of Al, Mg, Ca, Zr, Ti, In, W, Mo, B, and rare earth elements as other elements is preferably lower than 0.03 mass %, more preferably lower than 0.02 mass %, and still more preferably lower than 0.01 mass %.

The amount of the rare earth elements refers to the total amount of one or more of Sc, Y, La, Ce, Pr, Nd, Pm, Sm, Eu, Gd, Tb, Dy, Ho, Er, Tm, Tb, and Lu.

It is desirable to manage and limit the amount of these inevitable impurities in consideration of influence on the properties of the alloy according to the embodiment.

(Composition Relational Expression f1)

The composition relational expression f1 is an expression indicating a relation between the composition and the metallographic structure. Even if the amount of each of the elements is in the above-described defined range, unless this composition relational expression f1 is not satisfied, the desired properties of the embodiment cannot be satisfied. In the composition relational expression f1, a large coefficient of −7.5 is assigned to Sn. When the composition relational expression f1 is lower than 75.0, although depending on other relational expressions, the proportion of γ phase increases, and a length of a long side of γ phase increases. As a result, corrosion resistance deteriorates, and normal-temperature strength decreases, ductility, impact resistance, high temperature properties, cavitation resistance, and erosion-corrosion resistance also deteriorate. Accordingly, the lower limit of the composition relational expression f1 is 75.0 or higher, preferably 75.5 or higher, and more preferably 75.8 or higher. As the composition relational expression f1 approaches the more preferable range, the area ratio of γ phase decreases. Even in cases where γ phase is present, γ phase is spheroidized. That is, a length of a long side of γ phase tends to be short, and corrosion resistance, impact resistance, ductility, normal-temperature strength, and high temperature properties are further improved.

On the other hand, when the Sn content is in the range of the embodiment, the upper limit of the composition relational expression f1 mainly affects the proportion of κ phase. When the composition relational expression f1 is higher than 78.2, the proportion of κ phase is excessively high, and μ phase is likely to precipitate. When the proportion of κ phase is excessively high, impact resistance, ductility, machinability, hot workability, and erosion-corrosion resistance deteriorate. Accordingly, the upper limit of the composition relational expression f1 is 78.2 or lower, preferably 77.7 or lower, and more preferably 77.3 or lower.

This way, by defining the composition relational expression f1 to be in the above-described range, a copper alloy having excellent properties can be obtained. As, Sb, and Bi as selective elements and the inevitable impurities that are separately defined have substantially no effect on the composition relational expression f1 in consideration of the contents thereof, and thus are not defined in the composition relational expression f1.

(Composition Relational Expression f2)

The composition relational expression f2 is an expression indicating a relation between the composition and workability, various properties, and the metallographic structure. When the composition relational expression f2 is lower than 60.0, the proportion of γ phase in the metallographic structure increases, and other metallic phases including β phase are likely to appear and are likely to remain. Therefore, corrosion resistance, ductility, impact resistance, cold workability, and high-temperature strength properties deteriorate. In addition, during hot forging, crystal grains are coarsened, and cracking is likely to occur. Accordingly, the lower limit of the composition relational expression f2 is 60.0 or higher, preferably 60.2 or higher, and more preferably 60.3 or higher.

On the other hand, when the composition relational expression f2 is higher than 61.5, hot deformation resistance is improved, hot deformability deteriorates, and surface cracking may occur in a hot extruded material or a hot forged product. In addition, coarse α phase having a length of more than 500 μm and a width of more than 150 μm in a direction parallel to a hot working direction may appear. When coarse α phase is present, machinability deteriorates, and strength decreases. In addition, γ phase having a long length of a long side is likely to be present at a boundary between α phase and κ phase increases, and corrosion resistance, cavitation resistance, erosion-corrosion resistance, high-temperature properties, and wear resistance deteriorate. On the other hand, the presence of the coarse α phase also affects the formation of acicular κ phase present in α phase, and as the value of f2 increases, κ1 phase becomes unlikely to be present. The upper limit of the composition relational expression f2 is 61.5 or lower, preferably 61.3 or lower, and more preferably 61.2 or lower. This way, by setting the composition relational expression f2 to be in a narrow range, excellent corrosion resistance, erosion-corrosion resistance, strength, machinability, hot workability, impact resistance, and high temperature properties can be obtained.

As, Sb, and Bi as selective elements and the inevitable impurities that are separately defined have substantially no effect on the composition relational expression f2 in consideration of the contents thereof, and thus are not defined in the composition relational expression f2.

(Composition Relational Expression f3)

Addition of 0.40 mass % or higher of Sn improves, in particular, cavitation resistance and erosion-corrosion resistance. In the embodiment, the proportion of γ phase in the metallographic structure decreases, and the amount of Sn in κ phase or α phase is effectively increased. Further, by adding Sn together with P, the effect is further improved. The composition relational expression f3 relates to a mixing ratio between P and Sn. When the value of P/Sn is 0.09 to 0.30, that is, the number of P atoms is 1/3 to 1.1 with respect to one Sn atom substantially in terms of atomic concentration, corrosion resistance, cavitation resistance, and erosion-corrosion resistance can be improved. f3 is preferably 0.10 or higher. In addition, the upper limit value of f3 is preferably 0.27 or lower. When the value of P/Sn is below the lower limit of the range, corrosion resistance, cavitation resistance, and erosion-corrosion resistance particularly deteriorate. When the value of P/Sn exceeds the higher limit of the range, impact resistance and ductility particularly deteriorates.

(Comparison to Patent Documents)

Here, the results of comparing the compositions of the Cu—Zn—Si alloys described in Patent Documents 3 to 12 and the composition of the alloy according to the embodiment are shown in Table 1.

The embodiment and Patent Document 3 are different from each other in the content of Pb. The embodiment and Patent Document 5 are different from each other as to whether P/Sn ratio is defined. The embodiment and Patent Document 4 are different from each other in the content of Pb. The embodiment and Patent Documents 6 and 7 are different from each other as to whether or not Zr is contained. The embodiment and Patent Document 8 are different from each other as to whether or not Fe is contained. The embodiment and Patent Document 9 are different from each other as to whether or not Pb is contained and also whether or not Fe, Ni, and Mn are contained. Patent Document 10 is different from the embodiment since Sn, P, and Pb are not contained in Document 10. Patent Document 5 is silent about strength, machinability, κ1 phase present in α phase contributing to wear resistance, f2, and f7, and the strength balance is also low. Patent Document 11 relates to brazing in which heating is performed at 700° C. or higher, and relates to a brazed structure. Patent Document 12 relates to a material that is to be rolled for producing a threaded bolt or a gear.

As described above, the alloy according to the embodiment and the Cu—Zn—Si alloys described in Patent Documents 3 to 12 are different from each other in the compositional ranges.

TABLE 1

| | Cu | Si | Sn | P | Pb | Other Essential Elements |
|---|---|---|---|---|---|---|
| First Embodiment | 76.0-78.7 | 3.1-3.6 | 0.40-0.85 | 0.05-0.14 | 0.005 to less than 0.020 | — |
| Second Embodiment | 76.5-78.3 | 3.15-3.5 | 0.45-0.77 | 0.06-0.13 | 0.006-0.018 | — |
| Patent Document 3 | 69-79 | 2.0-4.0 | 0.3-3.5 | 0.02-0.25 | — | — |
| Patent Document 4 | 69-79 | 2.0-4.0 | 0.3-3.5 | 0.02-0.25 | 0.02-0.4 | — |
| Patent Document 5 | 71.5-78.5 | 2.0-4.5 | 0.1-1.2 | 0.01-0.2 | 0.005-0.02 | — |
| Patent Document 6 | 69-88 | 2-5 | 0.1-2.5 | 0.01-0.25 | 0.004-0.45 | Zr: 0.0005-0.04 |
| Patent Document 7 | 69-88 | 2-5 | 0.05-1.5 | 0.01-0.25 | 0.005-0.45 | Zr: 0.0005-0.04 |
| Patent Document 8 | 74.5-76.5 | 3.0-3.5 | 0.05-0.2 | 0.04-0.10 | 0.01-0.25 | Fe: 0.11-0.2 |
| Patent Document 9 | 70-83 | 1-5 | 0.01-2 | 0.1 or less | — | Fe, Co: 0.01-0.3<br>Ni: 0.01-0.3<br>Mn: 0.01-0.3 |
| Patent Document 10 | — | 0.25-3.0 | — | — | — | — |

TABLE 1-continued

| | Cu | Si | Sn | P | Pb | Other Essential Elements |
|---|---|---|---|---|---|---|
| Patent Document 11 | 73.0-79.5 | 2.5-4.0 | 0.03-1.0 | 0.015-0.2 | 0.003-0.25 | — |
| Patent Document 12 | 73.5-79.5 | 2.5-3.7 | 0.03-1.0 | 0.015-0.2 | 0.003-0.25 | — |

<Metallographic Structure>

In Cu—Zn—Si alloys, 10 or more kinds of phases are present, complicated phase change occurs, and desired properties cannot be necessarily obtained simply by defining the composition ranges and relational expressions of the elements. By specifying and determining the kinds of metallic phases that are present in a metallographic structure and the ranges thereof, desired properties can finally be obtained.

In the case of Cu—Zn—Si alloys including a plurality of metallic phases, the corrosion resistance level varies between phases. Corrosion begins and progresses from a phase having the lowest corrosion resistance, that is, a phase that is most prone to corrosion, or from a boundary between a phase having low corrosion resistance and a phase adjacent to such phase. In the case of Cu—Zn—Si alloys including three elements of Cu, Zn, and Si, for example, when corrosion resistances of α phase, α' phase, β phase (including β' phase), κ phase, γ phase (including γ' phase), and μ phase are compared, the ranking of corrosion resistance is: α phase>α' phase>κ phase>μ phase≥γ phase>β phase. The difference in corrosion resistance between κ phase and μ phase is particularly large.

Compositions of the respective phases vary depending on the composition of the alloy and the area ratios of the respective phases, and the following can be said.

Si concentration of each phase is higher in the following order: μ phase>γ phase>κ phase>α phase>α' phase≥β phase. The Si concentrations in μ phase, γ phase, and κ phase are higher than the Si concentration in the alloy. In addition, the Si concentration in μ phase is about 2.5 times to about 3 times the Si concentration in α phase, and the Si concentration in γ phase is about 2 times to about 2.5 times the Si concentration in α phase.

Cu concentration is higher in the following order: μ phase>κ phase≥α phase>α' phase≥γ phase>β phase. The Cu concentration in μ phase is higher than the Cu concentration in the alloy.

In the Cu—Zn—Si alloys described in Patent Documents 3 to 6, a large part of γ phase, which has the highest machinability-improving function, is present together with α' phase or is present at a boundary between κ phase and α phase. When used in water that is bad for copper alloys or in an environment that is harsh for copper alloys, γ phase becomes a source of selective corrosion (origin of corrosion) such that corrosion progresses. Of course, when β phase is present, β phase starts to corrode before γ phase. When μ phase and γ phase are present together, phase starts to corrode slightly later than or at the same time as γ phase. For example, when α phase, κ phase, γ phase, and μ phase are present together, if dezincification corrosion selectively occurs in γ phase or μ phase, the corroded γ phase or μ phase becomes a corrosion product (patina) that is rich in Cu due to dezincification. This corrosion product causes κ phase or α' phase adjacent thereto to be corroded, and corrosion progresses in a chain reaction.

The water quality of drinking water varies across the world including Japan, and under this water quality, corrosion is likely to occur due to a copper alloy. For example, the concentration of residual chlorine, which has an upper limit but is used for disinfection due to safety to a human body, increases, and thus a copper alloy forming a device for water supply is likely to be corroded. The description or more of drinking water is applicable to corrosion resistance in a usage environment where a large amount of a solution is present, for example, usage environments of members including the automobile components, the mechanical components, and the industrial pipes described above. In addition, in order to satisfy requirements of the recent years, for example, to secure corrosion resistance in high-temperature or high-speed fluid, to secure reliability of a high-pressure vessel or a high-pressure valve or to realize reduction in thickness and weight, a copper alloy member having a high strength and excellent high temperature creep and having excellent cavitation resistance and erosion-corrosion resistance is necessary.

On the other hand, even if the amount of γ phase, or the amounts of γ phase, μ phase, and β phase are controlled, that is, the proportions of the respective phases are significantly reduced or are made to be zero, the corrosion resistance of a Cu—Zn—Si alloy including the two phases of α phase and κ phase is not perfect. Depending on the environment where corrosion occurs, κ phase having lower corrosion resistance than α phase may be selectively corroded, and it is necessary to improve the corrosion resistance of κ phase. Further, in cases where κ phase is corroded, the corroded κ phase becomes a corrosion product that is rich in Cu. This corrosion product causes α phase to be corroded, and thus it is also necessary to improve the corrosion resistance of α phase.

In addition, γ phase is a hard and brittle phase. Therefore, when a large load is applied to a copper alloy member, the γ phase microscopically becomes a stress concentration source. γ phase becomes a stress concentration source and thus makes a point where chip parting begins promotes chip parting, and reduces cutting resistance during cutting. This way, although γ phase leads to machinability improvement, it increases stress corrosion cracking sensitivity and deteriorates ductility and impact resistance. In addition, high-temperature strength deteriorates due to a high-temperature creep phenomenon. As in the case of γ phase, μ phase is a hard phase containing a large amount of Si and is mainly present at a grain boundary of α phase or at a phase boundary between α phase and κ phase. Therefore, as in the case of γ phase, μ phase microscopically becomes a stress concentration source. Due to being a stress concentration source or a grain boundary sliding phenomenon, μ phase deteriorates ductility and impact resistance and deteriorates high-temperature strength. In addition, γ phase and μ phase deteriorate cavitation resistance and erosion-corrosion resistance. Although μ phase becomes a stress concentration source like γ phase, the effect of improving machinability is smaller than that of γ phase.

However, if the proportion of γ phase or the proportions of γ phase and μ phase are significantly reduced or are made to be zero in order to improve corrosion resistance and the above-mentioned properties, satisfactory machinability may not be obtained merely by containing a small amount of Pb and the two phases of α phase and κ phase. Therefore, providing that the alloy with a small amount of Pb has excellent machinability, it is necessary that constituent phases of a metallographic structure (metallic phases or crystalline phases) are defined as follows in order to improve corrosion resistance in a harsh environment, ductility, impact resistance, strength, high-temperature strength, cavitation resistance, and erosion-corrosion resistance.

Hereinafter, the unit of the proportion of each of the phases is area ratio (area %).

(γ Phase)

γ phase is a phase that contributes most to the machinability of Cu—Zn—Si alloys. In order to improve corrosion resistance, cavitation resistance, erosion-corrosion resistance, ductility, strength, high temperature properties, and impact resistance in a harsh environment, it is necessary to limit γ phase. In order to improve corrosion resistance, cavitation resistance, and erosion-corrosion resistance, it is necessary to add Sn, and as the Sn content increases, the proportion of γ phase further increases. In order to obtain sufficient machinability and corrosion resistance at the same time when Sn has such contradicting effects, the Sn content, the P content, the composition relational expressions f1, f2, and 3, the metallographic structure relational expressions described below, and the manufacturing process are limited.

(β Phase and Other Phases)

In order to obtain excellent corrosion resistance, cavitation resistance, and erosion-corrosion resistance, and high ductility, impact resistance, strength, and high-temperature properties, the proportions of β phase, γ phase, μ phase, and other phases such as ζ phase in a metallographic structure are particularly important.

The proportion of β phase needs to be at least 0% to 0.3% and is preferably 0.1% or lower, and it is most preferable that β phase is not present.

The proportion of phases such as phase other than α phase, κ phase, β phase, γ phase, and μ phase is preferably 0.3% or lower and more preferably 0.1% or lower. It is most preferable that the other phases such as c phase are not present.

First, in order to obtain excellent corrosion resistance, it is necessary that the proportion of γ phase is 0% to 2.0% and a length of a long side of γ phase is 50 μm or less.

The length of the long side of γ phase is measured using the following method. For example, using a 500-fold or 1000-fold metallographic micrograph, the maximum length of the long side of γ phase is measured in one visual field. This operation is performed mainly in five arbitrarily selected visual fields as described below. The average value of maximum lengths of long sides of γ phase obtained from the respective visual fields is calculated as the length of the long side of γ phase. Therefore, the length of the long side of γ phase will also be referred to as the maximum length of the long side of γ phase.

The proportion of γ phase is preferably 1.5% or lower, more preferably 1.0% or lower, and still more preferably 0.5% or lower. Even if the proportion of γ phase having an excellent machinability function is 0.5% or lower, the alloy can exhibit excellent machinability by including κ phase, whose machinability has been improved by containing Sn and P, and a small amount of Pb, and also by κ phase present in α phase (κ1 phase).

Since the length of the long side of γ phase has an effect on corrosion resistance, the length of the long side of γ phase is 50 μm or less, preferably 40 μm or less, more preferably 30 μm or less, and most preferably 20 μm or less.

The larger the amount of γ phase is, the more likely γ phase is selectively corroded, and Sn and P, which are effective elements, become less likely to be effectively distributed in kappa phase. In addition, as the length of γ phase increases, corrosion is more likely to selectively occur, and the progress of corrosion in a depth direction is promoted. Not only the amount of γ phase but also the length of long side of γ phase have an effect on properties other than corrosion resistance. Long series of γ phase is mainly present at a boundary between α phase and κ phase, and weakens normal-temperature strength due to decreased ductility, and deteriorate impact resistance, high temperature properties, wear resistance, and cavitation resistance.

The proportion of γ phase and the length of the long side of γ phase are closely related to the contents of Cu, Sn, and Si and the composition relational expressions f1 and f2.

As the proportion of γ phase increases, ductility, impact resistance, normal-temperature strength, high-temperature strength, stress corrosion cracking resistance, and wear resistance deteriorate. The proportion of γ phase is necessarily 2.0% or lower, preferably 1.5% or lower, more preferably 1.0 or lower, and still more preferably 0.5% or lower. When a high stress is applied, γ phase present in a metallographic structure becomes as a stress concentration source. In addition, in combination with BCC as a crystal structure of γ phase, normal-temperature strength, high-temperature strength, impact resistance, and stress corrosion cracking resistance deteriorate.

(μ Phase)

μ phase affects corrosion resistance, cavitation resistance, erosion-corrosion resistance, ductility, impact resistance, and high temperature properties. Therefore, it is necessary that the proportion of μ phase is at least 0% to 2.0%. The proportion of μ phase is preferably 1.0% or lower and more preferably 0.3% or lower, and it is most preferable that μ phase is not present. μ phase is mainly present at a grain boundary or a phase boundary. Therefore, in a harsh environment, grain boundary corrosion occurs at a grain boundary where μ phase is present. In addition, when impact is applied, cracks are more likely to develop from hard μ phase present at a grain boundary. In addition, for example, when a copper alloy is used in a valve used around the engine of a vehicle or in a high-temperature, high-pressure gas valve, if the copper alloy is held at a high temperature of 150° C. for a long period of time, grain boundary sliding occurs, and creep is more likely to occur. Therefore, it is necessary to limit the amount of μ phase, and at the same time limit the length of the long side of μ phase that is mainly present at a grain boundary to 25 μm or less. The length of the long side of μ phase is preferably 15 μm or less, more preferably 5 μm or less, and most preferably 2 μm or less.

The length of the long side of μ phase is measured using the same method as the method of measuring the length of the long side of γ phase. That is, by mainly using a 500-fold or 1000-fold metallographic micrograph or using a 2000-fold or 5000-fold secondary electron micrograph (electron micrograph) according to the size of μ phase, the maximum length of the long side of μ phase in one visual field is measured. This operation is performed in five arbitrarily chosen visual fields. The average maximum length of the long sides of μ phase calculated from the lengths measured in the respective visual fields is regarded as the length of the long side of μ phase. Therefore, the length of the long side of μ phase can be referred to as the maximum length of the long side of μ phase.

(κ Phase)

Under recent high-speed cutting conditions, the machinability of a material including cutting resistance and chip dischargeability is important. However, in order to obtain excellent machinability in a state where the proportion of γ phase having the highest machinability-improvement function is limited to be 2.0% or lower and the Pb content having an excellent machinability-improvement function is limited to be lower than 0.020 mass %, the proportion of κ phase needs to be at least 30% or higher. The proportion of κ phase is preferably 33% or higher and more preferably 35% or higher.

κ phase is less brittle, is richer in ductility, and has higher corrosion resistance than γ phase, μ phase, and β phase. γ phase and μ phase are present along a grain boundary or a phase boundary of α phase, but this tendency is not shown in κ phase. In addition, κ phase has higher strength, machinability, cavitation resistance, wear resistance, and high temperature properties than α phase except ductility. If the metallographic structure where α phase and κ phase are mixed, which is the metallographic structure of the alloy according to the embodiment, is appropriately proportioned between phases, and further, α phase and κ phase are improved, it is possible to create a copper alloy having various mechanical properties including machinability and various kinds of corrosion resistance.

As κ phase increases, machinability is improved. In addition, since κ phase is a hard phase, tensile strength is improved. On the other hand, as κ phase increases, ductility and impact resistance gradually deteriorate.

When the proportion of κ phase exceeds 60% and reaches about 2/3, the nature of κ phase which is very strong and hard exceeds the machinability-improvement function. As a result, cutting resistance increases, and chip partibility deteriorates. Concurrently, ductility and impact resistance deteriorate, and tensile strength is also saturated along with deterioration in ductility. Accordingly, by making about 1/3 or higher of soft α phase and 3/2 or lower of hard κ phase to be present together in the metallographic structure, excellent properties of κ phase such as machinability or high strength excel the problems in the ductility and impact resistance of κ phase. In addition, in the embodiment, the Sn content in κ phase is about 0.43 mass % to about 0.90 mass %. Therefore, the cavitation resistance, erosion-corrosion resistance, corrosion resistance, wear resistance, and machinability-improvement function of κ phase are higher, whereas the ductility and impact resistance of κ phase have further deteriorated. Accordingly, in consideration of machinability, ductility, and impact resistance, it is necessary to set the proportion of κ phase to be at least 65% or lower. The proportion of κ phase is preferably 60% or lower, more preferably 56% or lower, and still more preferably 52% or lower.

Concurrently, acicular κ phase (κ1 phase) can be made to be present in α phase by adjusting the composition and the manufacturing process conditions. By making κ phase to be present in α phase, machinability, strength, high temperature properties, and wear resistance of α phase itself can be improved in terms of mechanical properties, and cavitation resistance and erosion-corrosion resistance can also be improved. As a result, machinability, normal-temperature strength, high temperature properties, corrosion resistance, cavitation resistance, erosion-corrosion resistance, and wear resistance of the alloy are improved.

(α Phase, Other Improvements)

α Phase is a main phase that forms a matrix and is a source of the properties of all the copper alloys including the alloy according to the embodiment. α phase is most rich in ductility and toughness and is a phase that has so-called viscosity. However, viscosity of α phase raises cutting resistance of the alloy and make chips continuous. In order to obtain good machinability-improvement function and mechanical properties of α phase, Sn is contained in α phase to slightly lower the viscosity of α phase. If acicular κ phase (κ1 phase) is present in α phase, the machinability-improvement function of α phase itself is further improved, and the strength and wear resistance are significantly improved. Accordingly, by the presence of an appropriate amount of κ1 phase in α phase, the machinability, strength, wear resistance, cavitation resistance, erosion-corrosion resistance, and high temperature properties of the alloy are improved without deterioration in ductility or toughness. In the alloy according to the embodiment, due to the presence of κ1 phase, the machinability of α phase itself is improved, and an excellent machinability-improvement function can be obtained with a small amount of Pb.

(Presence of Elongated Acicular κ Phase (κ1 phase) in α Phase)

When the requirements of the composition, the composition relational expressions f1 and f2, and the process are satisfied, acicular κ phase (κ1 phase) starts to appear in α phase. This κ phase is harder than α phase. The thickness of κ phase (κ1 phase) present in α phase is about 0.1 μm to about 0.2 μm (about 0.05 μm to about 0.5 μm), and this κ phase (κ1 phase) is thin, elongated, and acicular. Due to the presence of acicular κ1 phase in α phase, the following effects are obtained.

1) α phase is strengthened, and the tensile strength of the alloy is improved.

2) The machinability of α phase is improved, and the machinability improvement of the alloy such as decrease in cutting resistance or improvement of chip partibility can be achieved.

3) Since the κ1 phase is present in α phase, there is no bad influence on the corrosion resistance of the alloy.

4) α phase is strengthened, and the wear resistance of the alloy is improved.

5) Since the κ1 phase is present in α phase, there is a small influence on ductility and impact resistance.

The acicular κ phase present in α phase is affected by a constituent element such as Cu, Zn, or Si or a relational expression. When the requirements of the composition and the metallographic structure of the embodiment are satisfied, if the amount of Si exceeds about 3.0 mass %, acicular κ1 phase starts to be present in α phase. When the amount of Si is about 3.1 mass % to about 3.15 mass %, κ1 phase becomes more clearly present in α phase. However, the presence of κ1 phase is significantly affected by the composition relational expression f2 or f1, and when the value of f2 is high, κ1 phase is less likely to be present.

On the other hand, as the proportion of κ1 phase in α phase increases, that is, the amount of κ1 phase excessively increases, the ductility and impact resistance of α phase deteriorate. As a result, the ductility and impact resistance of the alloy deteriorate, and the strength also decreases. The proportion of κ1 phase in α phase is proportionate mainly to the proportion of κ phase in the metallographic structure, and is also affected by the contents of Cu, Si, and Zn and the relational expression. When the proportion of κ phase exceeds 65%, the proportion of κ1 phase present in α phase is excessively high. From the viewpoint of obtaining an appropriate amount of κ1 phase present in α phase, the amount of κ phase in the metallographic structure is 65% or lower and preferably 60% or lower and, when ductility or impact resistance is important, is preferably 56% or lower and more preferably 52% or lower.

κ1 phase present in α phase can be recognized as an elongated linear material or acicular material when enlarged with a metallographic microscope at a magnification of 500-fold, in some cases, about 1000-fold. However, since it is difficult to calculate the area ratio of κ1 phase, it should be noted that the area ratio of κ1 phase in α phase is included in the area ratio of α phase.

(Metallographic Structure Relational Expressions f4, f5, and f6)

In order to obtain excellent various corrosion resistances, ductility, strength, impact resistance, and high-temperature properties, the total proportion of α phase, which is the main phase having good ductility and excellent corrosion resistance, and κ phase (metallographic structure relational expression f4=(α)+(κ)) is 96.5% or higher. The value of f4 is preferably 97.5% or higher, more preferably 98% or higher, and most preferably 98.5% or higher. Since the range of κ phase is defined, the range of α phase is also determined. Likewise, the total proportion of α phase, κ phase, γ phase, μ phase (metallographic structure relational expression f5=(α)+(κ)+(γ)+(i)) is 99.4% or higher and preferably 99.6% or higher.

Further, it is necessary that the total proportion of γ phase and μ phase (f6=(γ)+(μ)) is 0 or higher and 3.0% or lower. The value of f6 is preferably 2.0% or lower, more preferably 1.0% or lower, and most preferably 0.5% or lower.

Here, regarding the metallographic structure relational expressions f4 to f6, 10 kinds of metallic phases including α phase, β phase, γ phase, δ phase, ε phase, ζ phase, η phase, κ phase, μ phase, and χ phase are targets, and an intermetallic compound, Pb particles, an oxide, a non-metallic inclusion, a non-melted material, and the like are not targets. In addition, κ1 phase is included in α phase, and μ phase which is unable to be observed with a metallographic microscope having a magnification power of 500× or 1000× is excluded. Intermetallic compounds that are formed by Si, P, and inevitably incorporated elements (for example, Fe, Co, and Mn) are excluded from the area ratio of a metallic phase. However, these intermetallic compounds have an effect on machinability, and thus it is necessary to pay attention to the inevitable impurities.

(Metallographic Structure Relational Expression f7)

The alloy according to the embodiment has excellent machinability while Pb, which is harmful to human body, is contained in the very minimum amount in the Cu—Zn—Si alloy.

The alloy needs to have particularly excellent corrosion resistance, cavitation resistance, erosion-corrosion resistance, impact resistance, ductility, wear resistance, normal-temperature strength, and high-temperature properties. However, γ phase improves machinability, but for obtaining excellent corrosion resistance and impact resistance, presence of γ phase has an adverse effect.

Metallographically, it is preferable to contain a large amount of γ phase having the highest machinability. However, from the viewpoints of corrosion resistance, impact resistance, and other properties, it is necessary to reduce the amount of γ phase. It was found from experiment results that, when the proportion of γ phase is 2.0% or lower, it is necessary that the value of the metallographic structure relational expression f7 is in an appropriate range in order to obtain excellent machinability.

With respect to metallographic structure relational expression f7, γ phase has the highest machinability. In particular, when the amount of γ phase is small, that is, the area ratio of γ phase is 2.0% or lower, γ phase effectively contributes to machinability improvement. For this reason, a coefficient that is six times that of κ phase is assigned to the square root value of the proportion (%) of γ phase. In addition, since κ phase includes Sn, machinability of Sn is improved. Therefore, a coefficient of 1.05 is assigned to κ phase, and this coefficient is two times or more that of μ phase. In order to obtain excellent machinability, it is necessary that the value of the metallographic structure relational expression f7 is 35 or higher, preferably 38 or higher, and more preferably 42 or higher.

On the other hand, when the value of the metallographic structure relational expression f7 is higher than 70, cutting resistance becomes higher and chip partibility deteriorates. Further, impact resistance and ductility deteriorate, and strength declines due to deterioration in ductility. Therefore, the value of the metallographic structure relational expression f7 is 70 or lower, preferably 65 or lower, more preferably 60 or lower, and still more preferably 55 or lower.

(Amounts of Sn and P in κ phase)

In order to improve the corrosion resistance of κ phase, in the alloy, the amount of Sn is preferably 0.43 mass % to 0.90 mass % and the amount of P is preferably 0.06 mass % to 0.22 mass %.

In the alloy according to the embodiment, when the Sn content is in the above-described range and the amount of Sn distributed in α phase is 1, the amount of Sn distributed in κ phase is about 1.4, the amount of Sn distributed in γ phase is about 7 to about 15, and the amount of Sn distributed in μ phase is about 2. For example, in the case of the alloy according to the embodiment, in a Cu—Zn—Si alloy including 0.5 mass % of Sn, when the proportion of α phase is 50%, the proportion of κ phase is 49%, and the proportion of γ phase is 1%, the Sn concentration in α phase is about 0.38 mass %, the Sn concentration in κ phase is about 0.53 mass %, and the Sn concentration in γ phase is about 4 mass %. When the area ratio of γ phase is high, the amount of Sn consumed in γ phase increases, and the amounts of Sn distributed in κ phase and α phase are reduced. Accordingly, if where the amount of γ phase is small, Sn is effectively used for corrosion resistance and machinability as described below.

On the other hand, assuming that the amount of P distributed in α phase is 1, the amount of P distributed in κ phase is about 2, the amount of P distributed in γ phase is about 3, and the amount of P distributed in μ phase is about 4. For example, in the case of the alloy according to the embodiment, in a Cu—Zn—Si alloy including 0.1 mass % of P, when the proportion of α phase is 50%, the proportion of κ phase is 49%, and the proportion of γ phase is 1%, the P concentration in α phase is about 0.06 mass %, the P concentration in κ phase is about 0.12 mass %, and the P concentration in γ phase is about 0.18 mass %.

Both Sn and P improve the corrosion resistance of α phase and κ phase, and the amount of Sn and the amount of P in κ phase are about 1.4 times and about 2 times the amount of Sn and the amount of P in α phase, respectively. That is, the amount of Sn in κ phase is about 1.4 times the amount of Sn in α phase, and the amount of P in κ phase is about 2 times the amount of P in α phase. Therefore, the degree of improvement in corrosion resistance of κ phase is higher than that of α phase. As a result, the corrosion resistance of κ phase approaches the corrosion resistance of α phase. Then, when P/Sn ratio (f3) is appropriate, the cavitation resistance, erosion-corrosion resistance, and corrosion resistance further improve.

When the Sn content in the copper alloy is 0.40 mass % or lower, there is a problem in cavitation resistance and erosion-corrosion resistance under strict conditions. This problem can be solved by increasing the Sn content, increasing the concentrations of Sn and P in κ phase, and controlling a concentration ratio between P and Sn. Simultaneously, corrosion resistance can be improved. In addition, when a large amount of Sn is distributed in κ phase, machinability of κ phase is improved. As a result, loss of machinability caused by a decrease in the amount of γ phase can be compensated for.

On the other hand, a large amount of Sn is distributed in γ phase. However, even if γ phase includes a large amount of Sn, corrosion resistance of γ phase is not substantially improved, and there is a small effect of improving cavitation resistance and erosion-corrosion resistance. The main reason for this is presumed to be that the crystal structure of γ phase is a BCC structure. On the contrary, if the proportion of γ phase is high, the amount of Sn distributed in κ phase is small. Therefore, the degree to which corrosion resistance, cavitation resistance, and erosion-corrosion resistance of κ phase are improved is low. Therefore, the Sn concentration in κ phase is preferably 0.43 mass % or higher, more preferably 0.47 mass % or higher, and still more preferably 0.54 mass % or higher. κ phase inherently has lower ductility and toughness than α phase, and when the Sn concentration in κ phase reaches 1 mass %, ductility and toughness of κ phase deteriorate. Accordingly, the Sn concentration in κ phase is preferably 0.90 mass % or lower, more preferably 0.84 mass % or lower, and still more preferably 0.78 mass % or lower. When κ phase includes a predetermined amount of Sn, corrosion resistance, cavitation resistance, and erosion-corrosion resistance are improved without a significant deterioration in ductility and toughness, and machinability and wear resistance are also improved.

As in the case of Sn, when a large amount of P is distributed in κ phase, corrosion resistance, cavitation resistance, and erosion-corrosion resistance improve, and the machinability of κ phase also improves. However, when an excessive amount of P is contained, P is consumed for the formation of an intermetallic compound with Si such that the properties deteriorate, or when P is excessively solid solubilized in κ phase, ductility and toughness of κ phase are impaired, which causes deterioration of impact resistance and ductility of the alloy, and weakening of strength due to deteriorated ductility. The P concentration in κ phase is preferably 0.06 mass % or higher, more preferably 0.07 mass % or higher, and still more preferably 0.08 mass % or higher. The upper limit of the P concentration in κ phase is preferably 0.22 mass % or lower, more preferably 0.19 mass % or lower, and still more preferably 0.16 mass % or lower.

By adding P and Sn together, corrosion resistance, cavitation resistance, erosion-corrosion resistance, wear resistance, and machinability are improved.

<Properties>

(Normal-Temperature Strength and High-Temperature Strength)

As a strength required in various fields including fittings, plumbing, valves, automotive valves, or vessels in a high-pressure hydrogen environment such as a hydrogen station or hydrogen power generation, tensile strength is important. In the case of the pressure vessel, an allowable stress thereof is affected by the tensile strength. In addition, a valve used in an environment close to the engine room of an automobile or a high-temperature high-pressure valve, for example, is used in an environment where the temperature reaches about 150° C. at a maximum. However, deformation or fracture should not occur when a pressure or a stress is applied in such an environment. Since hydrogen embrittlement does not occur to the alloy according to the embodiment, when the alloy according to the embodiment has a high strength, the allowable stress and the allowable pressure increase such that the alloy can be used more safely for uses where hydrogen is involved.

To that end, it is preferable that hot extruded materials and hot forged materials, which are hot worked materials, have high strength having a tensile strength of 550 N/mm$^2$ or higher at a normal temperature. The tensile strength at a normal temperature is preferably 565 N/mm$^2$ or higher, more preferably 575 N/mm$^2$ or higher, and most preferably 590 N/mm$^2$ or higher. A free-cutting hot forged alloy having a high tensile strength of 590 N/mm$^2$ or higher is not found except the alloy according to the embodiment. In general, cold working is not performed on hot forged materials. For example, even though a material's surface can be hardened by shot peening, the cold working ratio is merely about 0.1% to 2.5% in effect, and the improvement of the tensile strength is about 2 to 40 N/mm$^2$. Pressure resistance depends on tensile strength, and a high tensile strength is required for a member such as a pressure vessel or a valve to which a pressure is applied. Therefore, the forged material according to the embodiment is suitable for a member such as a pressure vessel or a valve to which a pressure is applied.

The alloy according to the embodiment undergoes a heat treatment under an appropriate temperature condition that is higher than the recrystallization temperature of the material or undergoes an appropriate thermal history to improve the tensile strength. Specifically, although depending on the composition or the heat treatment conditions, the tensile strength is improved by about 10 to about 60 N/mm$^2$ as compared to the hot worked material before the heat treatment. Except for Corson alloy or an age-hardening alloy such as Ti—Cu, an example of increasing the tensile strength due to the heat treatment at a temperature higher than the recrystallization temperature is not substantially found as a copper alloy. The reason why the strength of the alloy according to the embodiment is presumed as follows. By performing the heat treatment at a temperature of 515° C. to 575° C. under appropriate conditions, α phase or κ phase in the matrix is softened. On the other hand, the strengthening of α phase due to the presence of acicular κ phase in α phase, an increase in maximum load that can be withstood before breakage due to improvement of ductility caused by a decrease in the amount of γ phase, and an increase in the proportion of κ phase significantly surmounts the softening of α phase and κ phase. The alloy according to the embodiment has the above-described metallographic structure state. As a result, as compared to the hot worked material before the heat treatment, not only corrosion resistance but also tensile strength, ductility, impact value, and cold workability are significantly improved, and an alloy having high strength, high ductility, and high toughness is prepared.

On the other hand, the hot worked material is drawn, wire-drawn, or rolled in a cold state after an appropriate heat treatment to improve the strength. When cold working is performed on the alloy according to the embodiment, at a cold working ratio of 15% or lower, the tensile strength increases by 12 N/mm$^2$ per 1% of cold working ratio. On the other hand, the impact resistance and the Charpy impact test value decrease by about 4% per 1% of cold working ratio. Otherwise, an impact value $I_R$ after cold working under the condition that the cold working ratio is 20% or lower can be substantially defined by $I_R=I_0\times\{20/(20+RE)\}$, where $I_0$ represents the impact value of the heat treated material and RE % represents the cold working ratio. For example, when an alloy material having a tensile strength of 570 N/mm$^2$ and an impact value of 30 J/cm$^2$ is cold-drawn at a cold working ratio 5% to prepare a cold worked material, the tensile strength of the cold worked material is about 630 N/mm$^2$, and the impact value is about 24 J/cm$^2$. When the cold working ratio varies, the tensile strength and the impact value cannot be uniquely determined. This way, when cold working is performed, the tensile strength increases, but the impact value and the elongation deteriorates. In order to obtain a strength, an elongation, and an impact value according to the intended use, it is necessary to set an appropriate cold working ratio.

Regarding the high-temperature strength (property), it is preferable that a creep strain after exposing (holding) the copper alloy at 150° C. for 100 hours in a state where a stress corresponding to 0.2% proof stress at room temperature is applied is 0.4% or lower. This creep strain is more preferably 0.3% or lower and still more preferably 0.2% or lower. As a result, a copper alloy that is not likely to be deformed even when exposed to a high temperature and has high-temperature strength is obtained.

(Normal-Temperature Strength, Ductility, and Cold Workability)

Even when machinability is excellent and tensile strength is high, if ductility and toughness are poor, the use of the alloy is limited. Machinability requires a material to have some kind of brittleness since chips are to be separated during machining. Although tensile strength and ductility are contrary to each other, it is desired that tensile strength and ductility (elongation) are highly balanced. Regarding a hot worked material that undergoes a heat treatment step or a material that undergoes cold working before and after a heat treatment after hot working, one yardstick to determine whether such a material has high strength and high ductility is that if the tensile strength is 550 N/mm$^2$ or higher, the elongation is 12% or higher, and the value of $f8=S\times\{(E+100)/100\}^{1/2}$, which is the product of the tensile strength (S), and the value of {(Elongation (E %)+100)/100} raised to the power ½ is 650 or higher, the material can be regarded as having high strength and high ductility. The value of f8 is more preferably 665 or higher, and still more preferably 680 or higher.

Incidentally, the strength balance index f8 is not applicable to castings because crystal grains of casting are likely to coarsen and may include microscopic defects.

Incidentally, in the case of free-cutting brass including 60 mass % of Cu, 3 mass % of Pb with a balance including Zn and inevitable impurities, tensile strength at a normal temperature is 360 N/mm$^2$ to 400 N/mm$^2$ when formed into a hot extruded material or a hot forged product, and the elongation is 35% to 45%. That is, the value of f8 is about 450. In addition, after the alloy is exposed to 150° C. for 100 hours in a state where a stress corresponding to 0.2% proof stress at room temperature is applied, the creep strain is about 4% to 5%. Therefore, the tensile strength and heat resistance of the alloy according to the embodiment are much higher than those of conventional free-cutting brass including Pb. That is, the alloy according to the embodiment has excellent corrosion resistance of various kinds and high strength at room temperature, and scarcely deforms even after being exposed to a high temperature for a long period of time. Therefore, a reduction in thickness and weight can be realized using the high strength. In particular, in the case of a forged material such as a high-pressure valve or a valve for high-pressure hydrogen, cold working cannot be performed. Therefore, an increase in allowable pressure and a reduction in thickness and weight can be realized using the high strength.

In the case of the alloy according to the embodiment, there is little difference in the properties under high temperature between a hot forged material, an extruded material, and a cold worked material. That is, the 0.2% proof stress increases due to cold working, but even in a state where such a high load corresponding to the 0.2% proof stress is applied, a creep strain after exposing the alloy to 150° C. for 100 hours is 0.4% or lower, and high heat resistance is obtained. The high temperature properties are mainly affected by the area ratios of 1 phase, γ phase, and μ phase, and as these area ratios increase, the high temperature properties deteriorate. In addition, as the length of the long side of μ phase or γ phase present at a grain boundary of α phase or at a phase boundary increases, the high temperature properties deteriorate.

(Impact Resistance)

In general, when a material has high strength, the material is brittle. It is said that a material having chip partibility during cutting has some kind of brittleness. Impact resistance is contrary to machinability and strength in some aspect.

However, if the copper alloy is for use in various members including drinking water devices such as valves or fittings, automobile components, mechanical components, and industrial plumbing components, the copper alloy needs to have not only high strength but also properties to resist impact. Specifically, when a Charpy impact test is performed using a U-notched specimen, the resultant test value is preferably 12 J/cm$^2$ or higher, more preferably 14 J/cm$^2$ or higher, and still more preferably 16 J/cm$^2$ or higher. In particular, regarding hot worked materials and hot forged materials that have not been cold worked, the Charpy impact test value is preferably 14 J/cm$^2$ or higher, more preferably 16 J/cm$^2$ or higher, and still more preferably 18 J/cm$^2$ or higher. The alloy according to the embodiment relates to an alloy having excellent machinability. Therefore, it is not necessary that the Charpy impact test value exceeds 45 J/cm$^2$. Conversely, when the Charpy impact test value exceeds 45 J/cm$^2$, cutting resistance increases due to increased toughness and viscosity of the material, which causes unseparated chips more likely to be generated, and as a result, machinability deteriorates. Therefore, it is preferable that the Charpy impact test value is preferably 45 J/cm$^2$ or lower.

When the amount of hard κ phase increases, the amount of acicular κ phase present in α phase increases, the Sn concentration in κ phase increases, or the amount of acicular κ phase present in α phase increases, strength and machinability are improved, but toughness, that is, impact resistance deteriorates. Therefore, strength and machinability are contrary to toughness (impact resistance). The following expression defines a strength-ductility-impact balance index f9 which indicates impact resistance in addition to strength and ductility.

Regarding the hot worked material, when the tensile strength (S) is 550 N/mm$^2$ or higher, the elongation (E) is 12% or higher, the Charpy impact test value (I) is 12 J/cm$^2$ or higher, and the value of $f9=S\times\{(E+100)/100\}^{1/2}+I$, is preferably 665 or higher, more preferably 680 or higher, and still more preferably 690 or higher, it can be said that the material has high strength, ductility, and toughness.

Although impact resistance (toughness) and ductility are similar properties, it is preferable that the strength-ductility balance index f8 is 650 or higher or the strength-ductility-impact balance index f9 is 665 or higher.

Impact resistance of the alloy according to the embodiment has a close relation with a metallographic structure as well, and γ phase deteriorates impact resistance. In addition, if μ phase is present at a grain boundary of α phase or a phase boundary between α phase, κ phase, and γ phase, the grain boundary or the phase boundary is embrittled, and impact resistance deteriorates.

As a result of a study, it was found that if μ phase having the length of the long side of more than 25 μm is present at a grain boundary or a phase boundary, impact resistance particularly deteriorates. Therefore, the length of the long side of μ phase present is 25 μm or less, preferably 15 μm or less, more preferably 5 μm or less, and most preferably 2 μm or less. In addition, in a harsh environment, μ phase present at a grain boundary is more likely to corrode than α phase or κ phase, thus causes grain boundary corrosion and deteriorate properties under high temperature. In the case of μ phase, if the occupancy ratio is low and the length is short and the width is narrow, it is difficult to detect the μ phase using a metallographic microscope at a magnification of about 500-fold or 1000-fold. When observing μ phase whose length is 5 μm or less, the μ phase may be observed at a grain boundary or a phase boundary using an electron microscope at a magnification of about 2000-fold or 5000-fold, μ phase can be found at a grain boundary or a phase boundary.

(Relation Between Various Properties and κ Phase)

Although a balance between ductility and toughness should be taken into consideration, when the amount of κ phase that is harder than α phase increases, the tensile strength increases. Concurrently, κ phase has an excellent machinability-improvement function and excellent wear resistance. Therefore, the proportion of κ phase is necessarily 30% or higher, preferably 33% or higher, and more preferably 35% or higher. On the other hand, when the proportion of κ phase exceeds 65%, toughness or ductility significantly deteriorates, and tensile strength is saturated along with deterioration in ductility. By making hard κ phase to be present together with soft α phase, the effect of κ phase on machinability can be exhibited. However, the proportion of κ phase exceeds 65%, the effect cannot be exhibited. Further, cutting resistance increases, and chip partibility deteriorates. Therefore, the proportion of κ phase is preferably 60% or lower, more preferably 56% or lower, and still more preferably 52% or lower. In addition, when κ phase includes an appropriate amount of Sn, corrosion resistance is improved, and machinability, strength, and wear resistance of κ phase are also improved. On the other hand, as the Sn content in κ phase increases, ductility or impact resistance of κ phase gradually deteriorates. By appropriately adjusting the proportion of κ phase in the metallographic structure and the Sn content in κ phase to be in the more preferable ranges, machinability, strength, ductility, impact resistance, and various corrosion resistance are well-balanced. To that end, the relational expressions f1 and f2 are important.

(κ Phase (κ1 Phase) in α Phase)

Acicular κ phase can be made to be present in α phase depending on conditions of the composition and the process. Specifically, typically, crystal grains of α phase and crystal grains of κ phase are present independently of each other. However, in the case of the alloy according to the embodiment, a plurality of crystal grains of acicular κ phase can be made to be present in crystal grains of α phase. This way, by making κ phase to be present in α phase, α phase is appropriately strengthened, and tensile strength, wear resistance, and machinability are improved without a significant deterioration in ductility and toughness.

In some aspects, cavitation resistance is affected by wear resistance, strength, and corrosion resistance, and erosion-corrosion resistance is affected by corrosion resistance and wear resistance. In particular, when the amount of κ phase is large, when κ1 phase is present in α phase, and when the Sn concentration in κ phase is high, cavitation resistance is improved. In order to improve erosion-corrosion resistance, it is most effective to increase the Sn concentration in κ phase. When κ1 phase is present in α phase, erosion-corrosion resistance is further improved. Regarding cavitation resistance and erosion-corrosion resistance, the Sn concentration in κ phase is more important than the Sn concentration in the alloy. As the Sn concentration in κ phase increases to 0.43 mass %, 0.47 mass %, and 0.54 mass %, both the properties are improved. In addition to the Sn concentration in κ phase, corrosion resistance of the alloy is also important. The reason for this is as follows. When the materials are corroded to form corrosion products during actual use of the copper alloy, these corrosion products easily peel off in high-speed fluid such that a newly formed surface is exposed. The corrosion and peeling are repeated. In an accelerated test (accelerated test of corrosion), this tendency can be determined.

The alloy according to the embodiment includes Sn, in which the proportion of γ phase is limited to be 2.0% or lower, preferably 1.5% or lower, and more preferably 1.0% or lower. As a result, the amount of Sn that is solid-solubilized in κ phase and α phase increases, and corrosion resistance, wear resistance, erosion-corrosion resistance, and cavitation resistance are significantly improved.

<Manufacturing Process>

Next, the method of manufacturing the free-cutting copper alloy according to the first or second embodiment of the present invention is described below.

The metallographic structure of the alloy according to the embodiment varies not only depending on the composition but also depending on the manufacturing process. The metallographic structure of the alloy is affected not only by hot working temperature during hot extrusion and hot forging, and heat treatment conditions but also by an average cooling rate (also simply referred to as cooling rate) in the process of cooling during hot working or heat treatment. As a result of a thorough study, it was found that the metallographic structure is largely affected by a cooling rate in a temperature range from 460° C. to 400° C. and a cooling rate in a temperature range from 575° C. to 525° C., in particular, from 570° C. to 530° C. in the process of cooling during hot working or a heat treatment.

The manufacturing process according to the embodiment is a process required for the alloy according to the embodiment. Basically, the manufacturing process has the following important roles although they are affected by composition.

1) Reduce the amount of γ phase that deteriorates corrosion resistance and impact resistance and shorten the length of the long side of γ phase.

2) Control μ phase that deteriorates corrosion resistance and impact resistance as well as the length of the long side of μ phase.

3) Allow acicular κ phase (κ1 phase) to appear in α phase.

4) Reduce the amount of γ phase and increase the amount (concentration) of Sn that is solid-solubilized in κ phase and α phase.

(Melt Casting)

Melting is performed at a temperature of about 950° C. to about 1200° C. that is higher than the melting point (liquidus temperature) of the alloy according to the embodiment by about 100° C. to about 300° C. In casting, casting material is poured into a predetermined mold at about 900° C. to about 1100° C. that is higher than the melting point by about 50° C. to about 200° C., then is cooled by some cooling means such as air cooling, slow cooling, or water cooling. After solidification, constituent phase(s) changes in various ways.

(Hot Working and Hot Extrusion)

Examples of hot working include hot extrusion and hot forging.

For example, although depending on production capacity of the equipment used, it is preferable that hot extrusion is performed when the temperature of the material during actual hot working, specifically, immediately after the material passes through an extrusion die, is 600° C. to 740° C. If hot working is performed when the material temperature is higher than 740° C., a large amount of β phase is formed during plastic working, and β phase may remain. In addition, a large amount of γ phase remains and has an adverse effect on constituent phase(s) after cooling. In addition, even when a heat treatment is performed in the next step, the metallographic structure of a hot worked material is affected. The hot working temperature is preferably 670° C. or lower and more preferably 645° C. or lower. When hot extrusion is performed at 645° C. or lower, the amount of γ phase in the hot extruded material is reduced. Further, α phase is refined into fine grains, which improves the strength. When a hot forged material or a heat treated material having undergone hot forging is prepared using the hot extruded material having a small amount of γ phase, the amount of γ phase in the hot forged material or the heat treated material is further reduced.

On the other hand, when the hot working temperature is low, hot deformation resistance is improved. From the viewpoint of deformability, the lower limit of the hot working temperature is preferably 600° C. or higher. When the extrusion ratio is 50 or lower, or when hot forging is performed in a relatively simple shape, hot working can be performed at 600° C. or higher. To be safe, the lower limit of the hot working temperature is preferably 605° C. Although depending on the production capacity of the equipment used, it is preferable to perform hot working at a lowest possible temperature.

In consideration of feasibility of measurement position, the hot working temperature is defined as a temperature of a hot worked material that can be measured three or four seconds after hot extrusion, hot forging, or hot rolling. The metallographic structure is affected by a temperature immediately after working where large plastic deformation occurs.

Most of extruded materials are made of a brass alloy including 1 to 4 mass % of Pb. Typically, this kind of brass alloy is wound into a coil after hot extrusion unless the diameter of the extruded material exceeds, for example, about 38 mm. The heat of the ingot (billet) during extrusion is taken by an extrusion device such that the temperature of the ingot decreases. The extruded material comes into contact with a winding device such that heat is taken and the temperature further decreases. A temperature decrease of 50° C. to 100° C. from the temperature of the ingot at the start of the extrusion or from the temperature of the extruded material occurs when the cooling rate is relatively high. Although depending on the weight of the coil and the like, the wound coil is cooled in a temperature range from 460° C. to 400° C. at a relatively low cooling rate of about 2° C./min due to a heat keeping effect. After the material's temperature reaches about 300° C., the cooling rate further declines. Therefore, water cooling is performed in consideration of handling. In the case of a brass alloy including Pb, hot extrusion is performed at about 600° C. to 800° C. In the metallographic structure immediately after extrusion, a large amount of β phase having excellent hot workability is present. When the cooling rate after extrusion is high, a large amount of β phase remains in the cooled metallographic structure such that corrosion resistance, ductility, impact resistance, and high temperature properties deteriorate. In order to avoid the deterioration, by performing cooling at a relatively low cooling rate using the heat keeping effect of the extruded coil and the like, β phase is transformed into α phase, and a metallographic structure that is rich in α phase is obtained. As described above, the cooling rate of the extruded material is relatively high immediately after extrusion. Therefore, by subsequently performing cooling at a relatively low cooling rate, a metallographic structure that is rich in α phase is obtained. Patent Document 1 does not describe the cooling rate but discloses that, in order to reduce the amount of β phase and to isolate β phase, slow cooling is performed until the temperature of an extruded material is 180° C. or lower.

As described above, the alloy according to the embodiment is manufactured at a cooling rate that is completely different from that of a method of manufacturing a brass alloy including Pb of the conventional art.

(Hot Forging)

As a material for hot forging, a hot extruded material is mainly used, but a continuously cast rod is also used. Since a more complex shape is formed in hot forging than in hot extrusion, the temperature of the material before forging is made high. However, the temperature of a hot forged material on which plastic working is performed to create a large, main portion of a forged product, that is, the material's temperature about three or four seconds immediately after forging is preferably 600° C. to 740° C. as in the case of the hot extruded material.

The material is then cooled after the hot forging in a temperature range from 575° C. to 525° C. at a cooling rate of 0.1° C./min to 2.5° C./min and is subsequently cooled in a temperature range from 460° C. to 400° C. at a cooling rate of 2.5° C./min to 500° C./min. The cooling rate for a temperature range from 460° C. to 400° C. is more preferably 4° C./min or higher, and still more preferably 8° C./min or higher. By doing so, growth of μ phase is prevented.

Further, by adjusting the cooling rate after forging, a material having various properties such as corrosion resistance or machinability can be obtained. That is, the temperature of the forged material about three or four seconds after hot forging is 600° C. to 740° C. When cooling is performed in a temperature range from 575° C. to 525° C., in particular, 570° C. to 530° C. at a cooling rate of 0.1° C./min to 2.5° C./min in the process of cooling after hot forging, the amount of γ phase is reduced. The lower limit of the cooling rate in a temperature range from 575° C. to 525° C. is set to be 0.1° C./min or higher in consideration of economic efficiency. On the other hand, when the cooling rate exceeds 2.5° C./min, the amount of γ phase is not sufficiently reduced. The cooling rate is preferably 1.5° C./min or lower and more preferably 1° C./min or lower. Cooling in a temperature range from 575° C. to 525° C. at a cooling rate of 2.5° C./min or lower is a condition corresponding to holding in a temperature range from 525°

C. to 575° C. for 20 minutes or longer according to the calculation, and by such cooling, an effect substantially the same as that of a heat treatment described below can be obtained, and the metallographic structure can be improved.

The cooling rate in a temperature range from 460° C. to 400° C. is 2.5° C./min to 500° C./min, preferably 4° C./min or higher, and more preferably 8° C./min or higher. As a result, an increase in the amount of μ phase is prevented. This way, in a temperature range from 575° C. to 525° C., cooling is performed at a cooling rate of 2.5° C./min or lower and preferably 1.5° C./min or lower. In addition, in a temperature range from 460° C. to 400° C., cooling is performed at a cooling rate of 2.5° C./min or higher and preferably 4° C./min or higher. This way, by adjusting the cooling rate to be low in a temperature range from 575° C. to 525° C. and conversely adjusting the cooling rate to be high in a temperature range from 460° C. to 400° C., a more satisfactory material can be prepared. When a heat treatment is performed in the next step or the final step, it is not necessary to control the cooling rate in a temperature range from 575° C. to 525° C. and the cooling rate in a temperature range from 460° C. to 400° C. after hot working.

(Heat Treatment)

The main heat treatment for copper alloys is also called annealing. When producing a small product which cannot be made by, for example, hot extrusion, a heat treatment is performed as necessary after cold drawing or cold wire drawing such that the material recrystallizes, that is, for the purpose of softening a material. In addition, in the case of hot worked materials, if the material is desired to have substantially no work strain, or if an appropriate metallographic structure is required, a heat treatment is performed as necessary.

In the case of a brass alloy including Pb, a heat treatment is performed as necessary. In the case of the brass alloy including Bi disclosed in Patent Document 1, a heat treatment is performed under conditions of 350° C. to 550° C. and 1 to 8 hours.

In the case of the alloy according to the embodiment, when it is held at a temperature of 525° C. to 575° C. for 20 minutes to 8 hours, corrosion resistance, impact resistance, high temperature properties, strength, and ductility are improved. However, when a heat treatment is performed under the condition that the material's temperature exceeds 610° C., a large amount of γ phase or β phase is formed, and α phase is coarsened. As the heat treatment condition, the heat treatment temperature is preferably 575° C. or lower. On the other hand, although a heat treatment can be performed even at a temperature lower than 525° C., the degree of a decrease in the amount of γ phase becomes much smaller, and it takes more time to complete heat treatment. At a temperature of at least 515° C. or higher and lower than 525° C., a time of 100 minutes or longer and preferably 120 minutes or longer is required. Further, in a heat treatment that is performed at a temperature lower than 515° C. for a long time, a decrease in the amount of γ phase is very small, or the amount of γ phase scarcely decreases. Depending on conditions, μ phase appears. Regarding the heat treatment time (the time for which the material is held at the heat treatment temperature), it is necessary to hold the material at a temperature of 525° C. to 575° C. for at least 20 minutes or longer. The holding time contributes to a decrease in the amount of γ phase. Therefore, the holding time is preferably 40 minutes or longer and more preferably 80 minutes or longer. The upper limit of the holding time is 8 hours, and from the viewpoint of economic efficiency, the holding time is 480 minutes or shorter and preferably 240 minutes or shorter. Alternatively, as described above, at a temperature of 515° C. or higher and lower than 525° C., the holding time is 100 minutes or longer and preferably 120 minutes to 480 minutes (8 hours). The advantage of performing heat treatment at a temperature of 515° C. or higher and lower than 525° C. is that, when the amount of γ phase in the material before the heat treatment is small, the softening of α phase and κ phase can be minimized, the grain growth of α phase scarcely occurs, and a higher strength can be obtained.

Regarding another heat treatment method, in the case of a continuous heat treatment furnace where a hot extruded material, a hot forged product, a hot rolled material, or a material that is cold worked (cold drawn, cold wire-drawn, etc.) moves in a heat source, the above-described problems occur if the material's temperature exceeds 610° C. However, by performing the heat treatment under conditions corresponding to increasing the material's temperature to 525° C. to 610° C. and preferably 525° C. to 595° C. and subsequently holding the material's temperature in a temperature range of 525° C. to 575° C. for 20 minutes or longer, that is, the heat treatment is performed such that the sum of the holding time in a temperature range of 525° C. to 575° C. and the time for which the material passes through a temperature range of 525° C. to 575° C. during cooling after holding is 20 minutes or longer, the metallographic structure can be improved. In the case of a continuous furnace, the holding time at a maximum reaching temperature is short. Therefore, the cooling rate in a temperature range from 575° C. to 525° C. is preferably 2.5° C./min or lower, more preferably 2° C./min or lower, and still more preferably 1.5° C./min or lower. Of course, the temperature is not necessarily set to be 575° C. or higher. For example, when the maximum reaching temperature is 545° C., the material may be held in a temperature range from 545° C. to 525° C. for at least 20 minutes. If the holding time at the maximum reaching temperature is 0 minutes, the material may be passed at a cooling rate of 1° C./min or lower. Not only in a continuous furnace but also in other furnaces, the definition of the holding time is the time from when the material's temperature reaches "Maximum Reaching Temperature−10° C.".

Although the material is cooled to normal temperature in these heat treatments also, in the process of cooling, the cooling rate in a temperature range from 460° C. to 400° C. needs to be 2.5° C./min to 500° C./min. The cooling rate is preferably 4° C./min or higher. That is, from about 500° C., it is necessary to increase the cooling rate. In general, during cooling in the furnace, the cooling rate decreases at a lower temperature. For example, the cooling rate at 430° C. is lower than that at 550° C.

When the metallographic structure is observed using a 2000-fold or 5000-fold electron microscope, it can be seen that the cooling rate in a temperature range from 460° C. to 400° C., which decides whether μ phase appears or not, is about 8° C./min. In particular, a critical cooling rate that significantly affects the properties is 2.5° C./min or 4° C./min. Of course, whether or not μ phase appears also depends on the composition, and the formation of μ phase rapidly progresses as the Cu concentration increases, the Si concentration increases, and the value of the metallographic structure relational expression f1 increases.

That is, when the cooling rate in a temperature range from 460° C. to 400° C. is lower than about 8° C./min, the length of the long side of μ phase precipitated at a grain boundary reaches about 1 μm, and μ phase further grows as the cooling rate becomes lower. When the cooling rate is about 5° C./min, the length of the long side of μ phase is about 3 μm to 10 μm. When the cooling rate is lower than about 2.5° C./min, the length of the long side of μ phase exceeds 15 μm and, in some cases, exceeds 25 μm. When the length of the long side of μ phase reaches about 10 μm, p phase can be distinguished from a grain boundary and can be observed using a 1000-fold metallographic microscope. On the other hand, the upper limit of the cooling rate varies depending on the hot working temperature or the like. When the cooling rate is excessively high (exceeds 500° C./min), a constituent phase that is formed under high temperature is maintained as it is even under normal temperature, the amount of κ phase increases, and the amounts of β phase and γ phase that affect corrosion resistance and impact resistance increase.

Currently, for most of extrusion materials of a copper alloy, brass alloy including 1 to 4 mass % of Pb is used. In the case of the brass alloy including Pb, as disclosed in Patent Document 1, a heat treatment is performed at a temperature of 350° C. to 550 as necessary. The lower limit of 350° C. is a temperature at which recrystallization occurs and the material softens almost entirely. At 550° C. as the upper limit, the recrystallization ends, and recrystallized grains start to be coarsened. In addition, heat treatment at a higher temperature causes a problem in relation to energy. In addition, when a heat treatment is performed at a temperature of higher than 550° C., the amount of β phase significantly increases. It is presumed that this is the reason the upper limit is disclosed as 550° C. As a common manufacturing facility, a batch furnace or a continuous furnace is used. In the case of the batch furnace, after furnace cooling, the material is air-cooled after its temperature reaches about 300° C. or about 200° C. In the case of the continuous furnace, the material is cooled at a relatively low rate until the material's temperature decreases to about 300° C. Cooling is performed at a cooling rate that is different from that of the method of manufacturing the alloy according to the embodiment.

Regarding the metallographic structure of the alloy according to the embodiment, one important thing in the manufacturing step is the cooling rate in the temperature range from 460° C. to 400° C. in the process of cooling after heat treatment or hot working. When the cooling rate is lower than 2.5° C./min, the proportion of μ phase increases. μ phase is mainly formed around a grain boundary or a phase boundary. In a harsh environment, the corrosion resistance of μ phase is lower than that of α phase or κ phase. Therefore, selective corrosion of μ phase or grain boundary corrosion is caused to occur. In addition, as in the case of γ phase, μ phase becomes a stress concentration source or causes grain boundary sliding to occur such that impact resistance or high-temperature strength deteriorates. Preferably, in the process of cooling after hot working, the cooling rate in a temperature range from 460° C. to 400° C. is 2.5° C./min or higher, preferably 4° C./min or higher and more preferably 8° C./min or higher. In consideration of thermal strain, the upper limit of the cooling rate is preferably 500° C./min or lower and more preferably 300° C./min or lower.

(Cold Working Step)

In order to improve the dimensional accuracy and straighten the extruded coil, cold working may be performed on the hot extruded material. For example, the hot extruded material is cold-drawn at a working ratio of about 2% to about 20%, preferably about 2% to about 15%, and more preferably about 2% to about 10% and then undergoes a heat treatment. Alternatively, after hot working and a heat treatment, the heat treated material is wire-drawn in a cold state at a working ratio of about 2% to about 20%, preferably about 2% to about 15%, and more preferably about 2% to about 10% and, in some cases, undergoes a straightness correction step. Depending on the dimensions of a final product, cold working and the heat treatment may be repeatedly performed. The straightness of the rod material may be improved using only a straightness correction facility, or shot peening may be performed a forged product after hot working. Actual cold working ratio is about 0.1% to about 2.5%, and even when the cold working ratio is small, the strength increases.

Cold working is advantageous in that the strength of the alloy can be increased. By performing a combination of cold working at a working ratio of 2% to 20% and a heat treatment on the hot worked material, regardless of the order of performing these processes, high strength, ductility, and impact resistance can be well-balanced, and properties in which strength is prioritized or ductility or toughness is prioritized according to the intended use can be obtained.

When the heat treatment of the embodiment is performed after cold working at a working ratio of 2% to 15%, α phase and κ phase are sufficiently recovered due to the heat treatment but are not completely recrystallized such that work strain remains in α phase and κ phase. Concurrently, the amount of γ phase is reduced, α phase is strengthened due to the presence of acicular κ phase (κ1 phase) in α phase, and the amount of κ phase increases. As a result, ductility, impact resistance, tensile strength, high temperature properties, and the strength-ductility balance index are higher than those of the hot worked material. When a copper alloy that is generally widely used as the free-cutting copper alloy is cold-worked at 2% to 15% and is heated to 525° C. to 575° C., the strength of the copper alloy decreases by recrystallization.

On the other hand, by performing cold working at an appropriate cold working ratio after the heat treatment, ductility and impact resistance deteriorate, but a material having a high strength is prepared. In addition, the balance index f8 can reach 670 or higher, or the balance index f9 can reach 680 or higher.

By adopting the manufacturing process, an alloy having excellent corrosion resistance and having excellent impact resistance, ductility, strength, and machinability is prepared.

(Low-Temperature Annealing)

A rod material or a forged product may be annealed at a low temperature which is lower than the recrystallization temperature in order to remove residual stress or to correct the straightness of rod material. As low-temperature annealing conditions, it is desired that the material's temperature is 240° C. to 350° C. and the heating time is 10 minutes to 300 minutes. Further, it is preferable that the low-temperature annealing is performed so that the relation of $150 \leq (T-220) \times (t)^{1/2} \leq 1200$, wherein the temperature (material's temperature) of the low-temperature annealing is represented by T (° C.) and the heating time is represented by t (min), is satisfied. Note that the heating time t (min) is counted (measured) from when the temperature is 10° C. lower (T−10) than a predetermined temperature T (° C.).

When the low-temperature annealing temperature is lower than 240° C., residual stress is not removed sufficiently, and straightness correction is not sufficiently performed. When the low-temperature annealing temperature is higher than 350° C., μ phase is formed around a grain boundary or a phase boundary. When the low-temperature annealing time is shorter than 10 minutes, residual stress is not removed sufficiently.

When the low-temperature annealing time is longer than 300 minutes, the amount of μ phase increases. As the low-temperature annealing temperature increases or the low-temperature annealing time increases, the amount of μ phase increases, and corrosion resistance, impact resistance, and high-temperature strength deteriorate. However, as long as low-temperature annealing is performed, precipitation of μ phase is not avoidable. Therefore, how precipitation of μ phase can be minimized while removing residual stress is the key.

The lower limit of the value of $(T-220)\times(t)^{1/2}$ is 150, preferably 180 or higher, and more preferably 200 or higher. In addition, the upper limit of the value of $(T-220)\times(t)^{1/2}$ is 1200, preferably 1100 or lower, and more preferably 1000 or lower.

(Heat Treatment of Casting)

Even when a final product is a casting, it is possible to improve metallographic structure by heat treating a casting after being cast and cooled to normal temperature under any one of the following conditions.

The casting is held at a temperature of 525° C. to 575° C. for 20 minutes to 8 hours or is held at a temperature of 515° C. or higher and lower than 525° C. for 100 minutes to 8 hours. Alternatively, the material's temperature is increased to a temperature of 525° C. to 610° C. once and subsequently is held in a temperature range of 525° C. to 575° C. for 20 minutes or longer. Alternatively, the casting is cooled on a condition corresponding to the above condition, specifically, in a temperature range of 525° C. to 575° C. at a cooling rate of 0.1° C./min to 2.5° C./min.

Subsequently, the casting is cooled in a temperature range from 460° C. to 400° C. at a cooling rate of 2.5° C./min to 500° C./min. As a result, the metallographic structure can be improved, and corrosion resistance, wear resistance, and erosion-corrosion resistance can be improved.

Crystal grains of the casting are coarsened, and defects are present in the casting. Therefore, tensile strength, elongation, the strength balance properties f8 and f9 are not applied to the casting.

Using this manufacturing method, the free-cutting copper alloys according to the first and second embodiments of the present invention are manufactured.

The hot working step, the heat treatment (also referred to as annealing) step, and the low-temperature annealing step are steps of heating the copper alloy. When the low-temperature annealing step is not performed, or the hot working step or the heat treatment step is performed after the low-temperature annealing step (when the low-temperature annealing step is not the final step among the steps of heating the copper alloy), the step that is performed later among the hot working steps and the heat treatment steps is important, regardless of whether cold working is performed. When the hot working step is performed after the heat treatment step, or the heat treatment step is not performed after the hot working step (when the hot working step is the final step among the steps of heating the copper alloy), it is necessary that the hot working step satisfies the above-described heating conditions and cooling conditions. When the heat treatment step is performed after the hot working step, or the hot working step is not performed after the heat treatment step (a case where the heat treatment step is the final step among the steps of heating the copper alloy), it is necessary that the heat treatment step satisfies the above-described heating conditions and cooling conditions. For example, in cases where the heat treatment step is not performed after the hot forging step, it is necessary that the hot forging step satisfies the above-described heating conditions and cooling conditions for hot forging. In cases where the heat treatment step is performed after the hot forging step, it is necessary that the heat treatment step satisfies the above-described heating conditions and cooling conditions for heat treatment. In this case, it is not necessary that the hot forging step satisfies the above-described heating conditions and cooling conditions for hot forging.

In the low-temperature annealing step, the material's temperature is 240° C. to 350° C. This temperature concerns whether or not μ phase is formed, and does not concern the temperature range (575° C. to 525° C. and 525° C. to 515° C.) where the amount of γ phase is reduced. This way, the material's temperature in the low-temperature annealing step does not relate to an increase or decrease in the amount of γ phase. Therefore, when the low-temperature annealing step is performed after the hot working step or the heat treatment step (the low-temperature annealing step is the final step among the steps of heating the copper alloy), the conditions of the low-temperature annealing step and the heating conditions and cooling conditions of the step before the low-temperature annealing step (the step of heating the copper alloy immediately before the low-temperature annealing step) are both important, and it is necessary that the low-temperature annealing step and the step before the low-temperature annealing step satisfy the above-described heating conditions and the cooling conditions. Specifically, the heating conditions and cooling conditions of the step that is performed last among the hot working steps and the heat treatment steps performed before the low-temperature annealing step are important, and it is necessary that the above-described heating conditions and cooling conditions are satisfied. When the hot working step or the heat treatment step is performed after the low-temperature annealing step, as described above, the step that is performed last among the hot working steps and the heat treatment steps is important, and it is necessary that the above-described heating conditions and cooling conditions are satisfied. The hot working step or the heat treatment step may be performed before or after the low-temperature annealing step.

In the free-cutting alloy according to the first or second embodiment of the present invention having the above-described constitution, the alloy composition, the composition relational expressions, the metallographic structure, and the metallographic structure relational expressions are defined as described above. Therefore, corrosion resistance in a harsh environment, impact resistance, and high-temperature properties are excellent. In addition, even if the Pb content is low, excellent machinability can be obtained.

The embodiments of the present invention are as described above. However, the present invention is not limited to the embodiments, and appropriate modifications can be made within a range not deviating from the technical requirements of the present invention.

EXAMPLES

The results of an experiment that was performed to verify the effects of the present invention are as described below. The following Examples are shown in order to describe the effects of the present invention, and the requirements for composing the example alloys, processes, and conditions included in the descriptions of the Examples do not limit the technical range of the present invention.

Example 1

<Experiment on the Actual Production Line>

Using a low-frequency melting furnace and a semi-continuous casting machine on the actual production line, a trial manufacture test of copper alloy was performed.

Tables 2 and 3 show alloy compositions. Since the equipment used was the one on the actual production line, impurities were also measured in the alloys shown in Tables 2 and 3. In addition, manufacturing steps were performed under the conditions shown in Tables 6 to 12.

(Step Nos. A1 to A12 and AH1 to AH11)

Using the low-frequency melting furnace and the semi-continuous casting machine on the actual production line, a billet having a diameter of 240 mm was manufactured. As to raw materials, those used for actual production were used. The billet was cut into a length of 800 mm and was heated. Then hot extruded into a round bar shape having a diameter of 25.6 mm, and the rod bar was wound into a coil (extruded material). Next, using the heat keeping effect of the coil and adjustment of a fan, the extruded material was cooled in a temperature range from 575° C. to 525° C. at a cooling rate of 20° C./min and also in a temperature range from 460° C. to 400° C. at a cooling rate of 15° C./min. In a temperature range of 400° C. or lower also, the extruded material was cooled at a cooling rate of about 15° C./min. The temperature was measured using a radiation thermometer placed mainly around the final stage of hot extrusion about three to four seconds after being extruded from an extruder. A radiation thermometer DS-06DF (manufactured by Daido Steel Co., Ltd.) was used for the temperature measurement.

It was verified that the average temperature of the extruded material was within ±5° C. of a temperature shown in Tables 6 and 7 (in a range of (temperature shown in Tables 6 and 7)−5° C. to (temperature shown in Table 6 and 7)+5° C.).

In Step No. AH11, the extrusion temperature was 580° C. In steps other than Step AH11, the extrusion temperatures were 640° C. In Step No. AH11 in which the extrusion temperature was 580° C., three kinds of prepared materials were not able to be extruded to the end, and the extrusion was given up.

After the extrusion, in Step No. AH1, only straightness correction was performed. In Step No. AH2, an extruded material having a diameter of 25.6 mm was cold-drawn to obtain a diameter of 25.0 mm.

In Step Nos. A1 to A9 and AH3 to AH10, an extruded material having a diameter of 25.6 mm was cold-drawn to obtain a diameter of 25.0 mm. The drawn material was heated and held at a predetermined temperature for a predetermined time using an electric furnace on the actual production line, or an electric furnace or a continuous furnace in the laboratory. Alternatively, the maximum reaching temperature was made to vary, and a cooling rate in a temperature range from 575° C. to 525° C. or a cooling rate in a temperature range from 460° C. to 400° C. in the process of cooling was made to vary.

In Step Nos. A10 and A11, a heat treatment was performed on an extruded material having a diameter of 25.6 mm. Next, in Step Nos. A10 and A11, the extruded materials were cold-drawn at cold working ratios of about 5% and about 8% to obtain diameters of 25 mm and 24.5 mm, respectively, and the straightness thereof was corrected (drawing and straightness correction after heat treatment).

Step No. A12 is the same as Step No. A1, except for the dimension after drawing as being 424.5 mm.

Regarding heat treatment conditions, as shown in Tables 6 and 7, the heat treatment temperature was made to vary in a range of 505° C. to 620° C., and the holding time was made to vary in a range of 5 minutes to 180 minutes.

In the following tables, if cold drawing was performed before the heat treatment, "○" is indicated, and if the cold drawing was not performed before the heat treatment, "–" is indicated.

Regarding Alloy No. S01, Sn and Fe were additionally added after the alloy was transferred to a holding furnace. Regarding Alloy No. S02, Pb was additionally added after the alloy was transferred to a holding furnace. Step No. EH1 or Step No. E1 was performed on Alloy Nos. S01 and S02 for evaluation.

(Step Nos. B1 to B3 and BH1 to BH3)

A material (rod material) having a diameter of 25 mm obtained in Step No. A10 was cut into a length of 3 m. Next, this rod material was set in a mold and was annealed at a low temperature for straightness correction. The conditions of this low-temperature annealing are shown in Table 9.

The conditional expression indicated in Table 8 is as follows:

$$(\text{Conditional Expression})=(T-220)\times(t)^{1/2}$$

T: temperature (material's temperature) (° C.)

t: heating time (min)

The result was that straightness was poor only when Step No. BH1 was performed regarding all of the three materials prepared. Therefore, the remaining property research (except analysis of metallographic structure) was not conducted.

(Step Nos. C0 and C1)

Using the low-frequency melting furnace and the semi-continuous casting machine on the actual production line, an ingot (billet) having a diameter of 240 mm was manufactured. As to raw materials, raw materials corresponding to those used for actual production were used. The billet was cut into a length of 500 mm and was heated. Hot extrusion was performed to obtain a round bar-shaped extruded material having a diameter of 50 mm. This extruded material was extruded onto an extrusion table in a straight rod shape. The temperature was measured using a radiation thermometer mainly at the final stage of extrusion about three to four seconds after extrusion from an extruder. It was verified that the average temperature of the extruded material was within ±5° C. of a temperature shown in Table 10 (in a range of (temperature shown in Table 10)−5° C. to (temperature shown in Table 10)+5° C.). The cooling rate from 575° C. to 525° C. and the cooling rate from 460° C. to 400° C. after extrusion were 16° C./min and 12° C./min, respectively (extruded material). In steps described below, an extruded material (round bar) obtained in Step No. C0 was used as materials for forging. In Step No. C1, heating was performed at 560° C. for 80 minutes, and subsequently, the material was cooled from 460° C. to 400° C. at a cooling rate of 12° C./min.

(Step Nos. D1 to D7 and DH1 to DH7)

A round bar having a diameter of 50 mm obtained in Step No. C0 was cut into a length of 180 mm. This round bar was horizontally set and was forged into a thickness of 16 mm using a press machine having a hot forging press capacity of 150 ton. About three or four seconds immediately after hot forging the material into a predetermined thickness, the temperature was measured using the radiation thermometer. It was verified that the hot forging temperature (hot working temperature) was within ±5° C. of a temperature shown in Table 11 (in a range of (temperature shown in Table 11)−5° C. to (temperature shown in Table 11)+5° C.).

In Step Nos. D1 to D4, DH2, DH6, and DH7, a heat treatment was performed in a laboratory electric furnace, and the heat treatment temperature, the time, the cooling rate in a temperature range from 575° C. to 525° C., and the cooling rate in a temperature range from 460° C. to 400° C. in the process of cooling were made to vary.

In Step Nos. D5, D7, DH3, and DH4, heating was performed using the continuous furnace in the laboratory in a temperature range of 565° C. to 590° C. for 3 minutes, and the cooling rate was made to vary.

Heat treatment temperature refers to the maximum reaching temperature of the material, and as the holding time, a period of time in which the material was held in a temperature range from the maximum reaching temperature to (maximum reaching temperature−10° C.) was used.

In Step Nos. DH1, D6, and DH5, during cooling after hot forging, the cooling rate in a temperature range from 575° C. to 525° C. and the cooling rate in a temperature range from 460° C. to 400° C. were made to vary. The preparation operations of the samples ended upon completion of the cooling after forging.

<Laboratory Experiment>

Using a laboratory facility, a trial manufacture test of copper alloy was performed. Tables 4 and 5 show alloy compositions. The balance refers to Zn and inevitable impurities. The copper alloys having the compositions shown in Tables 2 and 3 were also used in the laboratory experiment. In addition, manufacturing steps were performed under the conditions shown in Tables 13 to 17.

(Step Nos. E1 and EH1)

In a laboratory, raw materials mixed at a predetermined component ratio were melted. The molten alloy was cast into a mold having a diameter of 100 mm and a length of 180 mm to prepare a billet. A part of the molten alloy was cast from a melting furnace on the actual production line into a mold having a diameter of 100 mm and a length of 180 mm to prepare a billet. This billet was heated and, in Step Nos. E1 and EH1, was extruded into a round bar having a diameter of 40 mm.

Immediately after stopping the extrusion test machine, the temperature was measured using a radiation thermometer. In effect, this temperature corresponds to the temperature of the extruded material about three or four seconds after being extruded from the extruder.

In Step No. EH1, the preparation operation of the sample ended upon completion of the extrusion, and the obtained extruded material was used as a material for hot forging in steps described below.

In Step No. E1, a heat treatment was performed under conditions shown in Table 13 after extrusion.

The extruded materials obtained in Step Nos. EH1 and E1 were also used as materials for evaluation of hot workability.

(Step Nos. F1 to F5, FH1, and FH2)

Round bars having a diameter of 40 mm obtained in Step Nos. EH1 and PH1, which will be described later, were cut into a length of 180 mm. This round bar obtained in Step No. EH1 or the casting of Step No. PH1 was horizontally set and was forged to a thickness of 15 mm using a press machine having a hot forging press capacity of 150 ton. About three to four seconds immediately after hot forging the material to the predetermined thickness, the temperature was measured using a radiation thermometer. It was verified that the hot forging temperature (hot working temperature) was within ±5° C. of a temperature shown in Table 14 (in a range of (temperature shown in Table 14)−5° C. to (temperature shown in Table 14)+5° C.)

The hot-forged material was cooled after being hot-forged at the cooling rate of 22° C./min for a temperature range from 575° C. to 525° C. and at the cooling rate of 18° C./min for a temperature range from 460° C. to 400° C. respectively. In Step No. FH1, hot forging was performed on the round bar obtained in Step No. EH1, and the preparation operation of the sample ended upon cooling the material after hot forging.

In Step Nos. F1, F2, F3, and FH2, hot forging was performed on the round bar obtained in Step No. EH1, and a heat treatment was performed after hot forging. The heat treatment was performed with varied heating conditions and varied cooling rates for temperature ranges from 575° C. to 525° C. and from 460° C. to 400° C.

In Step Nos. F4 and F5, hot forging was performed using a casting which was made with a metal mold (No. PH1) as a material for forging. After hot forging, a heat treatment was performed with varied heating conditions and cooling rates.

(Steps No. P1 to P3 and PH1)

In Step No. PH1, molten alloy in which raw materials were melted at a predetermined component ratio was cast into a mold having an inner diameter of 00 mm to obtain a casting. A part of the molten alloy was also cast from a melting furnace on the actual production line into a mold having an inner diameter of 40 mm to prepare a casting.

In Step No. PC, a continuously cast rod having a diameter of ϕ40 mm was prepared by continuous casting (not shown in the table).

In Step No. P1, a heat treatment was performed on the casting of Step No. PH1. On the other hand, in Steps No. P2 and P3, a heat treatment was performed on the casting of Step No. PC. In Steps No. P1 to P3, a heat treatment was performed on the casting while making the heating conditions and the cooling rate to vary.

TABLE 2

| Alloy | Component Composition (mass %) | | | | | | Impurities (mass %) | | | | Composition Relational Expression | | |
|---|---|---|---|---|---|---|---|---|---|---|---|---|---|
| No. | Cu | Si | Sn | P | Pb | Zn | Element | Amount | Element | Amount | f1 | f2 | f3 |
| S01 | 77.0 | 3.26 | 0.49 | 0.09 | 0.013 | Balance | Fe | 0.02 | Ni | 0.04 | 76.0 | 60.9 | 0.18 |
| | | | | | | | Ag | 0.005 | Cr | 0.01 | | | |
| | | | | | | | Bi | 0.002 | Se | 0.001 | | | |
| | | | | | | | S | 0.001 | C | 0.0001 | | | |
| S02 | 78.0 | 3.46 | 0.68 | 0.08 | 0.011 | Balance | Fe | 0.01 | Ni | 0.01 | 75.8 | 60.8 | 0.12 |
| | | | | | | | Mn | 0.01 | Ag | 0.02 | | | |
| | | | | | | | Sb | 0.003 | As | 0.003 | | | |
| | | | | | | | Se | 0.001 | Te | 0.003 | | | |

TABLE 2-continued

| Alloy | Component Composition (mass %) | | | | | | Impurities (mass %) | | | | Composition Relational Expression | | |
|---|---|---|---|---|---|---|---|---|---|---|---|---|---|
| No. | Cu | Si | Sn | P | Pb | Zn | Element | Amount | Element | Amount | f1 | f2 | f3 |
| S03 | 77.6 | 3.38 | 0.53 | 0.11 | 0.009 | Balance | Ni | 0.01 | Fe | 0.02 | 76.4 | 60.8 | 0.21 |
| | | | | | | | Co | 0.005 | Ag | 0.01 | | | |
| | | | | | | | W | 0.002 | Mo | 0.003 | | | |
| | | | | | | | Rare Earth Element | 0.009 | | | | | |

TABLE 3

| Alloy | Component Composition (mass %) | | | | | | Impurities (mass %) | | | | Composition Relational Expression | | |
|---|---|---|---|---|---|---|---|---|---|---|---|---|---|
| No. | Cu | Si | Sn | P | Pb | Zn | Element | Amount | Element | Amount | f1 | f2 | f3 |
| S11 | 77.0 | 3.26 | 0.48 | 0.09 | 0.013 | Balance | Fe | 0.05 | Ni | 0.04 | 76.1 | 60.9 | 0.19 |
| | | | | | | | Ag | 0.005 | Cr | 0.01 | | | |
| | | | | | | | Bi | 0.002 | Se | 0.001 | | | |
| | | | | | | | S | 0.001 | | | | | |
| S12 | 77.0 | 3.25 | 0.48 | 0.09 | 0.013 | Balance | Fe | 0.13 | Ni | 0.04 | 76.1 | 60.9 | 0.19 |
| | | | | | | | Ag | 0.005 | Cr | 0.01 | | | |
| | | | | | | | Bi | 0.002 | Se | 0.001 | | | |
| | | | | | | | S | 0.001 | | | | | |
| 313 | 78.0 | 3.46 | 0.68 | 0.08 | 0.035 | Balance | Fe | 0.02 | Ni | 0.01 | 75.8 | 60.8 | 0.12 |
| | | | | | | | Mn | 0.01 | Al | 0.005 | | | |
| | | | | | | | Ag | 0.02 | Sb | 0.003 | | | |
| | | | | | | | As | 0.003 | Se | 0.001 | | | |
| | | | | | | | Te | 0.003 | | | | | |
| S14 | 78.0 | 3.45 | 0.67 | 0.08 | 0.095 | Balance | Fe | 0.02 | Ni | 0.01 | 75.9 | 60.9 | 0.12 |
| | | | | | | | Mn | 0.01 | Al | 0.005 | | | |
| | | | | | | | Ag | 0.02 | Sb | 0.003 | | | |
| | | | | | | | As | 0.003 | Se | 0.001 | | | |
| | | | | | | | Te | 0.003 | | | | | |

TABLE 4

| Alloy No. | Cu | Si | Sn | P | Pb | Others | f1 | f2 | f3 |
|---|---|---|---|---|---|---|---|---|---|
| S21 | 78.2 | 3.53 | 0.77 | 0.10 | 0.008 | | 75.4 | 60.5 | 0.13 |
| S22 | 77.2 | 3.32 | 0.51 | 0.09 | 0.016 | | 76.1 | 60.8 | 0.18 |
| S23 | 78.4 | 3.55 | 0.80 | 0.11 | 0.015 | | 75.4 | 60.6 | 0.14 |
| S24 | 76.4 | 3.15 | 0.43 | 0.07 | 0.033 | | 75.8 | 60.9 | 0.16 |
| S25 | 76.7 | 3.13 | 0.42 | 0.08 | 0.017 | | 76.1 | 61.3 | 0.19 |
| S26 | 78.5 | 3.48 | 0.43 | 0.11 | 0.015 | | 78.2 | 61.3 | 0.26 |
| S27 | 76.7 | 3.30 | 0.45 | 0.13 | 0.013 | | 76.1 | 60.4 | 0.29 |
| S28 | 77.5 | 3.47 | 0.52 | 0.05 | 0.009 | | 76.4 | 60.4 | 0.10 |
| S29 | 77.5 | 3.33 | 0.53 | 0.09 | 0.018 | | 76.3 | 61.0 | 0.17 |
| S30 | 76.8 | 3.25 | 0.46 | 0.14 | 0.010 | | 76.1 | 60.7 | 0.30 |
| S31 | 78.2 | 3.51 | 0.78 | 0.11 | 0.008 | | 75.3 | 60.6 | 0.14 |
| S32 | 77.7 | 3.40 | 0.60 | 0.09 | 0.013 | | 76.0 | 60.8 | 0.15 |
| S33 | 77.2 | 3.47 | 0.48 | 0.10 | 0.008 | | 76.5 | 60.1 | 0.21 |
| S34 | 76.3 | 3.24 | 0.51 | 0.11 | 0.014 | | 75.2 | 60.2 | 0.22 |
| S35 | 78.6 | 3.49 | 0.48 | 0.12 | 0.011 | | 77.9 | 61.3 | 0.25 |
| S41 | 77.5 | 3.35 | 0.57 | 0.07 | 0.017 | Sb: 0.018, As: 0.04 | 76.0 | 60.9 | 0.12 |
| S42 | 77.3 | 3.43 | 0.51 | 0.10 | 0.008 | Sb: 0.03, Bi: 0.015 | 76.3 | 60.3 | 0.20 |
| S43 | 77.6 | 3.33 | 0.59 | 0.07 | 0.017 | Sb: 0.03, As: 0.04, Bi: 0.05 | 75.9 | 61.1 | 0.12 |

TABLE 5

| Alloy No. | Cu | Si | Sn | P | Pb | Others | f1 | f2 | f3 |
|---|---|---|---|---|---|---|---|---|---|
| S51 | 76.5 | 3.16 | 0.63 | 0.10 | 0.012 | | 74.4 | 60.7 | 0.16 |
| S52 | 73.5 | 3.15 | 0.54 | 0.08 | 0.017 | | 72.1 | 57.9 | 0.15 |
| S53 | 76.1 | 2.83 | 0.52 | 0.07 | 0.011 | | 74.5 | 62.0 | 0.13 |
| S54 | 78.0 | 3.16 | 0.51 | 0.13 | 0.011 | | 76.8 | 62.3 | 0.25 |

TABLE 5-continued

| Alloy No. | Cu | Si | Sn | P | Pb | Others | f1 | f2 | f3 |
|---|---|---|---|---|---|---|---|---|---|
| S55 | 79.1 | 3.60 | 0.52 | 0.11 | 0.010 | | 78.2 | 61.3 | 0.21 |
| S56 | 78.5 | 3.70 | 0.60 | 0.10 | 0.008 | | 77.1 | 60.2 | 0.17 |
| S57 | 76.2 | 3.03 | 0.44 | 0.09 | 0.014 | | 75.4 | 61.2 | 0.20 |
| S58 | 78.5 | 3.50 | 0.95 | 0.12 | 0.012 | | 74.3 | 60.8 | 0.13 |

TABLE 5-continued

| Alloy No. | Cu | Si | Sn | P | Pb | Others | f1 | f2 | f3 |
|---|---|---|---|---|---|---|---|---|---|
| S59 | 77.5 | 3.35 | 0.34 | 0.08 | 0.009 | | 77.7 | 61.1 | 0.24 |
| S60 | 77.5 | 3.45 | 0.56 | 0.17 | 0.010 | | 76.2 | 60.3 | 0.30 |
| S61 | 78.0 | 3.55 | 0.67 | 0.05 | 0.018 | | 75.9 | 60.4 | 0.07 |
| S62 | 76.8 | 3.30 | 0.43 | 0.14 | 0.015 | | 76.4 | 60.5 | 0.33 |
| S63 | 77.2 | 3.34 | 0.50 | 0.03 | 0.010 | | 76.2 | 60.7 | 0.06 |
| S64 | 76.2 | 3.15 | 0.03 | 0 | 0.015 | | 78.5 | 61.1 | 0 |
| S65 | 75.5 | 3.13 | 0.41 | 0.08 | 0.010 | | 75.0 | 60.1 | 0.20 |
| S66 | 77.8 | 3.15 | 0.43 | 0.09 | 0.010 | | 77.2 | 62.3 | 0.21 |

TABLE 5-continued

| Alloy No. | Cu | Si | Sn | P | Pb | Others | f1 | f2 | f3 |
|---|---|---|---|---|---|---|---|---|---|
| S67 | 76.5 | 3.45 | 0.54 | 0.07 | 0.008 | | 75.3 | 59.4 | 0.13 |
| S68 | 78.1 | 3.22 | 0.45 | 0.09 | 0.010 | | 77.4 | 62.2 | 0.20 |
| S69 | 78.7 | 3.53 | 0.41 | 0.10 | 0.013 | | 78.6 | 61.3 | 0.24 |
| S70 | 76.5 | 3.30 | 0.63 | 0.07 | 0.016 | | 74.5 | 60.1 | 0.11 |
| S71 | 76.7 | 3.13 | 0.43 | 0.08 | 0.002 | | 76.1 | 61.3 | 0.19 |
| S72 | 77.1 | 3.32 | 0.72 | 0.11 | 0.010 | | 74.5 | 60.5 | 0.15 |

TABLE 6

| | Hot Extrusion | | | | | Heat Treatment (Annealing) | | | | |
|---|---|---|---|---|---|---|---|---|---|---|
| Step No. | Temp (° C.) | Cooling Rate from 575° C. to 525° C. (° C./min) | Cooling Rate from 460° C. to 400° C. (° C./min) | Cold Drawing and Straightness Correction before Heat Treatment | Diameter of Extruded Material before Heat Treatment (mm) | Kind of Furnace (*) | Temp (° C.) | Holding Time (min) | Cooling Rate from 575° C. to 525° C. (° C./min) | Cooling Rate from 460° C. to 400° C. (° C./min) |
| A1 | 640 | 20 | 15 | ○ | 25.0 | C | 545 | 120 | 15 | 15 |
| A2 | 640 | 20 | 15 | ○ | 25.0 | C | 545 | 120 | 15 | 10 |
| A3 | 640 | 20 | 15 | ○ | 25.0 | C | 545 | 120 | 15 | 7 |
| A4 | 640 | 20 | 15 | ○ | 25.0 | C | 545 | 120 | 8 | 3.6 |
| A5 | 640 | 20 | 15 | ○ | 25.0 | A | 565 | 70 | 15 | 15 |
| A6 | 640 | 20 | 15 | ○ | 25.0 | A | 545 | 30 | 15 | 15 |
| A7 | 640 | 20 | 15 | ○ | 25.0 | B | 595 | 5 | 1.8 | 10 |
| A8 | 640 | 20 | 15 | ○ | 25.0 | B | 595 | 5 | 1 | 10 |
| A9 | 640 | 20 | 15 | ○ | 25.0 | B | 570 | 5 | 1 | 20 |
| A10 | 640 | 20 | 15 | — | 25.6 | C | 545 | 120 | 15 | 20 |
| A11 | 640 | 20 | 15 | — | 25.6 | C | 545 | 120 | 15 | 20 |
| A12 | 640 | 20 | 15 | ○ | 24.5 | C | 545 | 120 | 15 | 20 |

(*) A: Electric furnace in the laboratory

B: Continuous furnace in the laboratory

C: Electric furnace on the production line

TABLE 7

| | Hot Extrusion | | | | | Heat Treatment (Annealing) | | | | |
|---|---|---|---|---|---|---|---|---|---|---|
| Step No. | Temp. (° C.) | Cooling Rate from 575° C. to 525° C. (° C./min) | Cooling Rate from 460° C. to 400° C. (° C./min) | Cold Drawing and Straightness Correction before Heat Treatment | Diameter of Extruded Material before Heat Treatment (mm) | Kind of Furnace (*) | Temp (° C.) | Holding Time (min) | Cooling Rate from 575° C. to 525° C. (° C./min) | Cooling Rate from 460° C. to 400° C. (° C./min) |
| AH1 | 640 | 20 | 15 | Only corrected | 25.6 | — | — | — | — | — |
| AH2 | 640 | 20 | 15 | ○ | 25.0 | — | — | — | — | — |
| AH3 | 640 | 20 | 15 | ○ | 25.0 | C | 545 | 120 | 3 | 1.8 |
| AH4 | 640 | 20 | 15 | ○ | 25.0 | C | 545 | 120 | 1.5 | 1 |
| AH5 | 640 | 20 | 15 | ○ | 25.0 | A | 615 | 60 | 15 | 15 |
| AH6 | 640 | 20 | 15 | ○ | 25.0 | A | 505 | 180 | — | 20 |
| AH7 | 640 | 20 | 15 | ○ | 25.0 | B | 595 | 5 | 5 | 10 |
| AH8 | 640 | 20 | 15 | ○ | 25.0 | B | 595 | 5 | 1.8 | 1.6 |
| AH9 | 640 | 20 | 15 | ○ | 25.0 | A | 550 | 10 | 15 | 20 |
| AH10 | 640 | 20 | 15 | ○ | 25.0 | B | 620 | 5 | 2 | 10 |
| AH11 | 580 | 20 | 15 | Unable to be extruded to the end. | | | | | | |

(*) A: Electric furnace in the laboratory

B: Continuous furnace in the laboratory

C: Electric furnace on the production line

TABLE 8

| Step No. | Note |
|---|---|
| A1 | Appropriate conditions |
| A2 | Cooling rate of heat treatment was made to vary |
| A3 | Cooling rate of heat treatment was made to vary |
| A4 | Cooling rate of heat treatment from 460° C. to 400° C. was close to 2.5° C./min. |
| A5 | Heat treatment temperature was appropriate, corrosion resistance was good, but strength was low |
| A6 | Heat treatment temperature was appropriate, and holding time was relatively short (31 minutes in effect) |
| A7 | Heat treatment temperature was relatively high. Cooling rate from 525° C. to 575° C. was relatively high (relatively short as being 28 minutes in effect) |
| A8 | Heat treatment temperature was relatively high. Cooling rate from 525° C. to 575° C. was relatively low (50 minutes in effect) |
| A9 | Cooling rate was relatively low (50 minutes in effect) |
| A10 | After heat treatment, drawing and straightness correction were performed at cold working ratio of 4.6% to obtain diameter of 25 mm |
| A11 | After heat treatment, drawing and straightness correction were performed at cold working ratio of 8.4% to obtain diameter of 24.5 mm |

TABLE 8-continued

| Step No. | Note |
|---|---|
| A12 | Same conditions as those of Step A1, except that diameter in Step A1 was 25 mm, whereas that in Step A12 was 24.5 mm |
| AH1 | — |
| AH2 | — |
| AH3 | Cooling rate from 460° C. to 400° C. was low due to furnace cooling |
| AH4 | Cooling rate from 460° C. to 400° C. was low due to furnace cooling |
| AH5 | α phase became coarse due to high heat treatment temperature |
| AH6 | Heat treatment temperature was low |
| AH7 | Heat treatment temperature was relatively high, and cooling rate from 525° C. to 575° C. was high |
| AH8 | Cooling rate from 460° C. to 400° C. was low |
| AH9 | Heat treatment temperature was appropriate, but holding time was short (12 minutes in effect) |
| AH10 | Maximum reaching temperature was high |
| AH11 | Extrusion was unable to be performed to the end due to low extrusion temperature |

TABLE 9

| Step No. | Material | Kind of Furnace | Temp. (° C.) | Holding Time (min) | Value of Conditional Expression | Note |
|---|---|---|---|---|---|---|
| B1 | Rod material obtained in Step A10 | Electric furnace on the production line | 275 | 180 | 738 | Appropriate conditions |
| B2 | | Electric furnace on the production line | 320 | 75 | 866 | Appropriate conditions |
| B3 | | Electric furnace on the production line | 290 | 75 | 606 | Appropriate conditions |
| BH1 | | Electric furnace on the production line | 220 | 120 | — | Temperature was low and straightness was poor |
| BH2 | | Electric furnace in the laboratory | 370 | 20 | 671 | Temperature was high |
| BH3 | | Electric furnace on the production line | 320 | 180 | 1342 | The value of the conditional expression was large |

Conditional Expression: $(T - 220) \times (t)^{1/2}$

T: Temperature (° C.), t: Time (min)

TABLE 10

| | Hot Extrusion | | | | Heat Treatment (Annealing) | | | | |
|---|---|---|---|---|---|---|---|---|---|
| Step No. | Temp. (° C.) | Cooling Rate from 575° C. to 525° C. (° C./min) | Cooling Rate from 460° C. to 400° C. (° C./min) | Diameter of Extruded Material before Heat Treatment (mm) | Temp. (° C.) | Holding Time (min) | Cooling Rate from 575° C. to 525° C. (° C./min) | Cooling Rate from 460° C. to 400° C. (° C./min) | Note |
| C0 | 640 | 16 | 12 | 50 | — | — | — | — | Materials for forging and wear resistance test |
| C1 | 640 | 16 | 12 | 50 | 560 | 80 | 15 | 12 | Appropriate conditions |

TABLE 11

| Step No. | Material | Hot Forging: Temp. (° C.) | Hot Forging: Cooling Rate from 575° C. to 525° C. (° C./min) | Hot Forging: Cooling Rate from 460° C. to 400° C. (° C./min) | Heat Treatment (Annealing): Kind of Furnace | Heat Treatment (Annealing): Temp. (° C.) | Heat Treatment (Annealing): Holding Time (min) | Heat Treatment (Annealing): Cooling Rate from 575° C. to 525° C. (° C./min) | Heat Treatment (Annealing): Cooling Rate from 460° C. to 400° C. (° C./min) |
|---|---|---|---|---|---|---|---|---|---|
| D1 | Round bar obtained in Step C0 | 690 | 20 | 16 | Electric Furnace in the Lab | 555 | 70 | 20 | 15 |
| D2 | | 690 | 20 | 16 | Electric Furnace in the Lab | 555 | 70 | 20 | 8 |
| D3 | | 690 | 20 | 16 | Electric Furnace in the Lab | 555 | 70 | 6 | 4.5 |
| D4 | | 690 | 20 | 16 | Electric Furnace in the Lab | 520 | 140 | 20 | 15 |
| D5 | | 690 | 20 | 16 | Continuous Furnace in the Lab | 590 | 3 | 1.8 | 15 |
| D6 | | 690 | 1.5 | 10 | — | — | — | — | — |
| D7 | | 690 | 20 | 16 | Continuous Furnace in Lab | 565 | 3 | 1 | 15 |
| DH1 | | 690 | 20 | 16 | — | — | — | — | — |
| DH2 | | 690 | 20 | 16 | Electric Furnace in the Lab | 555 | 70 | 6 | 2 |
| DH3 | | 690 | 20 | 16 | Continuous Furnace in the Lab | 590 | 3 | 1.7 | 1.7 |
| DH4 | | 690 | 20 | 16 | Continuous Furnace in the Lab | 565 | 3 | 5 | 15 |
| DH5 | | 690 | 3.5 | 10 | — | — | — | — | — |
| DH6 | | 690 | 20 | 16 | Electric Furnace in the Lab | 610 | 30 | 20 | 15 |
| DH7 | | 690 | 20 | 16 | Electric Furnace in the Lab | 520 | 45 | 20 | 15 |

TABLE 12

| Step No. | Note |
|---|---|
| D1 | Appropriate conditions |
| D2 | Cooling rate of heat treatment was made to vary |
| D3 | Cooling rate of heat treatment was made to vary |
| D4 | Heat treatment temperature was relatively low, but holding time was long |
| D5 | Cooling rate from 575° C. to 525° C. in heat treatment was relatively low (28 minutes in effect) |
| D6 | Cooling rate from 575° C. to 525° C. after forging was relatively low |
| D7 | Cooling rate from 575° C. to 525° C. in heat treatment was relatively low (43 minutes in effect) |
| DH1 | |

TABLE 12-continued

| Step No. | Note |
|---|---|
| DH2 | Cooling rate from 460° C. to 400° C. was low due to furnace cooling |
| DH3 | Cooling rate of heat treatment from 460° C. to 400° C. was low |
| DH4 | Cooling rate from 575° C. to 525° C. in heat treatment was high (11 minutes in effect) |
| DH5 | Cooling rate from 575° C. to 525° C. after forging was high |
| DH6 | Heat treatment temperature was relatively high |
| DH7 | Heat treatment temperature was relatively low, and holding time was short |

TABLE 13

| Step No. | Hot Extrusion: Temp. (° C.) | Hot Extrusion: Cooling Rate from 575° C. to 525° C. (° C./min) | Hot Extrusion: Cooling Rate from 460° C. to 400° C. (° C./min) | Hot Extrusion: Diameter of Extruded Material (mm) | Heat Treatment (Annealing): Temp. (° C.) | Heat Treatment (Annealing): Holding Time (min) | Heat Treatment (Annealing): Cooling Rate from 575° C. to 525° C. (° C./min) | Heat Treatment (Annealing): Cooling Rate from 460° C. to 400° C. (° C./min) | Note |
|---|---|---|---|---|---|---|---|---|---|
| E1 | 640 | 24 | 17 | 40 | 560 | 80 | 20 | 15 | Heat treatment temperature was appropriate. Material for hot workability evaluation |
| EH1 | 640 | 24 | 17 | 40 | — | — | — | — | Materials for forging and hot workability evaluation |

TABLE 14

| Step No. | Material | Hot Forging: Temp. (° C.) | Hot Forging: Cooling Rate from 575° C. to 525° C. (° C./min) | Hot Forging: Cooling Rate from 460° C. to 400° C. (° C./min) | Heat Treatment (Annealing): Kind of Furnace (*) | Heat Treatment (Annealing): Temp. (° C.) | Heat Treatment (Annealing): Holding Time (min) | Heat Treatment (Annealing): Cooling Rate from 575° C. to 525° C. (° C./min) | Heat Treatment (Annealing): Cooling Rate from 460° C. to 400° C. (° C./min) |
|---|---|---|---|---|---|---|---|---|---|
| F1 | Ø40 mm | 690 | 22 | 18 | A | 545 | 80 | 20 | 20 |
| F2 | round bar | 690 | 22 | 18 | A | 565 | 60 | 20 | 20 |
| F3 | obtained in Step EH1 | 690 | 22 | 18 | B | 570 | 3 | 1.2 | 10 |
| F4 | Ø40 mm | 690 | 22 | 18 | A | 560 | 70 | 20 | 20 |
| F5 | round bar obtained in Step PH1 (casting) | 690 | 22 | 18 | B | 590 | 5 | 1.2 | 10 |
| FH1 | Ø40 mm | 690 | 22 | 18 | — | — | — | — | — |
| FH2 | round bar obtained in Step EH1 | 690 | 22 | 18 | B | 590 | 5 | 1.8 | 1.5 |

(*) A: Electric furnace in the laboratory
B: Continuous furnace in the laboratory

TABLE 15

| Step No. | Note |
|---|---|
| F1 | Heat treatment temperature was slightly lower than the appropriate value |
| F2 | Heat treatment temperature was slightly higher than the appropriate value |
| F3 | Cooling rate from 575° C. to 525° C. in heat treatment was relatively low (40 minutes in effect) |
| F4 | Heat treatment temperature was appropriate |
| F5 | Cooling rate from 575° C. to 525° C. in heat treatment was relatively low (42 minutes in effect) |
| FH1 | — |
| FH2 | Cooling rate from 460° C. to 400° C. in heat treatment was low |

Regarding the above-described test materials, the metallographic structure observed, corrosion resistance (dezincification corrosion test/dipping test), and machinability were evaluated in the following procedure.

(Observation of Metallographic Structure)

The metallographic structure was observed using the following method and area ratios (%) of α phase, κ phase, β phase, γ phase, and μ phase were measured by image analysis. Note that α' phase, β' phase, and γ' phase were included in α phase, β phase, and γ phase respectively.

Each of the test materials, rod material or forged product, was cut in a direction parallel to the longitudinal direction or parallel to the flowing direction of the metallographic structure. Next, the surface was polished (mirror-polished) and was etched with a mixed solution of hydrogen peroxide and

TABLE 16

| Step No. | Method | Casting: Cooling Rate from 575° C. to 525° C. (° C./min) | Casting: Cooling Rate from 460° C. to 400° C. (° C./min) | Casting: Diameter of Casting (mm) | Heat Treatment (Annealing): Kind of Furnace (*) | Heat Treatment (Annealing): Temp. (° C.) | Heat Treatment (Annealing): Holding Time (min) | Heat Treatment (Annealing): Cooling Rate from 575° C. to 525° C. (° C./min) | Heat Treatment (Annealing): Cooling Rate from 460° C. to 400° C. (° C./min) |
|---|---|---|---|---|---|---|---|---|---|
| P1 | Metal mold casting | 30 | 20 | 40 | A | 560 | 120 | 20 | 20 |
| P2 | Continuous casting | 25 | 21 | 40 | A | 560 | 120 | 20 | 20 |
| P3 | Continuous casting | 25 | 21 | 40 | B | 595 | 5 | 1 | 15 |
| PH1 | Metal mold casting | 30 | 20 | 40 | — | — | — | — | — |

(*) A: Electric furnace in the laboratory
B: Continuous furnace in the laboratory

TABLE 17

| Step No. | Note |
|---|---|
| P1 | Heat treatment temperature was appropriate |
| P2 | Heat treatment temperature was appropriate |
| P3 | Heat treatment temperature was relatively high, and cooling rate from 575° C. to 525° C. was relatively low (50 minutes in effect) |
| PH1 | |

ammonia water. For etching, an aqueous solution obtained by mixing 3 mL of 3 vol % hydrogen peroxide water and 22 mL of 14 vol % ammonia water was used. At room temperature of about 15° C. to about 25° C., the metal's polished surface was dipped in the aqueous solution for about 2 seconds to about 5 seconds.

Using a metallographic microscope, the metallographic structure was observed mainly at a magnification of 500-fold and, depending on the conditions of the metallographic structure, at a magnification of 1000-fold. In micrographs of five visual fields, respective phases (α phase, κ phase, β phase, γ phase, and μ phase) were manually painted using image processing software "Photoshop CC". Next, the micrographs were binarized using image analysis software "WinROOF2013" to obtain the area ratios of the respective phases. Specifically, the average value of the area ratios of the five visual fields for each phase was calculated and regarded as the proportion of the phase. Thus, the total of the area ratios of all the constituent phases was 100%.

The lengths of the long sides of γ phase and μ phase were measured using the following method. Mainly using a 500-fold metallographic micrograph (when it is still difficult to distinguish, a 1000-fold metallographic micrograph instead), the maximum length of the long side of γ phase was measured in one visual field. This operation was performed in arbitrarily selected five visual fields, and the average maximum length of the long side of γ phase calculated from the lengths measured in the five visual fields was regarded as the length of the long side of γ phase. Likewise, by using a 500-fold or 1000-fold metallographic micrograph or using a 2000-fold or 5000-fold secondary electron micrograph (electron micrograph) according to the size of μ phase, the maximum length of the long side of μ phase in one visual field was measured. This operation was performed in arbitrarily selected five visual fields, and the average maximum length of the long sides of μ phase calculated from the lengths measured in the five visual fields was regarded as the length of the long side of μ phase.

Specifically, the evaluation was performed using an image that was printed out in a size of about 70 mm×about 90 mm. In the case of a magnification of 500-fold, the size of an observation field was 276 μm×220 μm.

When it was difficult to identify a phase, the phase was identified using an electron backscattering diffraction pattern (FE-SEM-EBSP) method at a magnification of 500-fold or 2000-fold.

In addition, in Examples in which the cooling rates were made to vary, in order to determine whether or not μ phase, which mainly precipitates at a grain boundary, was present, a secondary electron image was obtained using JSM-7000F (manufactured by JEOL Ltd.) under the conditions of acceleration voltage: 15 kV and current value (set value: 15) and JXA-8230 (manufactured by JEOL Ltd.) under the conditions of acceleration voltage: 20 kV and current value: $3.0\times10^{-11}$ A, and the metallographic structure was observed at a magnification of 2000-fold or 5000-fold. In cases where μ phase was able to be observed using the 2000-fold or 5000-fold secondary electron image but was not able to be observed using the 500-fold or 1000-fold metallographic micrograph, the μ phase was not included in the calculation of the area ratio. That is, μ phase that was able to be observed using the 2000-fold or 5000-fold secondary electron image but was not able to be observed using the 500-fold or 1000-fold metallographic micrograph was not included in the area ratio of μ phase. The reason for this is that, in most cases, the length of the long side of μ phase that is not able to be observed using the metallographic microscope is 5 μm or less, and the width of such μ phase is 0.3 μm or less. Therefore, such μ phase scarcely affects the area ratio.

The length of μ phase was measured in arbitrarily selected five visual fields, and the average value of the maximum lengths measured in the five visual fields was regarded as the length of the long side of μ phase as described above. The composition of μ phase was verified using an EDS, an accessory of JSM-7000F. Note that when μ phase was not able to be observed at a magnification of 500-fold or 1000-fold but the length of the long side of μ phase was measured at a higher magnification, in the measurement result columns of the tables, the area ratio of μ phase is indicated as 0%, but the length of the long side of μ phase is filled in.

(Observation of μ Phase)

Regarding μ phase, when cooling was performed in a temperature range of 460° C. to 400° C. at a cooling rate of 8° C./min or lower or 15° C./min or lower after hot extrusion or heat treatment, the presence of μ phase was able to be identified. FIG. 1 shows an example of a secondary electron image of Test No. T05 (Alloy No. S01/Step No. A3). It was verified that μ phase was precipitated at a grain boundary of α phase (elongated grayish white phase).

(Acicular κ Phase Present in α Phase)

Acicular κ phase (κ1 phase) present in α phase has a width of about 0.05 μm to about 0.5 μm and has an elongated linear shape or an acicular shape. If the width is 0.1 μm or more, the presence of κ1 phase can be identified using a metallographic microscope.

Figure 2:
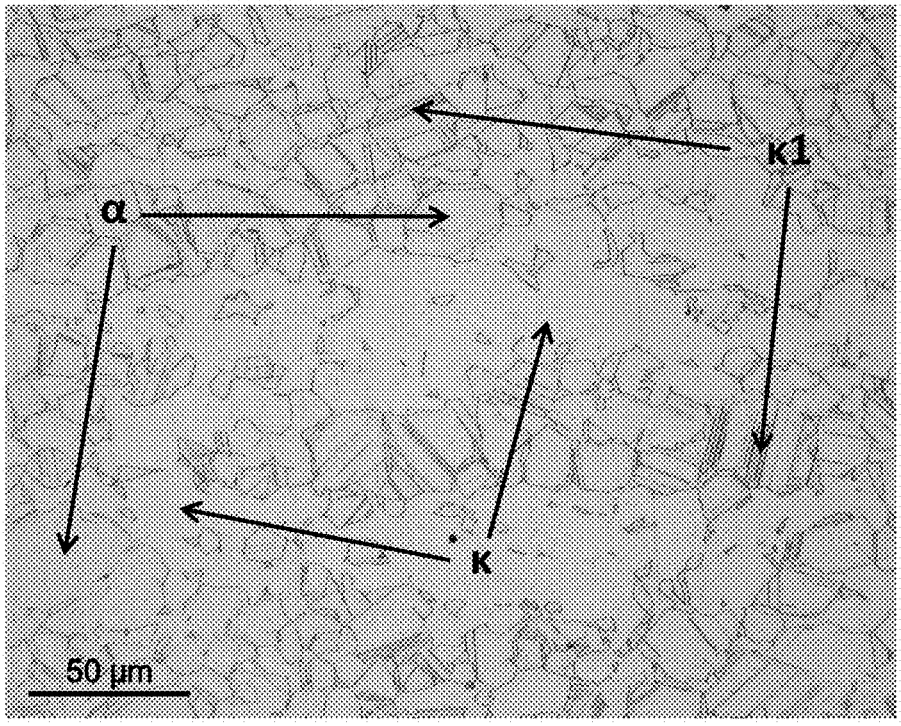
FIG. 2 is a metallographic micrograph of a metallographic structure of a free-cutting copper alloy (Test No. T03) according to Example 1.
Figure 3:
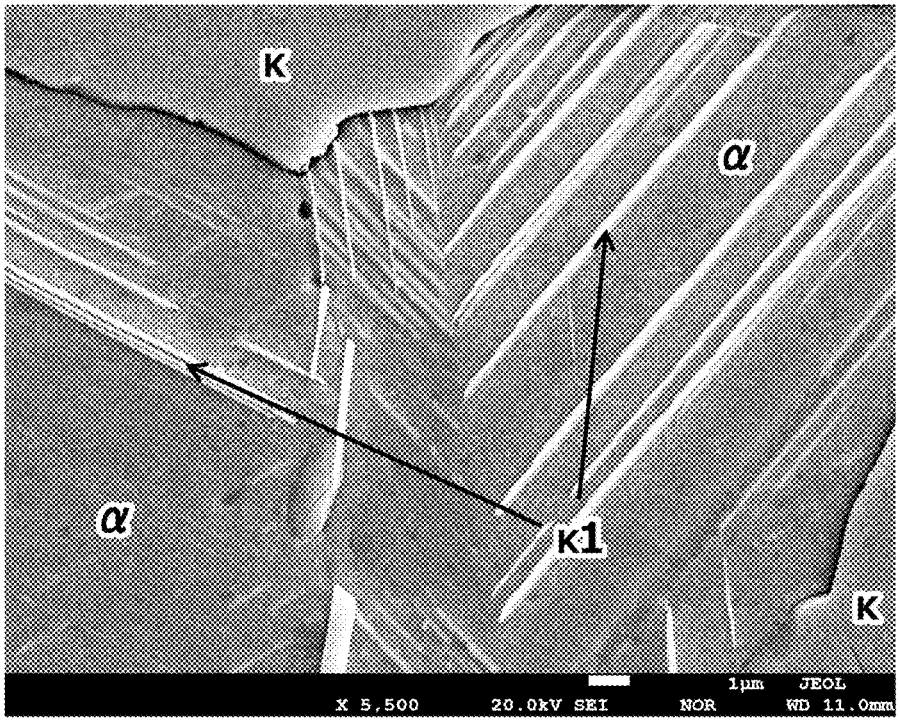
FIG. 3 is an electron micrograph of a metallographic structure of a free-cutting copper alloy (Test No. T03) according to Example 1.

FIG. 2 shows a metallographic micrograph of Test No. T03 (Alloy No. S01/Step No. A1) as a representative metallographic micrograph. FIG. 3 shows an electron micrograph of Test No. T03 (Alloy No. S01/Step No. A1) as a representative electron micrograph of acicular κ phase present in α phase. Observation points of FIGS. 2 and 3 were not the same. In a copper alloy, κ phase may be confused with twin crystal present in α phase. However, the width of κ phase is narrow, and twin crystal consists of a pair of crystals, and thus κ phase present in α phase can be distinguished from twin crystal present in α phase. In the metallographic micrograph of FIG. 2, a phase having an elongated, linear, and acicular pattern is observed in α phase. In the secondary electron image (electron micrograph) of FIG. 3, the pattern present in α phase can be clearly identified as κ phase. The thickness of κ phase was about 0.1 to about 0.2 μm.

The amount (number) of acicular κ phase in α phase was determined using the metallographic microscope. The micrographs of the five visual fields taken at a magnification of 500-fold or 1000-fold for the determination of the metallographic structure constituent phases (metallographic structure observation) were used. In an enlarged visual field printed out to the dimensions of about 70 mm in length and about 90 mm in width, the number of acicular κ phases was counted, and the average value of five visual fields was obtained. When the average number of acicular κ phase in the five visual fields is 20 or more and less than 70, it was determined that acicular κ phase was clearly present, and "Δ" was indicated. When the average number of acicular κ phase in the five visual fields was 70 or more, it was determined that a large amount of acicular κ phase was present, and "○" was indicated. When the average number of acicular κ phase in the five visual fields was 19 or less, it was determined that almost no acicular κ phase was present, and "X" was indicated. The number of acicular κ1 phases that was unable to be observed using the images was not counted. In the case the image was enlarged 500 time, the dimensions of the viewed area were 276 μm×220 μm.

(Amounts of Sn and P in κ phase)

The amount of Sn and the amount of P contained in κ phase were measured using an X-ray microanalyzer. The measurement was performed using "JXA-8200" (manufactured by JEOL Ltd.) under the conditions of acceleration voltage: 20 kV and current value: $3.0\times10^{-8}$ A.

Regarding Test No. T101 (Alloy No. S03/Step No. AH1), Test No. T103 (Alloy No. S03/Step No. A1), and Test No. T130 (Alloy No. S03/Step No. BH3), the quantitative analysis of the concentrations of Sn, Cu, Si, and P in the respective phases was performed using the X-ray microanalyzer, and the results thereof are shown in Tables 18 to 20.

Regarding μ phase, the length of the longest long side in the visual field was measured using an EDS, an accessory of JSM-7000F.

TABLE 18

Test No. T101 (Alloy No. S03: 77.6Cu-3.38Si-0.53Sn-0.11P-0.009Pb/Step No. AH1)

| | Cu | Si | Sn | P | (mass%) Zn |
|---|---|---|---|---|---|
| α Phase | 77.3 | 2.6 | 0.34 | 0.08 | Balance |
| κ Phase | 78.2 | 4.1 | 0.44 | 0.15 | Balance |
| γ Phase | 76.0 | 6.3 | 3.7 | 0.22 | Balance |
| μ Phase | — | — | — | — | — |

TABLE 19

Test No. T103 (Alloy No. S03: 77.6Cu-3.38Si-0.53Sn-0.11P-0.009Pb/Step No. A1)

| | Cu | Si | Sn | P | (mass%) Zn |
|---|---|---|---|---|---|
| α Phase | 77.3 | 2.8 | 0.43 | 0.08 | Balance |
| κ Phase | 78.0 | 4.0 | 0.58 | 0.15 | Balance |
| γ Phase | 76.2 | 6.0 | 3.5 | 0.20 | Balance |
| μ Phase | — | — | — | — | — |

TABLE 20

Test No. T118 (Alloy No. S03: 77.6Cu-3.38Si-0.53Sn-0.11P-0.009Pb/Step No. BH3)

| | Cu | Si | Sn | P | (mass%) Zn |
|---|---|---|---|---|---|
| α Phase | 77.2 | 2.7 | 0.44 | 0.08 | Balance |
| κ Phase | 77.9 | 3.9 | 0.59 | 0.15 | Balance |
| γ Phase | 76.0 | 5.8 | 3.4 | 0.20 | Balance |
| μ Phase | 82.0 | 7.4 | 0.6 | 0.27 | Balance |

Based on the above-described measurement results, the following findings were obtained.

1) The concentrations of the elements distributed in the respective phases vary depending on the manufacturing method.

2) The amount of Sn distributed in κ phase is about 1.3 times that in α phase.

3) The Sn concentration in γ phase is about 8 to about 11 times the Sn concentration in α phase.

4) The Si concentrations in κ phase, γ phase, and μ phase are about 1.5 times, about 2.2 times, and about 2.7 times the Si concentration in α phase, respectively.

5) The Cu concentration in μ phase is higher than that in α phase, κ phase, γ phase, or μ phase.

6) As the proportion of γ phase increases, the Sn concentration in κ phase necessarily decreases.

7) The amount of P distributed in κ phase is about 2 times that in α phase.

8) The P concentrations in γ phase and μ phase are about 2.5 times and about 3.5 times the P concentration in α phase respectively.

9) Even with the same composition, as the proportion of γ phase decreases, the Sn concentration in α phase increases 1.3 times from 0.34 mass % to 0.44 mass %. Likewise, the Sn concentration in κ phase increases 1.3 times from 0.44 mass % to 0.58 mass %. The increase in the Sn concentration in κ phase is more than the increase in the Sn concentration in α phase (Alloy No. S03).

(Mechanical Properties)

(Tensile Strength)

Each of the test materials was processed into a No. 10 specimen according to JIS Z 2241, and the tensile strength thereof was measured. If the tensile strength of a hot extruded material or hot forged material is 550 N/mm$^2$ or higher, preferably 565 N/mm$^2$ or higher or 575 N/mm$^2$ or higher. Further, if the tensile strength is 590 N/mm$^2$ or higher, the material can be regarded as a free-cutting copper alloy of the highest quality, and with such a material, an increase in allowable stress or a reduction in the thickness and weight of members used in various fields can be realized.

As the alloy according to the embodiment is a copper alloy having a high tensile strength, the finished surface roughness of the tensile test specimen affects elongation and tensile strength. Therefore, the tensile test specimen was prepared so as to satisfy the following conditions (Condition of Finished Surface Roughness of Tensile Test Specimen)

The difference between the maximum value and the minimum value on the Z-axis is 2 μm or less in a cross-sectional curve corresponding to a standard length of 4 mm at any position between gauge marks on the tensile test specimen. The cross-sectional curve refers to a curve obtained by applying a low-pass filter of a cut-off value λs to a measured cross-sectional curve.

(High Temperature Creep)

A flanged specimen having a diameter of 10 mm according to JIS Z 2271 was prepared from each of the specimens. In a state where a load corresponding to 0.2% proof stress at room temperature was applied to the specimen, a creep strain after being kept for 100 hours at 150° C. was measured. If the creep strain is 0.4% or lower after the test piece is held at 150° C. for 100 hours in a state where 0.2% proof stress, that is, a load corresponding to 0.2% plastic deformation in elongation between gauge marks under room temperature, is applied, the specimen is regarded to have good high-temperature creep. In the case this creep strain is 0.3% or lower, further, 0.2% or lower, the alloy is regarded to be of the highest quality among copper alloys, and such material can be used as a highly reliable material in, for example, valves used under high temperature or in automobile components used in a place close to the engine room.

(Impact Resistance)

In an impact test, a U-notched specimen (notch depth: 2 mm, notch bottom radius: 1 mm) according to JIS Z 2242 was taken from each of the extruded rod materials, the forged materials, and alternate materials thereof, the cast materials, and the continuously cast rod materials. Using an impact blade having a radius of 2 mm, a Charpy impact test was performed to measure the impact value.

The relation between the impact value obtained from the V-notched specimen and the impact value obtained from the U-notched specimen is substantially as follows.

$$(V\text{-Notch Impact Value})=0.8\times(U\text{-Notch Impact Value})-3$$

(Machinability)

The machinability was evaluated as follows in a cutting test using a lathe.

Hot extruded rod materials having a diameter of 50 mm, 40 mm, or 25.6 mm, cold drawn materials having a diameter of 25 mm (24.5 mm), and castings were machined to prepare test materials having a diameter of 18 mm. A forged material was machined to prepare a test material having a diameter of 14.5 mm. A point nose straight tool, in particular, a tungsten carbide tool not equipped with a chip breaker was attached to the lathe. Using this lathe, the circumference of the test material having a diameter of 18 mm or a diameter of 14.5 mm was machined under dry conditions at rake angle: −6 degrees, nose radius: 0.4 mm, machining speed: 150 m/min, machining depth: 1.0 mm, and feed rate: 0.11 mm/rev.

A signal emitted from a dynamometer (AST tool dynamometer AST-TL1003, manufactured by Mihodenki Co., Ltd.) that is composed of three portions attached to the tool was electrically converted into a voltage signal, and this voltage signal was recorded on a recorder. Next, this signal was converted into cutting resistance (N). Accordingly, the machinability of the alloy was evaluated by measuring the cutting resistance, in particular, the principal component of cutting resistance showing the highest value during machining.

Concurrently, chips were collected, and the machinability was evaluated based on the chip shape. The most serious problem during actual machining is that chips become entangled with the tool or become bulky. Therefore, when all the chips that were generated had a chip shape with one winding or less, it was evaluated as "○" (good). When the chips had a chip shape with more than one winding and three windings or less, it was evaluated as "Δ" (fair). When a chip having a shape with more than three windings was included, it was evaluated as "X" (poor). This way, the evaluation was performed in three grades.

The cutting resistance depends on the strength of the material, for example, shear stress, tensile strength, or 0.2% proof stress, and as the strength of the material increases, the cutting resistance tends to increase. Cutting resistance that is higher than the cutting resistance of a free-cutting brass rod including 1% to 4% of Pb by about 100 to about 20%, the cutting resistance is sufficiently acceptable for practical use. In the embodiment, since the target is to obtain superb machinability with minimum Pb content by having κ1 phase present in α phase and increasing the concentrations of Sn and P in κ phase, the cutting resistance was evaluated based on whether or not the material had cutting resistance of 125 N (boundary value). Specifically, when the cutting resistance was 125 N or lower, the machinability was evaluated as excellent (evaluation: ○). When the cutting resistance was higher than 125 N and 145 N or lower, the machinability was evaluated as "acceptable (Δ)". When the cutting resistance was higher than 145 N, the cutting resistance was evaluated as "unacceptable (X)". Incidentally, when Step No. E1 was performed on a 58 mass % Cu-42 mass % Zn alloy to prepare a sample and this sample was evaluated, the cutting resistance was 185 N.

(Hot Working Test)

The rod materials and castings having a diameter of 50 mm, 40 mm, 25.6 mm, or 25.0 mm were machined to prepare test materials having a diameter of 15 mm and a length of 25 mm. The test materials were held at 740° C. or 635° C. for 20 minutes. Next, the test materials were horizontally set and compressed to a thickness of 5 mm at a high temperature using an Amsler testing machine having a hot compression capacity of 10 ton and equipped with an electric furnace at a strain rate of 0.02/sec and a working ratio of 80%.

Hot workability was evaluated using a magnifying glass at a magnification of 10-fold, and when cracks having an opening of 0.2 mm or more were observed, it was regarded that cracks occurred. When cracking did not occur under two conditions of 740° C. and 635° C., it was evaluated as "○" (good). When cracking occurred at 740° C. but did not occur at 635° C., it was evaluated as "Δ" (fair). When cracking did not occur at 740° C. and occurred at 635° C., it was evaluated as "▲" (fair). When cracking occurred at both of the temperatures, 740° C. and 635° C., it was evaluated as "X" (poor).

When cracking did not occur under two conditions of 740° C. and 635° C., even if the material's temperature decreases to some extent during actual hot extrusion or hot forging, or even if the material comes into contact with a mold or a die even for a moment and the material's temperature decreases, there is no problem in practical use as long as hot extrusion or hot forging is performed at an appropriate temperature. When cracking occurs at either temperature of 740° C. or 635° C., although hot working is considered to be possible, there is a restriction in practical use, and therefore, it is necessary to perform hot working in a more narrowly controlled temperature range. When cracking occurred at both temperatures of 740° C. and 635° C., it is determined to be unacceptable as that is a serious problem in practical use.

(Dezincification Corrosion Tests 1 and 2)

When the test material was an extruded material, the test material was embedded in a phenol resin material such that an exposed sample surface of the test material was perpendicular to the extrusion direction. When the test material was a cast material (cast rod), the test material was embedded in a phenol resin material such that an exposed sample surface of the test material was perpendicular to the longitudinal direction of the cast material. When the test material was a forged material, the test material was embedded in a phenol resin material such that an exposed sample surface of the test material was perpendicular to the flowing direction of forging.

The sample surface was polished with emery paper up to grit 1200, was ultrasonically cleaned in pure water, and then was dried with a blower. Next, each of the samples was dipped in a prepared dipping solution.

After the end of the test, the samples were embedded in a phenol resin material again such that the exposed surface is maintained to be perpendicular to the extrusion direction, the longitudinal direction, or the flowing direction of forging. Next, the sample was cut such that the cross-section of a corroded portion was the longest cut portion. Next, the sample was polished.

Using a metallographic microscope, corrosion depth was observed in 10 visual fields (arbitrarily selected 10 visual fields) of the microscope at a magnification of 500-fold. The deepest corrosion point was recorded as the maximum dezincification corrosion depth.

In the dezincification corrosion test 1, the following test solution 1 was prepared as the dipping solution, and the above-described operation was performed. In the dezincification corrosion test 2, the following test solution 2 was prepared as the dipping solution, and the above-described operation was performed.

The test solution 1 is a solution for performing an accelerated test in a harsh corrosion environment simulating an environment in which an excess amount of a disinfectant which acts as an oxidant is added such that pH is significantly low. When this solution is used, it is presumed that this test is an about 75 to 100 times accelerated test performed in such a harsh corrosion environment. As the embodiment aims at obtaining excellent corrosion resistance under a harsh environment, if the maximum corrosion depth is 80 μm or less, corrosion resistance is excellent. If excellent corrosion resistance is required, it is presumed that the maximum corrosion depth is preferably 60 μm or less and more preferably 40 μm or less.

The test solution 2 is a solution for performing an accelerated test in a harsh corrosion environment, for simulating water quality that makes corrosion advance fast in which the chloride ion concentration is high and pH is low. When this solution is used, it is presumed that corrosion is accelerated about 30 to 50 times in such a harsh corrosion environment. If the maximum corrosion depth is 50 μm or less, corrosion resistance is good. When excellent corrosion resistance is required, it is presumed that the maximum corrosion depth is preferably 35 μm or less and more preferably 25 μm or less. The Examples of the instant invention were evaluated based on these presumed values.

In the dezincification corrosion test 1, hypochlorous acid water (concentration: 30 ppm, pH=6.8, water temperature: 40° C.) was used as the test solution 1. Using the following method, the test solution 1 was adjusted. Commercially available sodium hypochlorite (NaClO) was added to 40 L of distilled water and was adjusted such that the residual chlorine concentration measured by iodometric titration was 30 mg/L. Residual chlorine decomposes and decreases in amount over time. Therefore, while continuously measuring the residual chlorine concentration using a voltammetric method, the amount of sodium hypochlorite added was electronically controlled using an electromagnetic pump. In order to reduce pH to 6.8, carbon dioxide was added while adjusting the flow rate thereof. The water temperature was adjusted to 40° C. using a temperature controller. While maintaining the residual chlorine concentration, pH, and the water temperature to be constant, the sample was held in the test solution 1 for 2 months. Next, the sample was taken out from the aqueous solution, and the maximum value (maximum dezincification corrosion depth) of the dezincification corrosion depth was measured.

In the dezincification corrosion test 2, a test water including components shown in Table 21 was used as the test solution 2. The test solution 2 was adjusted by adding a commercially available chemical agent to distilled water. Simulating highly corrosive tap water, 80 mg/L of chloride ions, 40 mg/L of sulfate ions, and 30 mg/L of nitrate ion were added. The alkalinity and hardness were adjusted to 30 mg/L and 60 mg/L, respectively, based on Japanese general tap water. In order to reduce pH to 6.3, carbon dioxide was added while adjusting the flow rate thereof. In order to saturate the dissolved oxygen concentration, oxygen gas was continuously added. The water temperature was adjusted to 25° C. which is the same as room temperature. While maintaining pH and the water temperature to be constant and maintaining the dissolved oxygen concentration in the saturated state, the sample was held in the test solution 2 for 3 months. Next, the sample was taken out from the aqueous solution, and the maximum value (maximum dezincification corrosion depth) of the dezincification corrosion depth was measured.

TABLE 21

(Units of Items other than pH: mg/L)

| Mg | Ca | Na | K | $NO^{3-}$ | $SO_4^{2-}$ | Cl | Alkalinity | Hardness | pH |
|---|---|---|---|---|---|---|---|---|---|
| 10.1 | 7.3 | 55 | 19 | 30 | 40 | 80 | 30 | 60 | 6.3 |

(Dezincification Corrosion Test 3: Dezincification Corrosion Test according to ISO 6509)

This test is adopted in many countries as a dezincification corrosion test method and is defined by JIS H 3250 of JIS Standards.

As in the case of the dezincification corrosion tests 1 and 2, the test material was embedded in a phenol resin material. For example, the test material was embedded in a phenol resin material such that the exposed sample surface was perpendicular to the extrusion direction of the extruded material. The sample surface was polished with emery paper up to grit 1200, was ultrasonically cleaned in pure water, and then was dried.

Subsequently, each of the samples was dipped in an aqueous solution (12.7 g/L) of 1.0% cupric chloride dihydrate ($CuCl_2.2H_2O$) and was held under a temperature condition of 75° C. for 24 hours. Next, the sample was taken out from the aqueous solution.

The samples were embedded in a phenol resin material again such that the exposed surfaces were maintained to be perpendicular to the extrusion direction, the longitudinal direction, or the flowing direction of forging. Next, the samples were cut such that the longest possible cross-section of a corroded portion could be obtained. Next, the samples were polished.

Using a metallographic microscope, corrosion depth was observed in 10 visual fields of the microscope at a magnification of 200-fold or 500-fold. The deepest corrosion point was recorded as the maximum dezincification corrosion depth.

When the maximum corrosion depth in the test according to ISO 6509 is 200 μm or less, there was no problem for practical use regarding corrosion resistance. When particularly excellent corrosion resistance is required, it is presumed that the maximum corrosion depth is preferably 100 μm or less and more preferably 50 μm or less.

In this test, when the maximum corrosion depth was more than 200 μm, it was evaluated as "X" (poor). When the maximum corrosion depth was more than 50 μm and 200 μm or less, it was evaluated as "Δ" (fair). When the maximum corrosion depth was 50 μm or less, it was strictly evaluated as "○" (good). In the embodiment, a strict evaluation criterion was adopted because the alloy was assumed to be used in a harsh corrosion environment, and only when the evaluation was "○", it was determined that corrosion resistance was excellent.

(Cavitation Resistance)

Cavitation refers to a phenomenon in which the formation and elimination of bubbles occurs within a short period of time due to a difference in pressure in the flow of liquid. Cavitation resistance refer to resistance to damages caused by the formation and elimination of bubbles.

Cavitation resistance were evaluated using a direct magnetostriction vibration test. The sample was cut into a diameter of 16 mm by cutting, and subsequently an exposure test surface was polished with waterproof abrasive paper of #1200. As a result, a sample was prepared. The sample was attached to a horn at a tip of a vibrator. The sample was ultrasonically vibrated in a test solution under conditions of vibration frequency: 18 kHz, amplitude: 40 μm, and test time: 2 hours. As a test solution in which the sample surface was dipped, ion exchange water was used. A beaker to which ion exchange water was added was cooled such that the water temperature was 20° C.±2° C. (18° C. to 22° C.). The weight of the sample was measured before and after the test, and cavitation resistance were evaluated based on a difference in weight. When the difference in weight (decrease in weight) was more than 0.03 g, the surface was damaged, and cavitation resistance were determined to be significantly poor. When the difference in weight (decrease in weight) was more than 0.005 g and 0.03 g or less, surface damages were small, and cavitation resistance were determined to be good. However, in the embodiment, excellent cavitation resistance are desired. Therefore, a difference of more than 0.005 g and 0.03 g or less was determined to be poor. When the difference in weight (decrease in weight) was 0.005 g or less, there were substantially no surface damages, and cavitation resistance were determined to be excellent. When the difference in weight (decrease in weight) was 0.003 g or less, cavitation resistance were determined to be particularly excellent.

Incidentally, when a free-cutting brass 59Cu-3Pb-38Zn including Pb was tested under the same test conditions, a decrease in weight was 0.10 g.

(Erosion-Corrosion Resistance)

Erosion-corrosion refers to a phenomenon in which local corrosion rapidly progresses due to a combination of a chemical corrosion phenomenon caused by fluid and a physical scraping phenomenon. Erosion-corrosion resistance refers to resistance to this corrosion.

The sample surface was made to have a flat true circular shape having a diameter of 20 mm, and subsequently was further polished with emery paper of #2000. As a result, the sample was prepared. Using a nozzle having an aperture of 1.6 mm, test water was brought into contact with the sample at a flow rate of about 9 m/sec (test method 1) or a flow rate of about 7 m/sec (test method 2). Specifically, the water was brought into contact with the center of the sample surface from a direction perpendicular to the sample surface. In addition, the distance between a nozzle tip and the sample surface was 0.4 mm. After bringing the test water into contact with the sample under the above-described conditions for 336 hours, a decrease in corrosion was measured.

As the test water, hypochlorous acid water (concentration: 30 ppm, pH=7.0, water temperature: 40° C.) was used. The test water was prepared using the following method. Commercially available sodium hypochlorite (NaClO) was poured into 40 L of distilled water. The amount of sodium hypochlorite was adjusted such that the residual chlorine concentration measured by iodometric titration was 30 mg/L. The residual chlorine is decomposed and decreases in amount over time. Therefore, while continuously measuring the residual chlorine concentration using a voltammetric method, the addition amount of sodium hypochlorite was electronically controlled using an electromagnetic pump. In order to reduce pH to 7.0, carbon dioxide was added while adjusting the flow rate thereof. The water temperature was adjusted to 40° C. using a temperature controller. This way, the residual chlorine concentration, pH, and the water temperature were maintained to be constant.

In the test method 1, when the decrease in corrosion was more than 75 mg, erosion-corrosion resistance was evaluated to be poor. When the decrease in corrosion was more than 50 mg and 75 mg or less, erosion-corrosion resistance was evaluated to be good. When the decrease in corrosion was more than 30 mg and 50 mg or less, erosion-corrosion resistance was evaluated to be excellent. When the decrease in corrosion was 30 mg or less, erosion-corrosion resistance was evaluated to be particularly excellent.

Likewise, in the test method 2, when the decrease in corrosion was more than 60 mg, erosion-corrosion resistance was evaluated to be poor. When the decrease in corrosion was more than 40 mg and 60 mg or less, erosion-corrosion resistance was evaluated to be good. When the decrease in corrosion was more than 25 mg and 40 mg or less, erosion-corrosion resistance was evaluated to be excellent. When the decrease in corrosion was 25 mg or less, erosion-corrosion resistance was evaluated to be particularly excellent.

The evaluation results are shown in Tables 22 to 69.

Tests No. T01 to T164 are the results of experiments performed on the actual production line. Tests No. T201 to T258 are the results of laboratory experiments performed on alloys corresponding to Examples. Tests No. T301 to T329 are the results of laboratory experiments performed on alloys corresponding to Comparative Examples.

Regarding the length of the long side of μ phase in the tables, the value "40" refers to 40 μm or more. In addition, regarding the length of the long side of γ phase in the tables, the value "150" refers to 150 μm or more.

TABLE 22

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T01 | S01 | AH1 | 32.7 | 5.6 | 0 | 0 | 94.4 | 100 | 5.6 | 48.5 | 88 | 0 | X | 0.40 | 0.13 |
| T02 | S01 | AH2 | 32.8 | 5.3 | 0 | 0 | 94.7 | 100 | 5.3 | 48.2 | 80 | 0 | X | 0.41 | 0.13 |
| T03 | S01 | A1 | 40.4 | 0.9 | 0 | 0 | 99.1 | 100 | 0.9 | 48.1 | 30 | 0 | ○ | 0.52 | 0.13 |
| T04 | S01 | A2 | 40.9 | 0.8 | 0 | 0 | 99.2 | 100 | 0.8 | 48.3 | 28 | 0 | ○ | 0.53 | 0.13 |
| T05 | S01 | A3 | 40.5 | 1.0 | 0 | 0 | 99.0 | 100 | 1.0 | 48.5 | 32 | 1 | ○ | 0.52 | 0.13 |
| T06 | S01 | A4 | 40.1 | 0.9 | 0 | 0.4 | 98.7 | 100 | 1.3 | 47.9 | 36 | 12 | ○ | 0.53 | 0.13 |
| T07 | S01 | AH3 | 39.4 | 0.7 | 0 | 1.6 | 97.7 | 100 | 2.3 | 47.2 | 26 | 20 | ○ | 0.54 | 0.13 |
| T08 | S01 | AH4 | 37.7 | 0.6 | 0 | 4.5 | 94.9 | 100 | 5.1 | 46.4 | 22 | 40 | ○ | 0.53 | 0.13 |
| T09 | S01 | A5 | 40.5 | 0.5 | 0 | 0 | 99.5 | 100 | 0.5 | 46.7 | 20 | 0 | ○ | 0.54 | 0.13 |
| T10 | S01 | A6 | 40.3 | 1.1 | 0 | 0 | 98.9 | 100 | 1.1 | 48.6 | 36 | 0 | ○ | 0.52 | 0.13 |
| T11 | S01 | AH5 | 39.9 | 2.2 | 0 | 0 | 97.8 | 100 | 2.2 | 50.8 | 64 | 0 | X | 0.48 | 0.12 |
| T12 | S01 | AH6 | 39.9 | 2.4 | 0 | 0 | 97.6 | 100 | 2.4 | 51.2 | 76 | 0 | X | 0.47 | 0.12 |
| T13 | S01 | AH7 | 39.8 | 1.8 | 0 | 0 | 98.2 | 100 | 1.8 | 49.8 | 54 | 0 | X | 0.49 | 0.13 |
| T14 | S01 | A7 | 39.7 | 1.5 | 0 | 0 | 98.5 | 100 | 1.5 | 49.0 | 40 | 0 | ○ | 0.50 | 0.13 |
| T15 | S01 | A8 | 40.3 | 1.0 | 0 | 0 | 99.0 | 100 | 1.0 | 48.3 | 34 | 0 | ○ | 0.52 | 0.13 |
| T16 | S01 | AH8 | 40.1 | 1.7 | 0 | 2.6 | 95.7 | 100 | 4.3 | 51.2 | 50 | 40 | ○ | 0.51 | 0.13 |
| T17 | S01 | A9 | 40.3 | 1.1 | 0 | 0 | 98.9 | 100 | 1.1 | 48.6 | 38 | 0 | ○ | 0.52 | 0.13 |
| T19 | S01 | AH9 | 39.3 | 1.8 | 0 | 0 | 98.2 | 100 | 1.8 | 49.3 | 52 | 0 | ○ | 0.50 | 0.13 |
| T20 | S01 | AH10 | 39.4 | 1.5 | 0 | 0 | 98.5 | 100 | 1.5 | 48.7 | 52 | 0 | Δ | 0.50 | 0.13 |

TABLE 23

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T01 | S01 | AH1 | 110 | ○ | ○ | 120 | 74 | ○ |
| T02 | S01 | AH2 | 112 | ○ | — | 122 | 70 | — |
| T03 | S01 | A1 | 114 | ○ | — | 34 | 24 | ○ |
| T04 | S01 | A2 | 116 | ○ | — | 36 | 32 | — |
| T05 | S01 | A3 | 115 | ○ | — | 32 | 36 | — |
| T06 | S01 | A4 | 116 | ○ | — | 60 | 40 | ○ |
| T07 | S01 | AH3 | 115 | ○ | — | 78 | 54 | — |
| T08 | S01 | AH4 | 116 | ○ | — | 108 | 64 | ○ |
| T09 | S01 | A5 | 113 | ○ | — | 46 | 32 | ○ |
| T10 | S01 | A6 | 114 | ○ | — | 68 | 40 | — |
| T11 | S01 | AH5 | 118 | ○ | — | 88 | 54 | — |
| T12 | S01 | AH6 | 116 | ○ | — | 100 | 58 | ○ |
| T13 | S01 | AH7 | 117 | ○ | — | 84 | 48 | — |
| T14 | S01 | A7 | 113 | ○ | — | 66 | 42 | — |
| T15 | S01 | A8 | 114 | ○ | — | 52 | 34 | — |
| T16 | S01 | AH8 | 116 | ○ | — | 108 | 66 | ○ |
| T17 | S01 | A9 | 115 | ○ | — | 58 | 32 | ○ |
| T19 | S01 | AH9 | 113 | ○ | — | 84 | 48 | — |
| T20 | S01 | AH10 | 116 | ○ | — | 78 | 54 | — |

TABLE 24

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T01 | S01 | AH1 | 555 | 22.2 | 15.4 | 613 | 628 |
| T02 | S01 | AH2 | 591 | 16.4 | 14.3 | 638 | 652 |
| T03 | S01 | A1 | 618 | 27.4 | 21.0 | 698 | 719 |
| T04 | S01 | A2 | 617 | 27.6 | 21.0 | 696 | 717 |
| T05 | S01 | A3 | 609 | 26.4 | 20.6 | 684 | 705 |
| T06 | S01 | A4 | 607 | 25.4 | 20.5 | 680 | 700 |
| T07 | S01 | AH3 | 585 | 22.6 | 18.4 | 648 | 666 |
| T08 | S01 | AH4 | 570 | 20.8 | 15.1 | 626 | 641 |
| T09 | S01 | A5 | 608 | 28.6 | 21.8 | 689 | 711 |
| T10 | S01 | A6 | 616 | 24.8 | 19.2 | 688 | 707 |
| T11 | S01 | AH5 | 574 | 23.4 | 19.4 | 637 | 657 |
| T12 | S01 | AH6 | 601 | 19.2 | 16.6 | 656 | 673 |
| T13 | S01 | AH7 | 578 | 22.8 | 18.8 | 640 | 659 |
| T14 | S01 | A7 | 589 | 24.6 | 19.6 | 658 | 677 |
| T15 | S01 | A8 | 603 | 26.4 | 20.7 | 677 | 698 |
| T16 | S01 | AH8 | 580 | 22.8 | 15.2 | 642 | 657 |
| T17 | S01 | A9 | 614 | 26.8 | 20.5 | 691 | 712 |
| T19 | S01 | AH9 | 587 | 23.6 | 18.5 | 653 | 671 |
| T20 | S01 | AH10 | 580 | 24.0 | 19.5 | 646 | 666 |

TABLE 25

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T01 | S01 | AH1 | 0.46 | 0.0061 | 106 | 72 |
| T02 | S01 | AH2 | — | — | — | — |
| T03 | S01 | A1 | 0.15 | 0.0031 | 60 | 38 |
| T04 | S01 | A2 | — | — | 61 | 42 |
| T05 | S01 | A3 | 0.16 | — | — | — |
| T06 | S01 | A4 | 0.26 | 0.0031 | 65 | 44 |
| T07 | S01 | AH3 | 0.36 | 0.0042 | 77 | 58 |
| T08 | S01 | AH4 | 0.47 | 0.0059 | 81 | 79 |
| T09 | S01 | A5 | 0.11 | — | 68 | 44 |
| T10 | S01 | A6 | 0.16 | — | — | — |
| T11 | S01 | AH5 | 0.29 | 0.0041 | 83 | 62 |
| T12 | S01 | AH6 | 0.32 | 0.0052 | 86 | 58 |
| T13 | S01 | AH7 | 0.30 | 0.0060 | — | — |
| T14 | S01 | A7 | 0.30 | — | — | — |
| T15 | S01 | A8 | — | 0.0032 | 63 | 37 |
| T16 | S01 | AH8 | 0.39 | 0.0060 | 84 | 73 |
| T17 | S01 | A9 | 0.16 | 0.0032 | 65 | 45 |
| T19 | S01 | AH9 | — | — | — | — |
| T20 | S01 | AH10 | — | 0.0043 | 80 | 58 |

TABLE 26

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T21 | S01 | A10 | 40.4 | 0.8 | 0 | 0 | 99.2 | 100 | 0.8 | 47.8 | 30 | 0 | ○ | 0.53 | 0.13 |
| T22 | S01 | A11 | 40.9 | 0.9 | 0 | 0 | 99.1 | 100 | 0.9 | 48.6 | 32 | 0 | ○ | 0.52 | 0.13 |
| T23 | S01 | A12 | 40.4 | 0.7 | 0 | 0 | 99.3 | 100 | 0.7 | 47.5 | 26 | 0 | ○ | 0.53 | 0.13 |
| T24 | S01 | B1 | 40.1 | 1.1 | 0 | 0 | 98.9 | 100 | 1.1 | 48.4 | 34 | 2 | ○ | 0.52 | 0.13 |
| T25 | S01 | B3 | 40.7 | 0.9 | 0 | 0 | 99.1 | 100 | 0.9 | 48.4 | 32 | 1 | ○ | 0.52 | 0.13 |
| T26 | S01 | BH2 | 39.2 | 0.7 | 0 | 1.9 | 97.4 | 100 | 2.6 | 47.2 | 28 | 34 | ○ | 0.54 | 0.13 |
| T27 | S01 | BH3 | 38.4 | 0.8 | 0 | 2.5 | 96.7 | 100 | 3.3 | 46.9 | 26 | 40 | ○ | 0.54 | 0.13 |
| T28 | S01 | C0 | 33.4 | 5.8 | 0 | 0 | 94.2 | 100 | 5.8 | 49.5 | 90 | 0 | X | 0.39 | 0.12 |
| T29 | S01 | C1 | 39.7 | 1.0 | 0 | 0 | 99.0 | 100 | 1.0 | 47.7 | 34 | 0 | ○ | 0.52 | 0.13 |
| T30 | S01 | DH1 | 34.7 | 4.4 | 0 | 0 | 95.6 | 100 | 4.4 | 49.0 | 82 | 0 | X | 0.43 | 0.13 |

TABLE 26-continued

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T31 | S01 | D1 | 41.1 | 0.5 | 0 | 0 | 99.5 | 100 | 0.5 | 47.4 | 22 | 0 | ○ | 0.54 | 0.13 |
| T32 | S01 | D2 | 41.5 | 0.4 | 0 | 0 | 99.6 | 100 | 0.4 | 47.4 | 20 | 1 | ○ | 0.54 | 0.13 |
| T33 | S01 | D3 | 40.8 | 0.7 | 0 | 0.3 | 99.0 | 100 | 1.0 | 48.0 | 24 | 16 | ○ | 0.53 | 0.13 |
| T34 | S01 | DH2 | 40.2 | 0.3 | 0 | 1.1 | 98.6 | 100 | 1.4 | 46.0 | 18 | 24 | ○ | 0.55 | 0.13 |
| T35 | S01 | D4 | 40.3 | 1.3 | 0 | 0 | 98.7 | 100 | 1.3 | 49.2 | 36 | 0 | ○ | 0.51 | 0.13 |
| T36 | S01 | D5 | 41.0 | 0.9 | 0 | 0 | 99.1 | 100 | 0.9 | 48.7 | 28 | 0 | ○ | 0.52 | 0.13 |
| T37 | S01 | DH3 | 39.4 | 0.7 | 0 | 2 | 97.3 | 100 | 2.7 | 47.4 | 26 | 30 | ○ | 0.54 | 0.13 |
| T38 | S01 | DH4 | 39.7 | 2.0 | 0 | 0 | 98.0 | 100 | 2.0 | 50.2 | 48 | 0 | ○ | 0.49 | 0.13 |

TABLE 27

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T21 | S01 | A10 | 117 | ○ | — | 38 | 26 | ○ |
| T22 | S01 | A11 | 119 | ○ | — | 40 | 32 | — |
| T23 | S01 | A12 | 117 | ○ | — | 36 | 24 | — |
| T24 | S01 | B1 | 116 | ○ | — | 42 | 28 | ○ |
| T25 | S01 | B3 | 116 | ○ | — | 44 | 28 | — |
| T26 | S01 | BH2 | 116 | ○ | — | 90 | 54 | — |
| T27 | S01 | BH3 | 117 | ○ | — | 98 | 58 | ○ |
| T28 | S01 | C0 | 108 | ○ | ○ | 122 | 72 | Δ |
| T29 | S01 | C1 | 111 | ○ | — | 50 | 34 | ○ |
| T30 | S01 | DH1 | 111 | ○ | — | — | — | — |
| T31 | S01 | D1 | 114 | ○ | — | 36 | 22 | — |
| T32 | S01 | D2 | 113 | ○ | — | 34 | 20 | — |
| T33 | S01 | D3 | 113 | ○ | — | 70 | 38 | — |
| T34 | S01 | DH2 | 115 | ○ | — | 72 | 44 | ○ |
| T35 | S01 | D4 | 113 | ○ | — | 76 | 44 | ○ |
| T36 | S01 | D5 | 114 | ○ | — | 54 | 34 | — |
| T37 | S01 | DH3 | 114 | ○ | — | 98 | 58 | — |
| T38 | S01 | DH4 | 113 | ○ | — | 86 | 52 | ○ |

TABLE 28

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T21 | S01 | A10 | 626 | 24.2 | 19.2 | 698 | 717 |
| T22 | S01 | A11 | 682 | 19.0 | 16.2 | 744 | 760 |
| T23 | S01 | A12 | 624 | 25.8 | 19.8 | 700 | 720 |
| T24 | S01 | B1 | 627 | 23.4 | 18.5 | 696 | 715 |
| T25 | S01 | B3 | 628 | 24.4 | 18.8 | 700 | 719 |
| T26 | S01 | BH2 | 598 | 19.0 | 15.7 | 653 | 668 |
| T27 | S01 | BH3 | 569 | 18.2 | 13.9 | 619 | 633 |
| T28 | S01 | C0 | 542 | 22.4 | 15.3 | 599 | 615 |
| T29 | S01 | C1 | 581 | 30.0 | 23.5 | 662 | 686 |
| T30 | S01 | DH1 | 555 | 23.2 | 16.6 | 616 | 632 |
| T31 | S01 | D1 | 587 | 32.6 | 23.6 | 676 | 700 |
| T32 | S01 | D2 | 585 | 33.2 | 23.7 | 676 | 699 |
| T33 | S01 | D3 | 581 | 32.2 | 22.4 | 668 | 691 |
| T34 | S01 | DH2 | 568 | 27.8 | 20.6 | 642 | 662 |
| T35 | S01 | D4 | 586 | 28.4 | 21.6 | 664 | 686 |
| T36 | S01 | D5 | 578 | 31.2 | 22.5 | 662 | 684 |
| T37 | S01 | DH3 | 570 | 26.8 | 19.6 | 642 | 662 |
| T38 | S01 | DH4 | 573 | 26.6 | 19.2 | 645 | 664 |

TABLE 29

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T21 | S01 | A10 | 0.14 | 0.0030 | 63 | 39 |
| T22 | S01 | A11 | 0.15 | 0.0031 | 61 | 38 |
| T23 | S01 | A12 | — | 0.0031 | 62 | 43 |
| T24 | S01 | B1 | 0.18 | 0.0031 | 63 | — |
| T25 | S01 | B3 | — | — | — | — |
| T26 | S01 | BH2 | — | — | — | — |
| T27 | S01 | BH3 | 0.41 | 0.0051 | 87 | 73 |
| T28 | S01 | C0 | — | 0.0070 | 108 | 78 |
| T29 | S01 | C1 | — | 0.0033 | — | — |
| T30 | S01 | DH1 | 0.38 | 0.0059 | 105 | 74 |
| T31 | S01 | D1 | 0.11 | 0.0030 | 62 | 43 |
| T32 | S01 | D2 | 0.11 | — | 59 | 44 |
| T33 | S01 | D3 | — | — | — | — |
| T34 | S01 | DH2 | 0.26 | 0.0033 | 72 | 63 |
| T35 | S01 | D4 | 0.18 | 0.0042 | 69 | 52 |
| T36 | S01 | D5 | — | — | 61 | 39 |
| T37 | S01 | DH3 | 0.34 | 0.0050 | 74 | 63 |
| T38 | S01 | DH4 | — | — | 84 | 56 |

TABLE 30

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T39 | S01 | D6 | 40.3 | 1.5 | 0 | 0 | 98.5 | 100 | 1.5 | 49.6 | 44 | 0 | Δ | 0.50 | 0.13 |
| T40 | S01 | DH5 | 38.3 | 2.6 | 0 | 0 | 97.4 | 100 | 2.6 | 49.9 | 64 | 0 | X | 0.46 | 0.13 |
| T41 | S01 | D7 | 40.7 | 0.7 | 0 | 0 | 99.3 | 100 | 0.7 | 47.8 | 26 | 0 | ○ | 0.53 | 0.13 |
| T42 | S01 | DH6 | 38.9 | 2.3 | 0 | 0 | 97.7 | 100 | 2.3 | 49.9 | 56 | 0 | X | 0.48 | 0.13 |
| T43 | S01 | DH7 | 39.6 | 2.1 | 0 | 0 | 97.9 | 100 | 2.1 | 50.2 | 50 | 0 | Δ | 0.49 | 0.13 |
| T44 | S01 | EH1 | 32.7 | 5.5 | 0 | 0 | 94.5 | 100 | 5.5 | 48.4 | 90 | 0 | X | 0.41 | 0.13 |
| T45 | S01 | E1 | 39.7 | 1.0 | 0 | 0 | 99.0 | 100 | 1.0 | 47.7 | 40 | 0 | ○ | 0.52 | 0.13 |
| T46 | S01 | FH1 | 34.9 | 4.7 | 0 | 0 | 95.3 | 100 | 4.7 | 49.6 | 78 | 0 | X | 0.42 | 0.12 |
| T47 | S01 | F1 | 41.8 | 0.6 | 0 | 0 | 99.4 | 100 | 0.6 | 48.5 | 22 | 0 | ○ | 0.53 | 0.13 |
| T48 | S01 | F2 | 42.4 | 0.2 | 0 | 0 | 99.8 | 100 | 0.2 | 47.1 | 20 | 0 | ○ | 0.55 | 0.13 |
| T49 | S01 | FH2 | 40.0 | 1.2 | 0 | 1.8 | 97.0 | 100 | 3.0 | 49.4 | 44 | 24 | ○ | 0.52 | 0.13 |
| T50 | S01 | F3 | 41.9 | 0.6 | 0 | 0 | 99.4 | 100 | 0.6 | 48.6 | 24 | 0 | ○ | 0.53 | 0.13 |
| T51 | S01 | F4 | 40.4 | 0.8 | 0 | 0 | 99.2 | 100 | 0.8 | 47.8 | 30 | 0 | ○ | 0.53 | 0.13 |
| T52 | S01 | F5 | 40.0 | 1.1 | 0 | 0 | 98.9 | 100 | 1.1 | 48.3 | 36 | 0 | ○ | 0.52 | 0.13 |
| T53 | S01 | PH1 | 34.9 | 4.7 | 0 | 0 | 95.3 | 100 | 4.7 | 49.6 | 78 | 0 | X | 0.42 | 0.12 |
| T54 | S01 | P1 | 41.8 | 0.6 | 0 | 0 | 99.4 | 100 | 0.6 | 48.5 | 26 | 0 | ○ | 0.53 | 0.13 |
| T55 | S01 | P2 | 42.4 | 0.2 | 0 | 0 | 99.8 | 100 | 0.2 | 47.1 | 22 | 0 | ○ | 0.55 | 0.13 |
| T56 | S01 | P3 | 40.0 | 1.1 | 0 | 0 | 98.9 | 100 | 1.1 | 48.3 | 36 | 0 | ○ | 0.52 | 0.13 |

TABLE 31

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T39 | S01 | D6 | 113 | ○ | — | 64 | 36 | — |
| T40 | S01 | DH5 | 115 | ○ | — | 96 | 62 | ○ |
| T41 | S01 | D7 | 113 | ○ | — | 64 | 46 | — |
| T42 | S01 | DH6 | 115 | ○ | — | 86 | 54 | ○ |
| T43 | S01 | DH7 | 115 | ○ | — | 82 | 50 | ○ |
| T44 | S01 | EH1 | 109 | ○ | ○ | 124 | 78 | ○ |
| T45 | S01 | E1 | 114 | ○ | — | 50 | 36 | — |
| T46 | S01 | FH1 | 111 | ○ | — | 110 | 66 | — |
| T47 | S01 | F1 | 114 | ○ | — | 34 | 22 | — |
| T48 | S01 | F2 | 115 | ○ | — | 42 | 18 | ○ |
| T49 | S01 | FH2 | 114 | ○ | — | 88 | 56 | ○ |
| T50 | S01 | F3 | 115 | ○ | — | 44 | 26 | — |
| T51 | S01 | F4 | 114 | ○ | — | 48 | 32 | ○ |
| T52 | S01 | F5 | 114 | ○ | — | 54 | 44 | — |
| T53 | S01 | PH1 | 110 | ○ | — | 130 | 68 | ○ |
| T54 | S01 | P1 | 113 | ○ | — | 46 | 24 | ○ |
| T55 | S01 | P2 | 114 | ○ | — | 42 | 32 | — |
| T56 | S01 | P3 | 112 | ○ | — | 58 | 44 | ○ |

TABLE 32

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T39 | S01 | D6 | 574 | 27.4 | 20.8 | 648 | 669 |
| T40 | S01 | DH5 | 564 | 25.8 | 18.3 | 633 | 652 |
| T41 | S01 | D7 | 580 | 31.4 | 23.2 | 665 | 688 |
| T42 | S01 | DH6 | 561 | 27.2 | 19.1 | 633 | 652 |
| T43 | S01 | DH7 | 575 | 26.4 | 18.3 | 647 | 665 |
| T44 | S01 | EH1 | 535 | 23.0 | 16.4 | 594 | 610 |
| T45 | S01 | E1 | 578 | 30.0 | 23.5 | 659 | 683 |
| T46 | S01 | FH1 | 550 | 23.6 | 16.2 | 611 | 628 |
| T47 | S01 | F1 | 590 | 32.2 | 23.7 | 678 | 702 |
| T48 | S01 | F2 | 584 | 33.8 | 24.8 | 676 | 700 |
| T49 | S01 | FH2 | 568 | 29.4 | 19.5 | 646 | 666 |
| T50 | S01 | F3 | 584 | 32.2 | 23.9 | 671 | 695 |
| T51 | S01 | F4 | 582 | 31.2 | 23.9 | 667 | 691 |
| T52 | S01 | F5 | 574 | 30.2 | 23.1 | 655 | 679 |
| T53 | S01 | PH1 | — | — | — | — | — |
| T54 | S01 | P1 | — | — | — | — | — |

TABLE 32-continued

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T55 | S01 | P2 | 584 | 27.8 | 24.8 | 660 | 685 |
| T56 | S01 | P3 | 580 | 26.2 | 23.1 | 652 | 675 |

TABLE 33

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T39 | S01 | D6 | 0.21 | 0.0039 | 72 | 55 |
| T40 | S01 | DH5 | 0.31 | 0.0060 | 91 | 66 |
| T41 | S01 | D7 | — | — | — | — |

TABLE 33-continued

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T42 | S01 | DH6 | 0.28 | — | 81 | 62 |
| T43 | S01 | DH7 | 0.30 | 0.0051 | 83 | 57 |
| T44 | S01 | EH1 | 0.46 | 0.0068 | 107 | 71 |
| T45 | S01 | E1 | 0.15 | 0.0033 | 59 | 44 |
| T46 | S01 | FH1 | 0.40 | 0.0060 | 106 | 73 |
| T47 | S01 | F1 | 0.12 | 0.0031 | 61 | 43 |
| T48 | S01 | F2 | — | — | — | — |
| T49 | S01 | FH2 | 0.35 | — | 78 | 65 |

TABLE 33-continued

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T50 | S01 | F3 | 0.12 | 0.0031 | 61 | 42 |
| T51 | S01 | F4 | 0.14 | 0.0031 | 62 | 40 |
| T52 | S01 | F5 | — | — | — | — |
| T53 | S01 | PH1 | 0.40 | 0.0052 | 110 | 72 |
| T54 | S01 | P1 | 0.12 | 0.0031 | 62 | 41 |
| T55 | S01 | P2 | 0.12 | 0.0032 | 58 | 42 |
| T56 | S01 | P3 | — | — | — | — |

TABLE 34

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T61 | S02 | AH1 | 40.8 | 5.3 | 0 | 0 | 94.7 | 100 | 5.3 | 56.6 | 86 | 0 | X | 0.56 | 0.11 |
| T62 | S02 | AH2 | 40.9 | 5.0 | 0 | 0 | 95.0 | 100 | 5.0 | 56.3 | 80 | 0 | X | 0.57 | 0.11 |
| T63 | S02 | A1 | 53.2 | 0.7 | 0 | 0 | 99.3 | 100 | 0.7 | 60.7 | 32 | 0 | ○ | 0.71 | 0.10 |
| T64 | S02 | A3 | 53.4 | 0.7 | 0 | 0 | 99.3 | 100 | 0.7 | 60.9 | 26 | 0 | ○ | 0.71 | 0.10 |
| T65 | S02 | A4 | 52.9 | 0.8 | 0 | 0.2 | 99.0 | 100 | 1.0 | 60.8 | 34 | 12 | ○ | 0.71 | 0.10 |
| T66 | S02 | AH3 | 53.6 | 0.5 | 0 | 1.4 | 98.1 | 100 | 1.9 | 61.0 | 32 | 30 | ○ | 0.73 | 0.10 |
| T67 | S02 | AH4 | 51.0 | 0.4 | 0 | 3.8 | 95.8 | 100 | 4.2 | 59.0 | 30 | 40 | ○ | 0.72 | 0.11 |
| T68 | S02 | A5 | 53.5 | 0.3 | 0 | 0 | 99.7 | 100 | 0.3 | 59.2 | 28 | 0 | ○ | 0.73 | 0.10 |
| T69 | S02 | A6 | 53.4 | 1.0 | 0 | 0 | 99.0 | 100 | 1.0 | 61.9 | 44 | 0 | ○ | 0.70 | 0.10 |
| T70 | S02 | AH5 | 53.1 | 2.1 | 0 | 0 | 97.9 | 100 | 2.1 | 64.4 | 56 | 0 | Δ | 0.65 | 0.10 |
| T71 | S02 | AH6 | 52.8 | 2.3 | 0 | 0 | 97.7 | 100 | 2.3 | 64.4 | 60 | 0 | Δ | 0.65 | 0.10 |
| T72 | S02 | A9 | 53.3 | 1.0 | 0 | 0 | 99.0 | 100 | 1.0 | 61.8 | 42 | 0 | ○ | 0.70 | 0.10 |
| T73 | S02 | AH9 | 52.3 | 1.7 | 0 | 0 | 98.3 | 100 | 1.7 | 62.6 | 54 | 0 | ○ | 0.67 | 0.10 |
| T74 | S02 | AH10 | 52.4 | 1.6 | 0 | 0 | 98.4 | 100 | 1.6 | 62.5 | 52 | 0 | ○ | 0.68 | 0.10 |
| T75 | S02 | A10 | 53.7 | 0.5 | 0 | 0 | 99.5 | 100 | 0.5 | 60.7 | 30 | 0 | ○ | 0.72 | 0.10 |
| T76 | S02 | B2 | 53.5 | 0.5 | 0 | 0 | 99.5 | 100 | 0.5 | 60.5 | 30 | 2 | ○ | 0.72 | 0.10 |
| T77 | S02 | BH2 | 52.4 | 0.6 | 0 | 1.8 | 97.6 | 100 | 2.4 | 60.6 | 24 | 26 | ○ | 0.73 | 0.11 |
| T78 | S02 | C0 | 41.5 | 5.7 | 0 | 0 | 94.3 | 100 | 5.7 | 57.8 | 94 | 0 | X | 0.54 | 0.10 |
| T79 | S02 | C1 | 52.8 | 0.7 | 0 | 0 | 99.3 | 100 | 0.7 | 60.3 | 38 | 0 | ○ | 0.72 | 0.10 |

TABLE 35

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T61 | S02 | AH1 | 108 | ○ | — | 122 | 66 | ○ |
| T62 | S02 | AH2 | 109 | ○ | — | 116 | 70 | — |
| T63 | S02 | A1 | 113 | ○ | — | 34 | 22 | ○ |
| T64 | S02 | A3 | 113 | ○ | — | 38 | 26 | — |
| T65 | S02 | A4 | 113 | ○ | — | 64 | 42 | — |
| T66 | S02 | AH3 | 112 | ○ | — | 82 | 52 | — |
| T67 | S02 | AH4 | 113 | ○ | — | 100 | 74 | ○ |
| T68 | S02 | A5 | 113 | ○ | — | 32 | 26 | — |
| T69 | S02 | A6 | 113 | ○ | — | 66 | 44 | ○ |
| T70 | S02 | AH5 | 117 | ○ | — | 82 | 54 | — |
| T71 | S02 | AH6 | 117 | ○ | — | 86 | 58 | ○ |
| T72 | S02 | A9 | 113 | ○ | — | 60 | 38 | — |
| T73 | S02 | AH9 | 112 | ○ | — | 84 | 52 | — |
| T74 | S02 | AH10 | 115 | ○ | — | 80 | 54 | — |
| T75 | S02 | A10 | 114 | ○ | — | 30 | 20 | ○ |
| T76 | S02 | B2 | 114 | ○ | — | 30 | 22 | — |
| T77 | S02 | BH2 | 112 | ○ | — | 76 | 52 | ○ |
| T78 | S02 | C0 | 108 | ○ | — | 124 | 70 | Δ |
| T79 | S02 | C1 | 111 | ○ | — | 52 | 28 | ○ |

TABLE 36

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T61 | S02 | AH1 | 563 | 18.6 | 13.4 | 613 | 627 |
| T62 | S02 | AH2 | 602 | 13.4 | 12.0 | 641 | 653 |
| T63 | S02 | A1 | 631 | 21.0 | 15.4 | 694 | 710 |
| T64 | S02 | A3 | 625 | 20.6 | 15.3 | 686 | 702 |
| T65 | S02 | A4 | 623 | 19.2 | 14.9 | 680 | 695 |
| T66 | S02 | AH3 | 598 | 18.2 | 13.3 | 650 | 663 |
| T67 | S02 | AH4 | 583 | 14.2 | 11.6 | 623 | 634 |
| T68 | S02 | A5 | 618 | 21.8 | 16.1 | 682 | 698 |
| T69 | S02 | A6 | 622 | 18.2 | 14.4 | 677 | 691 |
| T70 | S02 | AH5 | 576 | 18.0 | 14.2 | 625 | 640 |
| T71 | S02 | AH6 | 606 | 14.8 | 12.3 | 649 | 661 |
| T72 | S02 | A9 | 626 | 20.6 | 14.8 | 687 | 702 |
| T73 | S02 | AH9 | 599 | 17.8 | 13.5 | 650 | 664 |
| T74 | S02 | AH10 | 589 | 18.2 | 13.8 | 641 | 654 |
| T75 | S02 | A10 | 637 | 18.0 | 14.3 | 692 | 706 |
| T76 | S02 | B2 | 642 | 18.6 | 14.2 | 699 | 713 |
| T77 | S02 | BH2 | 611 | 12.4 | 11.4 | 648 | 659 |
| T78 | S02 | C0 | 558 | 18.2 | 12.7 | 606 | 619 |
| T79 | S02 | C1 | 593 | 22.5 | 16.8 | 657 | 674 |

TABLE 37

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T61 | S02 | AH1 | — | — | — | — |
| T62 | S02 | AH2 | 0.43 | 0.0070 | 69 | 51 |
| T63 | S02 | A1 | 0.12 | 0.0021 | 31 | 22 |
| T64 | S02 | A3 | — | — | — | — |
| T65 | S02 | A4 | 0.22 | — | — | — |
| T66 | S02 | AH3 | 0.34 | — | — | — |
| T67 | S02 | AH4 | 0.42 | 0.0053 | 52 | 49 |
| T68 | S02 | A5 | 0.10 | 0.0022 | 32 | 24 |
| T69 | S02 | A6 | — | — | — | — |
| T70 | S02 | AH5 | — | 0.0043 | — | — |
| T71 | S02 | AH6 | — | — | — | — |
| T72 | S02 | A9 | — | — | — | — |
| T73 | S02 | AH9 | — | — | — | — |
| T74 | S02 | AH10 | — | — | — | — |
| T75 | S02 | A10 | 0.11 | 0.0019 | 32 | 22 |
| T76 | S02 | B2 | 0.12 | 0.0023 | 32 | 23 |
| T77 | S02 | BH2 | 0.31 | 0.0057 | 51 | 42 |
| T78 | S02 | C0 | 0.47 | — | — | — |
| T79 | S02 | C1 | 0.12 | 0.0020 | 35 | 26 |

TABLE 38

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T80 | S02 | DH1 | 42.1 | 4.6 | 0 | 0 | 95.4 | 100 | 4.6 | 57.0 | 80 | 0 | X | 0.58 | 0.11 |
| T81 | S02 | D1 | 54.0 | 0.5 | 0 | 0 | 99.5 | 100 | 0.5 | 60.7 | 22 | 0 | ○ | 0.72 | 0.10 |
| T82 | S02 | D2 | 54.4 | 0.4 | 0 | 0 | 99.6 | 100 | 0.4 | 60.7 | 18 | 0 | ○ | 0.73 | 0.10 |
| T83 | S02 | D3 | 53.7 | 0.6 | 0 | 0.2 | 99.2 | 100 | 0.8 | 61.0 | 26 | 20 | ○ | 0.72 | 0.10 |
| T84 | S02 | DH2 | 53.2 | 0.3 | 0 | 1.1 | 98.6 | 100 | 1.4 | 59.5 | 24 | 22 | ○ | 0.74 | 0.10 |
| T85 | S02 | D4 | 53.5 | 1.2 | 0 | 0 | 98.8 | 100 | 1.2 | 62.6 | 44 | 0 | ○ | 0.69 | 0.10 |
| T86 | S02 | D5 | 54.0 | 0.8 | 0 | 0 | 99.2 | 100 | 0.8 | 61.9 | 32 | 0 | ○ | 0.71 | 0.10 |
| T87 | S02 | DH3 | 52.7 | 0.6 | 0 | 1.6 | 97.8 | 100 | 2.2 | 60.6 | 24 | 34 | ○ | 0.73 | 0.11 |
| T88 | S02 | DH4 | 52.7 | 2.1 | 0 | 0 | 97.9 | 100 | 2.1 | 64.0 | 50 | 0 | ○ | 0.65 | 0.10 |
| T89 | S02 | D7 | 53.7 | 0.6 | 0 | 0 | 99.4 | 100 | 0.6 | 60.9 | 26 | 0 | ○ | 0.72 | 0.10 |
| T90 | S02 | DH6 | 52.2 | 2.2 | 0 | 0 | 97.8 | 100 | 2.2 | 63.6 | 52 | 0 | Δ | 0.65 | 0.10 |
| T91 | S02 | DH7 | 52.7 | 2.1 | 0 | 0 | 97.9 | 100 | 2.1 | 64.0 | 58 | 0 | ○ | 0.65 | 0.10 |
| T92 | S02 | EH1 | 40.9 | 5.2 | 0 | 0 | 94.8 | 100 | 5.2 | 56.5 | 90 | 0 | X | 0.56 | 0.11 |
| T93 | S02 | E1 | 52.8 | 0.8 | 0 | 0 | 99.2 | 100 | 0.8 | 60.7 | 30 | 0 | ○ | 0.71 | 0.10 |
| T94 | S02 | FH1 | 45.2 | 4.5 | 0 | 0 | 95.5 | 100 | 4.5 | 60.1 | 72 | 0 | X | 0.58 | 0.10 |
| T95 | S02 | F1 | 55.0 | 0.5 | 0 | 0 | 99.5 | 100 | 0.5 | 61.8 | 24 | 0 | ○ | 0.72 | 0.10 |
| T96 | S02 | F2 | 55.3 | 0.3 | 0 | 0 | 99.7 | 100 | 0.3 | 61.1 | 22 | 0 | ○ | 0.73 | 0.10 |
| T97 | S02 | FH2 | 53.1 | 1.1 | 0 | 1.4 | 97.5 | 100 | 2.5 | 62.6 | 42 | 22 | ○ | 0.69 | 0.10 |

TABLE 39

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T80 | S02 | DH1 | 107 | ○ | — | 112 | 66 | — |
| T81 | S02 | D1 | 112 | ○ | — | 32 | 22 | — |
| T82 | S02 | D2 | 113 | ○ | — | 26 | 18 | — |
| T83 | S02 | D3 | 112 | ○ | — | 56 | 28 | — |
| T84 | S02 | DH2 | 111 | ○ | — | 72 | 50 | ○ |
| T85 | S02 | D4 | 112 | ○ | — | 72 | 42 | — |
| T86 | S02 | D5 | 113 | ○ | — | 58 | 30 | — |
| T87 | S02 | DH3 | 113 | ○ | — | 84 | 54 | — |
| T88 | S02 | DH4 | 112 | ○ | — | 78 | 52 | — |
| T89 | S02 | D7 | 112 | ○ | — | 38 | 26 | — |
| T90 | S02 | DH6 | 116 | ○ | — | 90 | 52 | — |
| T91 | S02 | DH7 | 114 | ○ | — | 84 | 58 | ○ |
| T92 | S02 | EH1 | 106 | ○ | ○ | 120 | 70 | ○ |
| T93 | S02 | E1 | 111 | ○ | — | 54 | 28 | — |
| T94 | S02 | FH1 | 109 | ○ | — | 108 | 64 | — |
| T95 | S02 | F1 | 111 | ○ | — | 34 | 18 | — |

TABLE 39-continued

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T96 | S02 | F2 | 113 | ○ | — | 26 | 18 | — |
| T97 | S02 | FH2 | 112 | ○ | — | 80 | 54 | — |

TABLE 40

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T80 | S02 | DH1 | 565 | 18.8 | 13.1 | 616 | 629 |
| T81 | S02 | D1 | 604 | 24.8 | 16.7 | 674 | 691 |
| T82 | S02 | D2 | 602 | 25.4 | 16.8 | 674 | 690 |
| T83 | S02 | D3 | 599 | 24.6 | 16.4 | 668 | 685 |
| T84 | S02 | DH2 | 584 | 21.6 | 14.8 | 645 | 659 |
| T85 | S02 | D4 | 601 | 21.2 | 15.5 | 662 | 677 |
| T86 | S02 | D5 | 594 | 23.6 | 15.9 | 661 | 677 |
| T87 | S02 | DH3 | 587 | 20.4 | 14.7 | 644 | 658 |
| T88 | S02 | DH4 | 583 | 20.2 | 13.5 | 639 | 652 |
| T89 | S02 | D7 | 600 | 24.0 | 16.6 | 668 | 685 |
| T90 | S02 | DH6 | 573 | 21.8 | 13.9 | 633 | 647 |
| T91 | S02 | DH7 | 592 | 18.8 | 13.1 | 645 | 658 |
| T92 | S02 | EH1 | 561 | 18.8 | 13.0 | 612 | 625 |
| T93 | S02 | E1 | 596 | 24.0 | 16.8 | 663 | 680 |
| T94 | S02 | FH1 | 567 | 19.4 | 12.9 | 619 | 632 |
| T95 | S02 | F1 | 602 | 25.0 | 17.0 | 673 | 690 |
| T96 | S02 | F2 | 596 | 25.4 | 17.4 | 668 | 685 |
| T97 | S02 | FH2 | 584 | 22.6 | 15.5 | 647 | 662 |

TABLE 41

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T80 | S02 | DH1 | 0.39 | 0.0051 | — | — |
| T81 | S02 | D1 | — | — | — | — |
| T82 | S02 | D2 | 0.10 | 0.0012 | 31 | 22 |
| T83 | S02 | D3 | — | — | — | — |
| T84 | S02 | DH2 | 0.25 | — | — | — |
| T85 | S02 | D4 | 0.17 | 0.0021 | 32 | 22 |
| T86 | S02 | D5 | — | — | — | — |
| T87 | S02 | DH3 | — | — | — | — |
| T88 | S02 | DH4 | — | — | 42 | 33 |
| T89 | S02 | D7 | — | — | — | — |
| T90 | S02 | DH6 | — | — | — | — |
| T91 | S02 | DH7 | — | — | — | — |
| T92 | S02 | EH1 | 0.43 | 0.0068 | 70 | 52 |
| T93 | S02 | E1 | 0.12 | 0.0022 | 31 | 25 |
| T94 | S02 | FH1 | 0.38 | 0.0060 | 66 | 47 |
| T95 | S02 | F1 | 0.10 | — | — | — |
| T96 | S02 | F2 | — | — | — | — |
| T97 | S02 | TH2 | 0.31 | — | 52 | 36 |

TABLE 42

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T101 | S03 | AH1 | 38.3 | 4.7 | 0 | 0 | 95.3 | 100 | 4.7 | 53.3 | 84 | 0 | X | 0.44 | 0.15 |
| T102 | S03 | AH2 | 38.4 | 4.4 | 0 | 0 | 95.6 | 100 | 4.4 | 52.9 | 84 | 0 | X | 0.45 | 0.15 |
| T103 | S03 | A1 | 47.7 | 0.5 | 0 | 0 | 99.5 | 100 | 0.5 | 54.5 | 23 | 0 | ○ | 0.58 | 0.15 |
| T104 | S03 | AH4 | 45.0 | 0.3 | 0 | 4.0 | 95.7 | 100 | 4.3 | 52.8 | 22 | 40 | ○ | 0.57 | 0.16 |
| T105 | S03 | A5 | 48.0 | 0.1 | 0 | 0 | 99.9 | 100 | 0.1 | 52.7 | 32 | 0 | ○ | 0.58 | 0.15 |
| T106 | S03 | A6 | 47.6 | 0.5 | 0 | 0 | 99.5 | 100 | 0.5 | 54.4 | 46 | 0 | ○ | 0.57 | 0.15 |
| T107 | S03 | AH5 | 47.3 | 1.4 | 0 | 0 | 98.6 | 100 | 1.4 | 56.8 | 50 | 0 | X | 0.54 | 0.15 |
| T108 | S03 | AH6 | 47.6 | 1.7 | 0 | 0 | 98.3 | 100 | 1.7 | 57.9 | 60 | 0 | X | 0.53 | 0.15 |
| T109 | S03 | AH7 | 46.9 | 1.2 | 0 | 0 | 98.8 | 100 | 1.2 | 56.0 | 48 | 0 | Δ | 0.54 | 0.15 |
| T110 | S03 | A7 | 47.0 | 0.9 | 0 | 0 | 99.1 | 100 | 0.9 | 55.1 | 36 | 0 | ○ | 0.56 | 0.15 |
| T111 | S03 | A8 | 47.8 | 0.5 | 0 | 0 | 99.5 | 100 | 0.5 | 54.6 | 32 | 0 | ○ | 0.57 | 0.15 |
| T112 | S03 | AH8 | 47.3 | 1.1 | 0 | 2.2 | 96.7 | 100 | 3.3 | 57.2 | 34 | 40 | ○ | 0.56 | 0.15 |
| T113 | S03 | A9 | 47.8 | 0.7 | 0 | 0 | 99.3 | 100 | 0.7 | 55.4 | 36 | 0 | ○ | 0.56 | 0.15 |
| T114 | S03 | A10 | 47.8 | 0.4 | 0 | 0 | 99.6 | 100 | 0.4 | 54.0 | 22 | 0 | ○ | 0.57 | 0.15 |
| T115 | S03 | A11 | 48.1 | 0.6 | 0 | 0 | 99.4 | 100 | 0.6 | 55.2 | 20 | 0 | ○ | 0.57 | 0.15 |
| T116 | S03 | A12 | 47.9 | 0.3 | 0 | 0 | 99.7 | 100 | 0.3 | 53.6 | 19 | 0 | ○ | 0.58 | 0.15 |
| T117 | S03 | B3 | 48.1 | 0.6 | 0 | 0 | 99.4 | 100 | 0.6 | 55.2 | 23 | 2 | ○ | 0.57 | 0.15 |
| T118 | S03 | BH3 | 45.7 | 0.3 | 0 | 2.5 | 97.2 | 100 | 2.8 | 52.6 | 22 | 40 | ○ | 0.59 | 0.15 |
| T119 | S03 | C0 | 38.6 | 4.5 | 0 | 0 | 95.5 | 100 | 4.5 | 53.3 | 92 | 0 | X | 0.45 | 0.15 |
| T120 | S03 | C1 | 47.1 | 0.6 | 0 | 0 | 99.4 | 100 | 0.6 | 54.3 | 32 | 0 | ○ | 0.57 | 0.15 |

TABLE 43

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T101 | S03 | AH1 | 108 | ○ | ○ | 120 | 70 | — |
| T102 | S03 | AH2 | 110 | ○ | — | 120 | 70 | — |
| T103 | S03 | A1 | 111 | ○ | ○ | 34 | 20 | ○ |
| T104 | S03 | AH4 | 112 | ○ | — | 102 | 68 | — |
| T105 | S03 | A5 | 113 | ○ | — | 50 | 30 | — |
| T106 | S03 | A6 | 113 | ○ | — | 70 | 48 | — |
| T107 | S03 | AH5 | 116 | ○ | — | 84 | 52 | — |
| T108 | S03 | AH6 | 116 | ○ | — | 89 | 62 | — |
| T109 | S03 | AH7 | 115 | ○ | — | 78 | 48 | — |
| T110 | S03 | A7 | 111 | ○ | — | 60 | 38 | — |
| T111 | S03 | A8 | 112 | ○ | — | 48 | 32 | — |
| T112 | S03 | AH8 | 111 | ○ | — | 86 | 54 | — |
| T113 | S03 | A9 | 113 | ○ | — | 58 | 36 | — |
| T114 | S03 | A10 | 114 | ○ | — | 32 | 22 | — |
| T115 | S03 | A11 | 115 | ○ | — | 32 | 20 | — |
| T116 | S03 | A12 | 112 | ○ | — | 36 | 24 | ○ |
| T117 | S03 | B3 | 114 | ○ | — | 40 | 24 | — |
| T118 | S03 | BH3 | 115 | ○ | — | 88 | 50 | ○ |
| T119 | S03 | C0 | 107 | ○ | — | 128 | 74 | — |
| T120 | S03 | C1 | 111 | ○ | — | 50 | 32 | — |

TABLE 44

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T101 | S03 | AH1 | 567 | 20.0 | 15.3 | 621 | 637 |
| T102 | S03 | AH2 | 603 | 15.2 | 13.8 | 647 | 661 |
| T103 | S03 | A1 | 628 | 24.8 | 18.2 | 702 | 720 |
| T104 | S03 | AH4 | 584 | 17.8 | 13.5 | 634 | 648 |
| T105 | S03 | A5 | 616 | 25.4 | 18.6 | 689 | 708 |
| T106 | S03 | A6 | 619 | 22.4 | 17.8 | 684 | 702 |
| T107 | S03 | AH5 | 582 | 22.8 | 18.0 | 645 | 663 |
| T108 | S03 | AH6 | 614 | 18.4 | 14.6 | 668 | 683 |
| T109 | S03 | AH7 | 592 | 21.6 | 17.0 | 652 | 669 |
| T110 | S03 | A7 | 602 | 23.4 | 17.6 | 669 | 687 |
| T111 | S03 | A8 | 616 | 24.4 | 18.2 | 687 | 705 |

TABLE 44-continued

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T112 | S03 | AH8 | 596 | 21.2 | 14.2 | 656 | 671 |
| T113 | S03 | A9 | 627 | 24.2 | 17.7 | 699 | 716 |
| T114 | S03 | A10 | 637 | 21.6 | 16.9 | 703 | 719 |
| T115 | S03 | A11 | 692 | 16.4 | 14.0 | 746 | 760 |
| T116 | S03 | A12 | 635 | 23.4 | 17.3 | 706 | 723 |
| T117 | S03 | B3 | 643 | 21.6 | 16.2 | 709 | 725 |
| T118 | S03 | BH3 | 601 | 15.6 | 12.5 | 646 | 658 |
| T119 | S03 | C0 | 560 | 21.0 | 16.1 | 616 | 632 |
| T120 | S03 | C1 | 593 | 27.4 | 20.3 | 669 | 690 |

TABLE 45

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T101 | S03 | AH1 | 0.40 | 0.0060 | 94 | 67 |
| T102 | S03 | AH2 | — | — | — | — |
| T103 | S03 | A1 | 0.11 | 0.0029 | 53 | 35 |
| T104 | S03 | AH4 | 0.41 | 0.0034 | 78 | 69 |
| T105 | S03 | A5 | 0.08 | 0.0022 | 55 | 33 |
| T106 | S03 | A6 | — | — | — | — |
| T107 | S03 | AH5 | — | — | — | — |
| T108 | S03 | AH6 | 0.25 | 0.0052 | 76 | 47 |
| T109 | S03 | AH7 | — | — | — | — |
| T110 | S03 | A7 | 0.21 | 0.0030 | 59 | 39 |
| T111 | S03 | A8 | 0.11 | — | 56 | 34 |
| T112 | S03 | AH8 | — | — | 77 | 64 |
| T113 | S03 | A9 | 0.13 | 0.0028 | 61 | 42 |
| T114 | S03 | A10 | 0.10 | 0.0021 | 57 | 35 |
| T115 | S03 | A11 | — | — | — | — |
| T116 | S03 | A12 | — | — | — | — |
| T117 | S03 | B3 | — | — | — | — |
| T118 | S03 | BH3 | 0.35 | 0.0053 | 80 | 68 |
| T119 | S03 | C0 | 0.39 | 0.0061 | 98 | 69 |
| T120 | S03 | C1 | 0.12 | 0.0020 | 59 | 39 |

TABLE 46

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T121 | 303 | DH1 | 39.7 | 3.8 | 0 | 0 | 96.2 | 100 | 3.8 | 53.4 | 69 | 0 | X | 0.47 | 0.15 |
| T122 | S03 | D1 | 48.3 | 0.1 | 0 | 0 | 99.9 | 100 | 0.1 | 53.0 | 16 | 0 | ○ | 0.58 | 0.15 |
| T123 | 303 | D6 | 47.7 | 0.9 | 0 | 0 | 99.1 | 100 | 0.9 | 56.0 | 40 | 0 | ○ | 0.55 | 0.15 |
| T124 | S03 | DH5 | 45.7 | 1.9 | 0 | 0 | 98.1 | 100 | 1.9 | 56.4 | 64 | 0 | Δ | 0.52 | 0.15 |
| T125 | S03 | D7 | 48.2 | 0.3 | 0 | 0 | 99.7 | 100 | 0.3 | 54.2 | 26 | 0 | ○ | 0.58 | 0.15 |
| T126 | S03 | DH6 | 46.1 | 1.9 | 0 | 0 | 98.1 | 100 | 1.9 | 56.8 | 54 | 0 | X | 0.52 | 0.15 |
| T127 | 303 | DH7 | 46.8 | 1.6 | 0 | 0 | 98.4 | 100 | 1.6 | 56.8 | 62 | 0 | Δ | 0.53 | 0.15 |
| T128 | S03 | EH1 | 38.3 | 4.7 | 0 | 0 | 95.3 | 100 | 4.7 | 53.3 | 90 | 0 | X | 0.44 | 0.15 |
| T129 | S03 | E1 | 46.4 | 0.5 | 0 | 0 | 99.5 | 100 | 0.5 | 53.2 | 24 | 0 | ○ | 0.57 | 0.15 |
| T130 | 303 | FH1 | 41.6 | 3.9 | 0 | 0 | 96.1 | 100 | 3.9 | 55.6 | 78 | 0 | X | 0.47 | 0.15 |
| T131 | S03 | F1 | 49.2 | 0.2 | 0 | 0 | 99.8 | 100 | 0.2 | 54.6 | 20 | 0 | ○ | 0.58 | 0.15 |
| T132 | S03 | F2 | 49.6 | 0.1 | 0 | 0 | 99.9 | 100 | 0.1 | 54.4 | 32 | 0 | ○ | 0.58 | 0.15 |
| T133 | 303 | FH2 | 47.1 | 0.6 | 0 | 1.8 | 97.6 | 100 | 2.4 | 55.1 | 36 | 24 | ○ | 0.56 | 0.15 |
| T134 | S03 | F3 | 49.2 | 0.2 | 0 | 0 | 99.8 | 100 | 0.2 | 54.6 | 19 | 0 | ○ | 0.58 | 0.15 |
| T135 | S03 | F4 | 47.9 | 0.3 | 0 | 0 | 99.7 | 100 | 0.3 | 53.9 | 24 | 0 | ○ | 0.58 | 0.15 |
| T136 | 303 | F5 | 47.2 | 0.5 | 0 | 0 | 99.5 | 100 | 0.5 | 54.0 | 29 | 0 | ○ | 0.57 | 0.15 |
| T137 | S03 | PH1 | 41.6 | 4.6 | 0 | 0 | 95.4 | 100 | 4.6 | 56.5 | 78 | 0 | X | 0.45 | 0.15 |
| T138 | 303 | P1 | 49.3 | 0.2 | 0 | 0 | 99.8 | 100 | 0.2 | 54.7 | 17 | 0 | ○ | 0.58 | 0.15 |
| T139 | 303 | P2 | 49.3 | 0.1 | 0 | 0 | 99.9 | 100 | 0.1 | 54.1 | 20 | 0 | ○ | 0.58 | 0.15 |
| T140 | S03 | P3 | 47.2 | 0.4 | 0 | 0 | 99.6 | 100 | 0.4 | 53.6 | 27 | 0 | ○ | 0.57 | 0.15 |

TABLE 47

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T121 | S03 | DH1 | 108 | ○ | — | 114 | 68 | — |
| T122 | S03 | D1 | 112 | ○ | — | 28 | 18 | — |
| T123 | S03 | D6 | 110 | ○ | — | 68 | 44 | — |
| T124 | S03 | DH5 | 113 | ○ | — | 102 | 66 | — |
| T125 | S03 | D7 | 111 | ○ | — | 42 | 26 | — |
| T126 | S03 | DH6 | 114 | ○ | — | 88 | 52 | — |
| T127 | S03 | DH7 | 113 | ○ | — | 82 | 54 | — |
| T128 | S03 | EH1 | 107 | ○ | ○ | 122 | 72 | ○ |
| T129 | S03 | E1 | 111 | ○ | — | 40 | 26 | — |
| T130 | S03 | FH1 | 109 | ○ | — | 112 | 68 | ○ |
| T131 | S03 | F1 | 110 | ○ | — | 32 | 20 | ○ |
| T132 | S03 | F2 | 111 | ○ | — | 52 | 32 | — |
| T133 | S03 | FH2 | 111 | ○ | — | 90 | 60 | — |
| T134 | S03 | F3 | 111 | ○ | — | 46 | 28 | — |
| T135 | S03 | F4 | 110 | ○ | — | 82 | 52 | — |
| T136 | S03 | F5 | 111 | ○ | — | 52 | 34 | — |
| T137 | S03 | PH1 | 107 | ○ | ○ | 116 | 64 | ○ |
| T138 | S03 | P1 | 111 | ○ | — | 32 | 20 | ○ |
| T139 | S03 | P2 | 112 | ○ | — | 52 | 34 | — |
| T140 | S03 | P3 | 111 | ○ | — | 52 | 34 | ○ |

TABLE 48

| Test No. | Alloy No. | Step No. | Tensile Strength ($N/mm^2$) | Elongation (%) | Impact value ($J/cm^2$) | Strength Balance Index f8 | Strength Balance Index f9 |
|---|---|---|---|---|---|---|---|
| T121 | S03 | DH1 | 568 | 21.8 | 15.2 | 627 | 642 |
| T122 | S03 | D1 | 600 | 30.2 | 20.5 | 684 | 705 |
| T123 | S03 | D6 | 591 | 26.2 | 18.5 | 664 | 682 |
| T124 | S03 | DH5 | 577 | 25.6 | 16.5 | 647 | 664 |
| T125 | S03 | D7 | 589 | 28.0 | 20.0 | 667 | 687 |
| T126 | S03 | DH6 | 572 | 24.2 | 16.8 | 637 | 654 |
| T127 | S03 | DH7 | 582 | 23.0 | 15.3 | 646 | 661 |
| T128 | S03 | EH1 | 556 | 21.6 | 15.7 | 613 | 628 |
| T129 | S03 | E1 | 590 | 27.6 | 20.8 | 666 | 687 |
| T130 | S03 | FH1 | 562 | 22.4 | 15.1 | 621 | 637 |
| T131 | S03 | F1 | 602 | 29.8 | 20.5 | 686 | 706 |

TABLE 48-continued

| Test No. | Alloy No. | Step No. | Tensile Strength ($N/mm^2$) | Elongation (%) | Impact value ($J/cm^2$) | Strength Balance Index f8 | Strength Balance Index f9 |
|---|---|---|---|---|---|---|---|
| T132 | S03 | F2 | 591 | 30.6 | 20.8 | 675 | 696 |
| T133 | S03 | FH2 | 582 | 28.0 | 17.5 | 658 | 676 |
| T134 | S03 | F3 | 596 | 29.2 | 20.7 | 677 | 698 |
| T135 | S03 | F4 | 595 | 28.8 | 20.9 | 676 | 696 |
| T136 | S03 | F5 | 588 | 28.0 | 20.6 | 665 | 686 |
| T137 | S03 | PH1 | 574 | 10.6 | 16.2 | 604 | 620 |
| T138 | S03 | P1 | 596 | 29.1 | 20.6 | 677 | 698 |
| T139 | S03 | P2 | 597 | 29.5 | 20.9 | 679 | 700 |
| T140 | S03 | P3 | 595 | 28.2 | 20.8 | 673 | 694 |

TABLE 49

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T121 | S03 | DH1 | — | — | — | — |
| T122 | S03 | D1 | 0.08 | 0.0022 | 54 | 33 |
| T123 | S03 | D6 | — | — | — | — |
| T124 | S03 | DH5 | 0.25 | 0.0048 | 79 | 64 |
| T125 | S03 | D7 | — | 0.0031 | 57 | 34 |
| T126 | S03 | DH6 | — | — | — | — |
| T127 | S03 | DH7 | — | — | — | — |
| T128 | S03 | EH1 | 0.40 | | 98 | 66 |
| T129 | S03 | E1 | 0.11 | 0.0020 | 56 | 35 |
| T130 | S03 | FH1 | 0.34 | 0.0054 | 94 | 67 |
| T131 | S03 | F1 | 0.09 | 0.0020 | 55 | 37 |
| T132 | S03 | F2 | — | 0.0023 | 52 | 32 |
| T133 | S03 | FH2 | 0.29 | — | 72 | 63 |
| T134 | S03 | F3 | 0.09 | — | — | — |
| T135 | S03 | F4 | — | — | — | — |
| T136 | S03 | F5 | 0.12 | 0.0032 | 61 | 40 |
| T137 | S03 | PH1 | 0.39 | 0.0067 | 100 | 67 |
| T138 | S03 | P1 | 0.09 | 0.0024 | 62 | 41 |
| T139 | S03 | P2 | — | — | — | — |
| T140 | S03 | P3 | 0.11 | 0.0032 | 64 | 40 |

TABLE 50

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (gm) | Length of Long side of μ Phase (gm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T151 | S11 | EH1 | 31.0 | 5.4 | 0 | 0 | 94.6 | 100 | 5.4 | 46.6 | 92 | 0 | X | 0.40 | 0.13 |
| T152 | S11 | E1 | 38.1 | 0.9 | 0 | 0 | 99.1 | 100 | 0.9 | 45.6 | 44 | 0 | ○ | 0.52 | 0.13 |
| T153 | S12 | EH1 | 28.1 | 5.2 | 0 | 0 | 94.8 | 100 | 5.2 | 43.2 | 86 | 0 | X | 0.41 | 0.13 |
| T154 | S12 | E1 | 34.3 | 0.9 | 0 | 0 | 99.1 | 100 | 0.9 | 41.6 | 40 | 0 | Δ | 0.52 | 0.13 |
| T161 | S13 | EH1 | 40.8 | 5.2 | 0 | 0 | 94.8 | 100 | 5.2 | 56.6 | 94 | 0 | X | 0.56 | 0.11 |
| T162 | S13 | E1 | 52.8 | 0.8 | 0 | 0 | 99.2 | 100 | 0.8 | 60.7 | 34 | 0 | ○ | 0.71 | 0.10 |
| T163 | S14 | EH1 | 40.4 | 5.0 | 0 | 0 | 95.0 | 100 | 5.0 | 55.8 | 88 | 0 | X | 0.56 | 0.11 |
| T164 | S14 | E1 | 52.2 | 0.7 | 0 | 0 | 99.3 | 100 | 0.7 | 60.0 | 28 | 0 | ○ | 0.70 | 0.10 |

TABLE 51

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T151 | S11 | EH1 | 111 | ○ | — | — | — | — |
| T152 | S11 | E1 | 116 | ○ | — | 56 | 38 | — |
| T153 | S12 | EH1 | 114 | ○ | ○ | — | — | Δ |
| T154 | S12 | E1 | 122 | ○ | — | 64 | 44 | ○ |
| T161 | S13 | EH1 | 106 | ○ | — | — | — | — |
| T162 | S13 | E1 | 110 | ○ | — | — | — | — |
| T163 | S14 | EH1 | 105 | ○ | ○ | — | — | — |
| T164 | S14 | E1 | 109 | ○ | — | 58 | 26 | ○ |

TABLE 52

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T151 | S11 | EH1 | 534 | 22.4 | 15.9 | 591 | 607 |
| T152 | S11 | E1 | 575 | 29.2 | 22.8 | 654 | 676 |
| T153 | S12 | EH1 | 527 | 21.2 | 15.2 | 580 | 595 |
| T154 | S12 | E1 | 562 | 28.4 | 21.5 | 637 | 658 |
| T161 | S13 | EH1 | 558 | 17.6 | 13.1 | 605 | 618 |

TABLE 52-continued

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T162 | S13 | E1 | 587 | 22.2 | 15.6 | 648 | 664 |
| T163 | S14 | EH1 | 553 | 17.2 | 12.6 | 599 | 611 |
| T164 | S14 | E1 | 571 | 20.2 | 14.4 | 626 | 641 |

TABLE 53

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T151 | S11 | EH1 | — | — | — | — |
| T152 | S11 | E1 | 0.15 | 0.0033 | 64 | 46 |
| T153 | S12 | EH1 | — | — | 113 | 78 |
| T154 | S12 | E1 | 0.14 | 0.0038 | 72 | 50 |
| T161 | S13 | EH1 | 0.50 | — | — | — |
| T162 | S13 | E1 | 0.15 | 0.0030 | — | — |
| T163 | S14 | EH1 | 0.51 | — | — | — |
| T164 | S14 | E1 | 0.22 | 0.0039 | 42 | 36 |

TABLE 54

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T201 | S21 | EH1 | 43.8 | 5.5 | 0 | 0 | 94.5 | 100 | 5.5 | 60.0 | 110 | 0 | X | 0.62 | 0.13 |
| T202 | S21 | E1 | 56.8 | 1.0 | 0 | 0 | 99.0 | 100 | 1.0 | 65.6 | 38 | 0 | ○ | 0.78 | 0.13 |
| T203 | S21 | FH1 | 43.8 | 5.3 | 0 | 0 | 94.7 | 100 | 5.3 | 59.8 | 100 | 0 | X | 0.63 | 0.13 |
| T204 | S21 | F1 | 57.8 | 0.7 | 0 | 0 | 99.3 | 100 | 0.7 | 65.7 | 28 | 0 | ○ | 0.80 | 0.13 |
| T205 | S21 | F2 | 58.2 | 0.5 | 0 | 0 | 99.5 | 100 | 0.5 | 65.3 | 22 | 0 | ○ | 0.81 | 0.13 |
| T206 | S21 | FH2 | 56.3 | 1.2 | 0 | 1.5 | 97.3 | 100 | 2.7 | 66.5 | 46 | 22 | ○ | 0.78 | 0.13 |
| T207 | S22 | EH1 | 34.2 | 5.5 | 0 | 0 | 94.5 | 100 | 5.5 | 50.0 | 114 | 0 | X | 0.42 | 0.12 |
| T208 | S22 | E1 | 44.1 | 1.2 | 0 | 0 | 98.8 | 100 | 1.2 | 52.9 | 40 | 0 | ○ | 0.53 | 0.12 |
| T209 | S22 | F1 | 45.2 | 0.9 | 0 | 0 | 99.1 | 100 | 0.9 | 53.2 | 28 | 0 | ○ | 0.54 | 0.12 |
| T210 | S23 | FH1 | 47.6 | 4.7 | 0 | 0 | 95.3 | 100 | 4.7 | 63.0 | 90 | 0 | X | 0.67 | 0.14 |
| T211 | S23 | F1 | 61.4 | 0.4 | 0 | 0 | 99.6 | 100 | 0.4 | 68.3 | 22 | 0 | ○ | 0.85 | 0.14 |
| T212 | S24 | FH1 | 27.6 | 5.2 | 0 | 0 | 94.8 | 100 | 5.2 | 42.7 | 100 | 0 | X | 0.37 | 0.10 |
| T213 | S24 | F1 | 34.8 | 1.1 | 0 | 0 | 98.9 | 100 | 1.1 | 42.8 | 38 | 0 | ○ | 0.46 | 0.10 |
| T214 | S24 | F2 | 33.7 | 0.7 | 0 | 0 | 99.3 | 100 | 0.7 | 40.4 | 26 | 0 | Δ | 0.47 | 0.10 |
| T215 | S25 | E1 | 30.9 | 0.6 | 0 | 0 | 99.4 | 100 | 0.6 | 37.1 | 42 | 0 | Δ | 0.47 | 0.12 |
| T216 | S26 | E1 | 52.6 | 0.0 | 0 | 0 | 100 | 100 | 0 | 55.3 | 0 | 0 | ○ | 0.47 | 0.14 |
| T218 | S27 | E1 | 47.6 | 1.2 | 0 | 0 | 98.8 | 100 | 1.2 | 56.6 | 44 | 0 | ○ | 0.46 | 0.17 |
| T219 | S28 | E1 | 57.6 | 0.7 | 0 | 0 | 99.3 | 100 | 0.7 | 65.5 | 40 | 0 | ○ | 0.54 | 0.07 |
| T220 | S29 | P2 | 44.8 | 0.7 | 0 | 0 | 99.3 | 100 | 0.7 | 52.1 | 36 | 0 | ○ | 0.57 | 0.12 |
| T221 | S29 | P3 | 45.4 | 0.9 | 0 | 0 | 99.1 | 100 | 0.9 | 53.3 | 44 | 0 | ○ | 0.56 | 0.12 |

TABLE 55

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T201 | S21 | EH1 | 109 | ○ | ○ | 124 | 78 | — |
| T202 | S21 | E1 | 115 | ○ | — | 54 | 36 | — |
| T203 | S21 | FH1 | 110 | ○ | — | 120 | 70 | — |
| T204 | S21 | F1 | 116 | ○ | — | 44 | 30 | ○ |
| T205 | S21 | F2 | 115 | ○ | — | 40 | 26 | — |
| T206 | S21 | FH2 | 115 | ○ | — | 94 | 62 | — |
| T207 | S22 | EH1 | 108 | ○ | ○ | 124 | 72 | — |
| T208 | S22 | E1 | 112 | ○ | — | 64 | 40 | — |
| T209 | S22 | F1 | 111 | ○ | — | 46 | 32 | ○ |
| T210 | S23 | FH1 | 116 | ○ | ○ | 116 | 74 | ○ |
| T211 | S23 | F1 | 124 | ○ | — | 40 | 24 | — |
| T212 | S24 | FH1 | 114 | ○ | ○ | 118 | 74 | ○ |
| T213 | S24 | F1 | 121 | ○ | — | 72 | 42 | — |
| T214 | S24 | F2 | 121 | ○ | — | 58 | 36 | — |
| T215 | S25 | E1 | 125 | ○ | — | 48 | 32 | — |
| T216 | S26 | E1 | 120 | ○ | — | 28 | 22 | — |
| T218 | S27 | E1 | 112 | ○ | ○ | 74 | 42 | — |
| T219 | S28 | E1 | 119 | ○ | ○ | 76 | 48 | — |
| T220 | S29 | P2 | 111 | ○ | — | 60 | 36 | ○ |
| T221 | S29 | P3 | 110 | ○ | — | 64 | 44 | ○ |

TABLE 56

| Test No. | Alloy No. | Step No. | Tensile Strength ($N/mm^2$) | Elongation (%) | Impact value ($J/cm^2$) | Strength Balance Index f8 | Strength Balance Index f9 |
|---|---|---|---|---|---|---|---|
| T201 | S21 | EH1 | 555 | 15.8 | 12.1 | 597 | 609 |
| T202 | S21 | E1 | 605 | 21.0 | 14.6 | 666 | 680 |
| T203 | S21 | FH1 | 557 | 15.4 | 12.5 | 598 | 610 |
| T204 | S21 | F1 | 612 | 21.2 | 14.8 | 673 | 688 |
| T205 | S21 | F2 | 605 | 22.4 | 15.1 | 670 | 685 |
| T206 | S21 | FH2 | 585 | 19.8 | 13.9 | 640 | 654 |
| T207 | S22 | EH1 | 545 | 21.8 | 15.4 | 602 | 617 |
| T208 | S22 | E1 | 587 | 26.6 | 19.6 | 661 | 680 |
| T209 | S22 | F1 | 593 | 28.2 | 20.8 | 671 | 692 |
| T210 | S23 | FH1 | 559 | 14.4 | 10.6 | 598 | 608 |
| T211 | S23 | F1 | 608 | 18.4 | 13.3 | 662 | 675 |

TABLE 56-continued

| Test No. | Alloy No. | Step No. | Tensile Strength ($N/mm^2$) | Elongation (%) | Impact value ($J/cm^2$) | Strength Balance Index f8 | Strength Balance Index f9 |
|---|---|---|---|---|---|---|---|
| T212 | S24 | FH1 | 535 | 23.8 | 20.3 | 595 | 615 |
| T213 | S24 | F1 | 573 | 32.6 | 28.3 | 660 | 688 |
| T214 | S24 | F2 | 562 | 36.0 | 32.2 | 655 | 687 |
| T215 | S25 | E1 | 554 | 39.6 | 32.1 | 654 | 686 |
| T216 | S26 | E1 | 603 | 28.2 | 19.0 | 683 | 702 |
| T218 | S27 | E1 | 596 | 23.4 | 14.8 | 662 | 677 |
| T219 | S28 | E1 | 594 | 25.7 | 17.5 | 666 | 683 |
| T220 | S29 | P2 | — | — | — | — | — |
| T221 | S29 | P3 | — | — | — | — | — |

TABLE 57

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T201 | S21 | EH1 | — | — | — | — |
| T202 | S21 | E1 | 0.17 | 0.0014 | 28 | 21 |
| T203 | S21 | FH1 | 0.45 | 0.0043 | 53 | 42 |
| T204 | S21 | F1 | 0.14 | 0.0011 | 28 | 25 |
| T205 | S21 | F2 | 0.12 | — | — | — |
| T206 | S21 | FH2 | 0.37 | — | — | — |
| T207 | S22 | EH1 | 0.46 | — | — | — |
| T208 | S22 | E1 | — | — | — | — |
| T209 | S22 | F1 | 0.15 | 0.0020 | 58 | 40 |
| T210 | S23 | FH1 | 0.40 | — | — | — |
| T211 | S23 | F1 | 0.12 | 0.0010 | 27 | 22 |
| T212 | S24 | FH1 | 0.44 | 0.0082 | 118 | 86 |
| T213 | S24 | F1 | — | — | 74 | 55 |
| T214 | S24 | F2 | 0.15 | — | — | — |
| T215 | S25 | E1 | 0.13 | 0.0049 | 73 | 55 |
| T216 | S26 | E1 | 0.10 | 0.0031 | 73 | 53 |
| T218 | S27 | E1 | 0.21 | 0.0048 | 76 | 57 |
| T219 | S28 | E1 | 0.16 | 0.0027 | 62 | 42 |
| T220 | S29 | P2 | 0.12 | 0.0022 | 54 | 37 |
| T221 | S29 | P3 | — | — | 57 | 39 |

TABLE 58

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T222 | S30 | E1 | 40.5 | 0.7 | 0 | 0 | 99.3 | 100 | 0.7 | 47.5 | 32 | 0 | ○ | 0.50 | 0.20 |
| T223 | S31 | PH1 | 42.6 | 5.7 | 0 | 0 | 94.3 | 100 | 5.7 | 59.0 | 118 | 0 | X | 0.63 | 0.14 |
| T224 | S31 | P1 | 56.1 | 1.1 | 0 | 0 | 98.9 | 100 | 1.1 | 65.2 | 40 | 0 | ○ | 0.79 | 0.14 |
| T225 | S31 | F4 | 56.9 | 0.7 | 0 | 0 | 99.3 | 100 | 0.7 | 64.8 | 30 | 0 | ○ | 0.83 | 0.14 |
| T226 | S32 | EH1 | 38.6 | 5.2 | 0 | 0 | 94.8 | 100 | 5.2 | 54.2 | 106 | 0 | X | 0.50 | 0.12 |
| T227 | S32 | E1 | 49.9 | 0.6 | 0 | 0 | 99.4 | 100 | 0.6 | 57.0 | 36 | 0 | ○ | 0.64 | 0.12 |
| T228 | S33 | FH1 | 44.7 | 6.3 | 0.5 | 0 | 93.2 | 99.5 | 6.3 | 62.0 | 110 | 0 | X | 0.37 | 0.13 |
| T229 | S33 | F1 | 56.1 | 0.5 | 0 | 0 | 99.5 | 100 | 0.5 | 63.1 | 28 | 0 | ○ | 0.51 | 0.13 |
| T230 | S34 | E1 | 40.9 | 1.7 | 0 | 0 | 98.3 | 100 | 1.7 | 50.8 | 46 | 0 | ○ | 0.52 | 0.15 |
| T231 | S35 | EH1 | 42.5 | 2.8 | 0 | 0 | 97.2 | 100 | 2.8 | 54.7 | 86 | 0 | X | 0.45 | 0.16 |
| T232 | S35 | E1 | 53.6 | 0.2 | 0 | 0 | 99.8 | 100 | 0.2 | 58.9 | 20 | 0 | ○ | 0.52 | 0.16 |
| T251 | S41 | EH1 | 35.7 | 4.8 | 0 | 0 | 95.2 | 100 | 4.8 | 50.6 | 110 | 0 | X | 0.49 | 0.10 |
| T252 | S41 | E1 | 46.7 | 0.8 | 0 | 0 | 99.2 | 100 | 0.8 | 54.4 | 38 | 0 | ○ | 0.60 | 0.09 |
| T253 | S41 | FH1 | 36.5 | 4.6 | 0 | 0 | 95.4 | 100 | 4.6 | 51.2 | 94 | 0 | X | 0.49 | 0.10 |
| T254 | S41 | F2 | 46.8 | 0.4 | 0 | 0 | 99.6 | 100 | 0.4 | 52.9 | 20 | 0 | ○ | 0.62 | 0.09 |
| T255 | S42 | EH1 | 45.2 | 5.3 | 0 | 0 | 94.7 | 100 | 5.3 | 61.3 | 80 | 0 | X | 0.42 | 0.13 |
| T256 | S42 | E1 | 52.4 | 0.8 | 0 | 0 | 99.2 | 100 | 0.8 | 60.3 | 34 | 0 | ○ | 0.53 | 0.13 |
| T257 | S42 | F1 | 53.0 | 0.7 | 0 | 0 | 99.3 | 100 | 0.7 | 60.7 | 26 | 0 | ○ | 0.53 | 0.13 |
| T258 | S43 | E1 | 45.3 | 0.8 | 0 | 0 | 99.2 | 100 | 0.8 | 53.0 | 38 | 0 | ○ | 0.63 | 0.10 |

TABLE 59

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T222 | S30 | E1 | 113 | ○ | — | 52 | 30 | — |
| T223 | S31 | PH1 | 110 | ○ | — | 128 | 74 | — |
| T224 | S31 | P1 | 114 | ○ | — | 56 | 32 | ○ |
| T225 | S31 | F4 | 116 | ○ | — | 44 | 28 | ○ |
| T226 | S32 | EH1 | 109 | ○ | ○ | 130 | 74 | — |
| T227 | S32 | E1 | 111 | ○ | — | 40 | 24 | — |
| T228 | S33 | FH1 | 107 | ○ | ○ | 130 | 80 | — |
| T229 | S33 | F1 | 112 | ○ | — | 76 | 46 | — |
| T230 | S34 | E1 | 112 | ○ | ○ | 78 | 46 | — |
| T231 | S35 | EH1 | 114 | ○ | ○ | 98 | 72 | — |
| T232 | S35 | E1 | 118 | ○ | — | 38 | 26 | — |
| T251 | S41 | EH1 | 109 | ○ | ○ | 116 | 72 | — |
| T252 | S41 | E1 | 111 | ○ | — | 36 | 28 | ○ |
| T253 | S41 | FH1 | 110 | ○ | — | 110 | 68 | — |
| T254 | S41 | F2 | 112 | ○ | — | 28 | 14 | — |
| T255 | S42 | EH1 | 107 | ○ | ○ | 120 | 74 | — |
| T256 | S42 | E1 | 111 | ○ | — | 40 | 26 | — |
| T257 | S42 | F1 | 110 | ○ | — | 36 | 22 | — |
| T258 | S43 | E1 | 112 | ○ | — | 38 | 24 | — |

TABLE 60

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T222 | S30 | E1 | — | — | 19.5 | — | — |
| T223 | S31 | PH1 | — | — | — | — | — |
| T224 | S31 | P1 | — | — | — | — | — |
| T225 | S31 | F4 | 608 | 21.4 | 14.8 | 669 | 684 |
| T226 | S32 | EH1 | 546 | 20.8 | 13.6 | 600 | 613 |
| T227 | S32 | E1 | 598 | 25.6 | 17.2 | 670 | 687 |
| T228 | S33 | FH1 | 559 | 16.2 | 11.2 | 603 | 614 |
| T229 | S33 | F1 | 602 | 22.8 | 16.2 | 668 | 684 |
| T230 | S34 | E1 | 583 | 27.0 | 20.8 | 657 | 677 |
| T231 | S35 | EH1 | 547 | 21.0 | 14.9 | 602 | 617 |
| T232 | S35 | E1 | 590 | 26.2 | 18.9 | 663 | 682 |

TABLE 60-continued

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T251 | S41 | EH1 | 556 | 22.4 | 15.4 | 615 | 630 |
| T252 | S41 | E1 | 588 | 27.2 | 20.3 | 664 | 684 |
| T253 | S41 | FH1 | 560 | 22.0 | 15.7 | 619 | 635 |
| T254 | S41 | F2 | 594 | 28.4 | 21.6 | 673 | 694 |
| T255 | S42 | EH1 | 555 | 21.2 | 13.8 | 611 | 625 |
| T256 | S42 | E1 | 599 | 24.8 | 17.8 | 669 | 687 |
| T257 | S42 | F1 | 605 | 25.8 | 18.0 | 679 | 697 |
| T258 | S43 | E1 | 587 | 28.6 | 21.0 | 665 | 686 |

TABLE 61

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T222 | S30 | E1 | 0.19 | 0.0021 | 66 | 46 |
| T223 | S31 | PH1 | — | 0.0040 | 57 | 46 |
| T224 | S31 | P1 | 0.13 | 0.0011 | — | — |
| T225 | S31 | F4 | 0.14 | 0.0010 | 27 | 23 |
| T226 | S32 | EH1 | 0.44 | — | 79 | 57 |
| T227 | S32 | E1 | 0.12 | 0.0021 | 42 | 30 |
| T228 | S33 | FH1 | 0.62 | 0.0052 | 115 | 85 |
| T229 | S33 | F1 | 0.17 | 0.0023 | 67 | 46 |
| T230 | S34 | E1 | 0.27 | 0.0038 | 66 | 44 |
| T231 | S35 | EH1 | — | — | 93 | 66 |
| T232 | S35 | E1 | 0.08 | 0.0024 | 65 | 44 |
| T251 | S41 | EH1 | — | — | 85 | 63 |
| T252 | S41 | E1 | — | 0.0020 | 48 | 33 |
| T253 | S41 | FH1 | 0.39 | 0.0051 | 82 | 62 |
| T254 | S41 | F2 | 0.11 | — | 44 | 31 |
| T255 | S42 | EH1 | 0.47 | 0.0053 | 103 | 72 |
| T256 | S42 | E1 | — | 0.0022 | 61 | 40 |
| T257 | S42 | F1 | 0.16 | — | 58 | 37 |
| T258 | S43 | E1 | 0.13 | 0.0019 | 45 | 30 |

TABLE 62

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|---|
| T301 | S51 | EH1 | 26.4 | 8.2 | 0 | 0 | 91.8 | 100 | 8.2 | 44.9 | 150 | 0 | X | 0.46 | 0.14 |
| T302 | S51 | E1 | 34.7 | 2.4 | 0 | 0 | 97.6 | 100 | 2.4 | 45.7 | 66 | 0 | Δ | 0.62 | 0.14 |
| T303 | S52 | E1 | 28.3 | 9.5 | 1.8 | 0 | 88.7 | 98.2 | 9.5 | 48.2 | 150 | 0 | Δ | 0.38 | 0.11 |
| T304 | S53 | E1 | 12.7 | 3.4 | 0 | 0 | 96.6 | 100 | 3.4 | 24.4 | 70 | 0 | X | 0.51 | 0.12 |
| T305 | S54 | E1 | 32.3 | 0.2 | 0 | 0 | 99.8 | 100 | 0.2 | 35.0 | 40 | 0 | X | 0.63 | 0.19 |
| T306 | S55 | E1 | 62.0 | 0.1 | 0 | 1.2 | 98.7 | 100 | 1.3 | 67.6 | 10 | 18 | ○ | 0.56 | 0.14 |
| T307 | S56 | E1 | 68.1 | 0.1 | 0 | 0 | 99.9 | 100 | 0.1 | 73.4 | 12 | 0 | ○ | 0.63 | 0.12 |
| T308 | S57 | EH1 | 22.2 | 5.8 | 0 | 0 | 94.2 | 100 | 5.8 | 37.8 | 120 | 0 | X | 0.37 | 0.13 |
| T309 | S57 | E1 | 28.7 | 1.7 | 0 | 0 | 98.3 | 100 | 1.7 | 37.9 | 52 | 0 | X | 0.46 | 0.14 |
| T310 | S58 | E1 | 50.7 | 3.2 | 0 | 0 | 96.8 | 100 | 3.2 | 63.9 | 82 | 0 | ○ | 0.86 | 0.15 |
| T311 | S59 | FH1 | 37.2 | 2.7 | 0 | 0 | 97.3 | 100 | 2.7 | 49.0 | 90 | 0 | X | 0.33 | 0.11 |
| T312 | S59 | F1 | 46.1 | 0.5 | 0 | 0 | 99.5 | 100 | 0.5 | 52.6 | 28 | 0 | ○ | 0.37 | 0.11 |
| T313 | S60 | E1 | 53.0 | 0.6 | 0 | 0 | 99.4 | 100 | 0.6 | 60.3 | 40 | 0 | ○ | 0.59 | 0.22 |
| T314 | S61 | E1 | 60.1 | 0.4 | 0 | 0 | 99.6 | 100 | 0.4 | 66.9 | 36 | 0 | ○ | 0.70 | 0.06 |
| T315 | S62 | E1 | 41.3 | 1.0 | 0 | 0 | 99.0 | 100 | 1.0 | 49.4 | 46 | 0 | ○ | 0.46 | 0.20 |

TABLE 63

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T301 | S51 | EH1 | 109 | ○ | — | 132 | 80 | Δ |
| T302 | S51 | E1 | 114 | ○ | — | 94 | 64 | ○ |
| T303 | S52 | E1 | 111 | ○ | Δ | 158 | 92 | X |
| T304 | S53 | E1 | 129 | ○ | — | 98 | 72 | ○ |
| T305 | S54 | E1 | 131 | Δ | ▲ | 52 | 40 | — |
| T306 | S55 | E1 | 126 | Δ | ▲ | 56 | 38 | — |
| T307 | S56 | E1 | 127 | Δ | — | 38 | 16 | — |
| T308 | S57 | EH1 | 119 | ○ | — | 120 | 80 | — |
| 2309 | S57 | E1 | 124 | ○ | — | 86 | 58 | — |
| T310 | S58 | E1 | 118 | ○ | Δ | 158 | 110 | ○ |
| T311 | S59 | FH1 | 110 | ○ | — | 92 | 58 | — |
| 2312 | S59 | F1 | 114 | ○ | — | 48 | 30 | — |
| T313 | S60 | E1 | 111 | ○ | — | 72 | 50 | — |
| T314 | S61 | E1 | 120 | ○ | — | 84 | 62 | — |
| 2315 | S62 | E1 | 112 | ○ | — | 66 | 52 | — |

TABLE 65

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T301 | S51 | EH1 | 0.72 | 0.0094 | 98 | 72 |
| T302 | S51 | E1 | 0.34 | 0.0060 | 46 | 37 |
| T303 | S52 | E1 | 1.46 | 0.0140 | 132 | 89 |
| T304 | S53 | E1 | 0.38 | 0.0120 | 82 | 68 |
| T305 | S54 | E1 | 0.09 | 0.0072 | 68 | 51 |
| T306 | S55 | E1 | 0.19 | 0.0054 | 58 | 44 |
| T307 | S56 | E1 | — | — | 45 | 36 |
| T308 | S57 | EH1 | 0.51 | 0.0110 | 120 | 80 |
| T309 | S57 | E1 | 0.23 | 0.0071 | 82 | 62 |
| T310 | S58 | E1 | 0.43 | 0.0013 | 40 | 33 |
| T311 | S59 | FH1 | — | — | 130 | 88 |
| T312 | S59 | F1 | — | — | 108 | 73 |
| T313 | S60 | E1 | 0.20 | 0.0062 | 79 | 47 |
| T314 | S61 | E1 | 0.14 | 0.0052 | 60 | 63 |
| T315 | S62 | E1 | 0.20 | 0.0070 | 84 | 61 |

TABLE 66

| Test No. | Alloy No. | Step No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn In κ Phase (mass %) | Amount of P in κ Phase (mass %) |
|---|---|---|---|---|---|---|---|---|---|---|---|---|---|---|---|
| T316 | S63 | EH1 | 35.2 | 5.3 | 0 | 0 | 94.7 | 100 | 5.3 | 50.8 | 110 | 0 | X | 0.42 | 0.04 |
| T317 | S63 | E1 | 46.2 | 0.8 | 0 | 0 | 99.2 | 100 | 0.8 | 53.9 | 34 | 0 | ○ | 0.53 | 0.04 |
| T318 | S64 | E1 | 34.7 | 0.1 | 0 | 0 | 99.9 | 100 | 0.1 | 36.6 | 20 | 0 | Δ | 0.04 | 0 |
| T319 | S65 | EH1 | 26.8 | 8.2 | 0 | 0 | 91.8 | 100 | 8.2 | 45.3 | 150 | 0 | X | 0.30 | 0.11 |
| T320 | S65 | E1 | 33.1 | 2.6 | 0 | 0 | 97.4 | 100 | 2.6 | 44.4 | 84 | 0 | ○ | 0.40 | 0.12 |
| T321 | S66 | F1 | 31.8 | 0.5 | 0 | 0 | 99.5 | 100 | 0.5 | 37.6 | 26 | 0 | X | 0.48 | 0.14 |
| T322 | S67 | EH1 | 40.2 | 8.5 | 5.0 | 0 | 86.5 | 95 | 8.5 | 59.8 | 150 | 0 | X | 0.39 | 0.09 |
| T323 | S67 | E1 | 52.8 | 1.9 | 0.5 | 0 | 97.6 | 99.5 | 1.9 | 63.8 | 80 | 0 | ○ | 0.53 | 0.09 |
| T324 | S68 | F1 | 35.3 | 0.2 | 0 | 0 | 99.8 | 100 | 0.2 | 39.7 | 24 | 0 | Δ | 0.51 | 0.13 |
| T325 | S69 | E1 | 57.8 | 0 | 0 | 0 | 100 | 100 | 0 | 60.7 | 0 | 0 | ○ | 0.43 | 0.13 |
| T326 | S70 | E1 | 45.5 | 2.2 | 0 | 0 | 97.8 | 100 | 2.2 | 56.7 | 68 | 0 | ○ | 0.61 | 0.09 |
| T327 | S71 | E1 | 31.1 | 0.6 | 0 | 0 | 99.4 | 100 | 0.6 | 37.3 | 40 | 0 | Δ | 0.48 | 0.12 |
| T328 | S72 | FH1 | 33.1 | 8.5 | 0 | 0 | 91.5 | 100 | 8.5 | 52.2 | 150 | 0 | X | 0.52 | 0.15 |
| T329 | S72 | F1 | 43.7 | 2.6 | 0 | 0 | 97.4 | 100 | 2.6 | 55.6 | 70 | 0 | ○ | 0.68 | 0.15 |

TABLE 64

| Test No. | Alloy No. | Step No. | Tensile Strength ($N/mm^2$) | Elongation (%) | Impact value ($J/cm^2$) | Strength Balance Index f8 | Strength Balance Index f9 |
|---|---|---|---|---|---|---|---|
| T301 | S51 | EH1 | 491 | 20.4 | 14.5 | 539 | 553 |
| T302 | S51 | E1 | 548 | 25.0 | 24.1 | 612 | 636 |
| T303 | S52 | E1 | 479 | 7.4 | 8.1 | 496 | 505 |
| T304 | S53 | E1 | 496 | 35.0 | 30.8 | 576 | 606 |
| T305 | S54 | E1 | 544 | 38.4 | 33.3 | 641 | 674 |
| T306 | S55 | E1 | 583 | 15.2 | 12.2 | 625 | 638 |
| T307 | S56 | E1 | 590 | 13.2 | 11.7 | 628 | 639 |
| T308 | S57 | EH1 | 499 | 21.4 | 22.5 | 549 | 572 |
| T309 | S57 | E1 | 537 | 35.4 | 31.6 | 625 | 657 |
| T310 | S58 | E1 | 554 | 13.6 | 10.1 | 591 | 601 |
| T311 | S59 | FH1 | — | — | — | — | — |
| T312 | S59 | F1 | 577 | 29.6 | 22.3 | 657 | 679 |
| T313 | S60 | E1 | 582 | 20.2 | 12.7 | 638 | 651 |
| T314 | S61 | E1 | 587 | 21.4 | 14.9 | 647 | 662 |
| T315 | S62 | E1 | 571 | 24.6 | 17.8 | 637 | 655 |

TABLE 67

| Test No. | Alloy No. | Step No. | Cutting Resistance (N) | Chip Shape | Hot Workability | Corrosion Test 1 (μm) | Corrosion Test 2 (μm) | Corrosion Test 3 (ISO 6509) |
|---|---|---|---|---|---|---|---|---|
| T316 | S63 | EH1 | 114 | ○ | — | 120 | 84 | ○ |
| T317 | S63 | E1 | 119 | ○ | — | 90 | 56 | — |
| T318 | S64 | E1 | 126 | Δ | — | 82 | 60 | — |
| T319 | S65 | EH1 | 109 | ○ | ○ | 154 | 98 | — |
| T320 | S65 | E11 | 114 | ○ | — | 112 | 70 | — |
| T321 | S66 | F1 | 128 | Δ | ▲ | 62 | 38 | — |
| T322 | S67 | EH1 | 119 | Δ | Δ | 180 | 126 | X |
| T323 | S67 | E1 | 114 | ○ | — | 122 | 82 | Δ |
| T324 | S68 | F1 | 126 | Δ | ▲ | 54 | 28 | — |
| T325 | S69 | E1 | 124 | Δ | ▲ | 22 | 14 | — |
| T326 | S70 | E1 | 110 | ○ | — | 92 | 60 | — |
| T327 | S71 | E1 | 127 | Δ | — | — | — | — |
| T328 | S72 | FH1 | 107 | ○ | ○ | 152 | 92 | Δ |
| T329 | S72 | F1 | 111 | ○ | — | 90 | 64 | — |

TABLE 68

| Test No. | Alloy No. | Step No. | Tensile Strength ($N/mm^2$) | Elongation (%) | Impact Value ($J/cm^2$) | Strength Balance Index f8 | Strength Balance Index f9 |
|---|---|---|---|---|---|---|---|
| T316 | S63 | EH1 | — | — | — | — | — |
| T317 | S63 | E1 | 577 | 27.2 | 20.4 | 651 | 671 |
| T318 | S64 | E1 | 533 | 43.0 | 36.4 | 637 | 674 |
| T319 | S65 | EH1 | 500 | 17.2 | 15.0 | 542 | 557 |
| T320 | S65 | E1 | 551 | 28.1 | 25.7 | 624 | 650 |
| T321 | S66 | F1 | 540 | 41.2 | 35.3 | 642 | 677 |
| T322 | S67 | EH1 | 488 | 9.8 | 6.5 | 511 | 518 |
| T323 | S67 | E1 | 542 | 14.8 | 12.8 | 581 | 594 |
| T324 | S68 | F1 | 546 | 34.8 | 30.4 | 634 | 664 |
| T325 | S69 | E1 | 583 | 16.6 | 15.0 | 629 | 644 |
| T326 | S70 | E1 | 566 | 21.4 | 16.0 | 624 | 640 |
| T327 | S71 | E1 | 554 | 40.0 | 32.4 | 655 | 687 |
| T328 | S72 | FH1 | 510 | 10.8 | 8.6 | 537 | 546 |
| T329 | S72 | F1 | 558 | 17.6 | 15.2 | 605 | 620 |

TABLE 69

| Test No. | Alloy No. | Step No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|---|
| T316 | S63 | EH1 | — | — | — | — |
| T317 | S63 | E1 | 0.16 | 0.0058 | 89 | 66 |
| T318 | S64 | E1 | — | 0.0120 | 268 | 154 |
| T319 | S65 | EH1 | — | — | — | — |
| T320 | S65 | E1 | 0.42 | — | 108 | 74 |
| T321 | S66 | F1 | 0.15 | 0.0061 | 78 | 55 |
| T322 | S67 | EH1 | 2.53 | 0.0160 | 183 | 98 |
| T323 | S67 | E1 | 0.78 | 0.0064 | 99 | 78 |
| T324 | S68 | F1 | 0.08 | 0.0069 | 70 | 54 |
| T325 | S69 | E1 | 0.07 | — | 80 | 63 |
| T326 | S70 | E1 | 0.36 | 0.0053 | — | — |
| T327 | S71 | E1 | 0.12 | 0.0054 | — | — |
| T328 | S72 | FH1 | — | — | — | — |
| T329 | S72 | F1 | 0.36 | 0.0051 | 42 | 36 |

The above-described experiment results are summarized as follows.

1) It was able to be verified that, by satisfying the composition according to the embodiment, the composition relational expressions f1, f2, and f3, the requirements of the metallographic structure, and the metallographic structure relational expressions f4 to f7, excellent machinability can be obtained with addition of a small amount of Pb, and a hot extruded material or a hot forged material having excellent hot workability and excellent corrosion resistance in a harsh environment (hereinafter referred to as corrosion resistance), cavitation resistance, erosion-corrosion resistance, high strength, excellent impact resistance, high temperature properties, and high balance index can be obtained (Alloy Nos. S01, S02, S03, and S21 to S35).

2) It was able to be verified that addition of Sb and As improves corrosion resistance under harsher conditions (Alloy Nos. S41 to S43).

3) It was able to be verified that the cutting resistance further lowers by containing Bi (Alloy No. S42 to S43).

4) When the Cu content was low, machinability was excellent. However, corrosion resistance, cavitation resistance, erosion-corrosion resistance, impact resistance, ductility, and high temperature properties deteriorated. When the Cu content was high, machinability, hot workability, ductility, and impact resistance deteriorated (Alloys No. S52, S55, and S65).

5) When the Si content was high, machinability, elongation, impact resistance, and strength balance indices deteriorated. When the Si content was low, machinability, cavitation resistance, and erosion-corrosion resistance deteriorated, and the strength was low (Alloys No. S53 and S56).

6) When the Sn content was higher than 0.85 mass %, the area ratio of γ phase was higher than 2%. Therefore, cavitation resistance and erosion-corrosion resistance were excellent, but elongation, impact resistance, and strength balance indices deteriorated. On the other hand, when the Sn content was lower than 0.40 mass %, cavitation resistance and erosion-corrosion resistance deteriorated (Alloys No. 559, 558, and S64).

7) When the P content was high, ductility and impact resistance deteriorated, and corrosion resistance, cavitation resistance, and erosion-corrosion resistance deteriorated. On the other hand, when the P content was low or P was not contained, the dezincification corrosion depth in a harsh environment was large, and cavitation resistance, erosion-corrosion resistance, and machinability deteriorated (Alloys No. S60, S63, and S64).

8) It was able to be verified that, when inevitable impurities are contained to some extent on the actual production line, there is little effect on the properties (Alloys No. S01, S02, and S03).

9) When Fe was further contained in Alloy No. S01, the proportion of κ phase decreased, and machinability and tensile strength deteriorated. Further, when the amount of Fe increased, corrosion resistance and erosion-corrosion resistance deteriorated along with deterioration in machinability and tensile strength, and elongation, the impact value, and strength balance indices slightly deteriorated. However, machinability, corrosion resistance, and erosion-corrosion resistance are in the allowable ranges (Alloys No. S01, S11, and S12). It is presumed that, when Fe was added such that the content thereof was outside of the composition according to the embodiment but higher than the limit of the inevitable impurities, an intermetallic compound of Fe and Si was mainly formed, which caused to deterioration in the properties.

10) When Pb was further contained in Alloy No. S02, machinability was improved, but substantially all the other properties such as tensile strength, elongation, the impact value, high temperature properties, cavitation resistance, and the strength balance indices slightly deteriorated. Further, when the amount of Pb increased, the above-described properties further deteriorated (Alloys No. S02, S13, and S14). As long as machinability can be satisfied, the content of Pb needs to be as low as possible. When the Pb content was 0.002 mass %, cutting resistance was improved, and cutting chip partibility deteriorated (Alloy No. S71).

11) Even in a case where the composition of each of the elements was satisfied, when the value of the composition relational expression f1 was 75.0 to 78.2 and preferably 75.5 to 77.7, the proportion of γ phase in the copper alloy was 2% or lower even with inclusion of 0.40% to 0.85% of Sn, and thus machinability, corrosion resistance, strength, impact resistance, high temperature properties, cavitation resistance, and erosion-corrosion resistance were good (Alloys No. S01 to S03, S21 to S35, and Steps No. E1 and F1).

12) When the composition of each of the elements was satisfied and the value of the composition relational expression f2 was low, the proportion of γ phase increased or the long side of γ phase increased. Machinability was excellent, but β phase was present in some cases. Therefore, hot workability, corrosion resistance, elongation, impact resistance, high temperature properties, cavitation resistance, and erosion-corrosion resistance deteriorated, and strength decreased. When the value of the composition relational expression f2 was high, κ1 phase was not likely to be present, hot workability and machinability deteriorated, and strength also decreased (Alloys No. S52 to S54 and S66 to S68).

13) There may be a case where f1 was satisfied but f2 was not satisfied or a case where f2 was satisfied but f1 was not satisfied. In these cases, priority was given to properties that were not satisfied (Alloys No. S54, S58, and S66 to S68). Accordingly, it is necessary to satisfy both the relational expressions f1 and f2.

Even in a case where the amounts of Sn and P were appropriate, when the relational expression f3 was not satisfied, corrosion resistance and cavitation resistance deteriorated. In addition, erosion-corrosion resistance deteriorated with respect to the Sn content, and all the properties such as impact resistance, ductility, strength, high temperature properties, and machinability were affected (Alloys No. S61 and S64).

14) When the area ratio of γ phase in the metallographic structure was higher than 2%, or when the length of the long side of γ phase was longer than 50 μm, machinability was excellent, but corrosion resistance, cavitation resistance, erosion-corrosion resistance, impact resistance, high temperature properties, tensile strength, and strength balance indices deteriorated. In particular, when the area ratio of γ phase was high, the selective corrosion of γ phase in the dezincification corrosion test in a harsh environment occurred (for example, Alloys No. S01 and Steps No. AH1, AH2, AH6, C0, DH1, DH5, EH1, and FH1, and Alloy No. S51). When the area ratio of γ phase was 1.5% or lower and further 0.8% or lower and the length of the long side of γ phase was 40 μm or less and further 30 μm or less, corrosion resistance, cavitation resistance, erosion-corrosion resistance, impact resistance, high temperature properties, tensile strength, and strength balance indices were further improved (Alloys No. S01 to S03 and S21 to S35, and Steps No. E1 and F1).

15) When the area ratio of μ phase was higher than 2%, corrosion resistance, cavitation resistance, erosion-corrosion resistance, impact resistance, high temperature properties, and strength balance indices deteriorated. In the dezincification corrosion test in a harsh environment, grain boundary corrosion or selective corrosion of μ phase occurred (Alloy No. S01 and Steps No. AH4, AH8, and BH3). When the area ratio of μ phase was 1.0% or lower and further 0.5% or lower and the length of the long side of μ phase was 15 μm or less and further 5 μm or less, corrosion resistance, high temperature properties, tensile strength, and strength balance indices were further improved (Alloys No. S01 to S03 and Steps No. A3, A4, AH3, B1, B3, D2, D3, DH2, and FH2).

When the area ratio of β phase was higher than 0.3%, corrosion resistance, cavitation resistance, erosion-corrosion resistance, elongation, impact resistance, and high temperature properties deteriorated (Alloys No. S52 and S67).

When the area ratio of κ phase was higher than 65%, machinability, elongation, and impact resistance deteriorated. On the other hand, when the area ratio of κ phase was lower than 30%, machinability, cavitation resistance, and erosion-corrosion resistance deteriorated (Alloys No. S56 and S53).

When κ phase was present in α phase and the amount of κ1 phase present in α phase increased, corrosion resistance, strength, elongation, strength balance indices, impact resistance, cavitation resistance, erosion-corrosion resistance, and high temperature properties were improved. In addition, even when the proportion of γ phase significantly decreased, excellent machinability was able to be maintained. It is presumed that κ1 phase leads to strengthening of α phase, a decrease in cutting resistance, and improvement of chip partibility (Alloys No. S01 to S03 and Steps No. AH1, AH2, A1, and A6). The relational expression f2 affected the amount of acicular κ phase (for example, Alloys No. S54, S66, S68, S24, and S30).

16) When the value of the metallographic structure relational expression $f6=(\gamma)+(\mu)$ was higher than 3%, or when the value of $f4=(\alpha)+(\kappa)$ was lower than 96.5%, corrosion resistance, impact resistance, and high temperature properties deteriorated (Alloy No. S52).

When the value of the metallographic structure relational expression $f7=1.05(\kappa)+6\times(\gamma)^{1/2}+0.5\times(\mu)$ was lower than 35 or was higher than 70, machinability deteriorated (Alloys No. S56, S53, and S54).

17) When the amount of Sn in κ phase was lower than 0.43 mass %, cavitation resistance and erosion-corrosion resistance deteriorated. Even when the Sn contents in the alloys were the same, the Sn concentration in κ phase largely varied depending on the proportion of γ phase, and there was a large difference in the decrease (erosion-corrosion resistance) in the erosion-corrosion test. It is presumed that erosion-corrosion resistance is affected by f1, f2, f3, and whether or not acicular κ phase is present in α phase, depends on corrosion resistance and the Sn concentration in κ phase, and a Sn concentration of about 0.45% in κ phase is a critical amount of Sn (Alloys No. S01, Steps No. AH1 and A1, Alloy No. S33, and Steps No. FH1 and F1).

In a case where the proportions of κ phase were substantially the same, when the Sn concentration in κ phase was low, cutting resistance was high (for example, Alloys No. S29, S32, and S59).

18) When the requirements of the composition and the requirements of the metallographic structure were satisfied, the tensile strength was 550 $N/mm^2$ or higher, and the creep strain after holding the material at 150° C. for 100 hours in a state where 0.2% proof stress at room temperature was applied was 0.3% or lower and was excellent in most cases (for example, Alloys No. S01, S02, and S03).

19) When the requirements of the composition and the requirements of the metallographic structure were satisfied, the Charpy impact test value was 12 $J/cm^2$ or higher. In addition, in a hot extruded material or a hot forged material, the Charpy impact test value was 14 $J/cm^2$ or higher (for example, Alloys No. S01 and S21 to S35 and Steps No. E1 and F1).

When the requirements of the composition and the requirements of the metallographic structure were satisfied, the strength balance index f8 was 650 or higher, and the strength balance index f9 was 665 or higher (Alloy No. S01).

In the test method according to ISO 6509, an alloy including about 0.5% or higher of (3 phase, an alloy including about 5% or higher of γ phase was evaluated as fail (evaluation: Δ, X). However, an alloy including 3% to 5% of γ phase and about 3% of μ phase was evaluated as pass (evaluation: ○). This shows that the corrosion environment used in the embodiment simulated a harsh environment (Alloys No. S01, S02, S03, S52, and S67).

20) In the evaluation of the materials prepared using the mass-production facility and the materials prepared in the laboratory, substantially the same results were obtained (Alloys No. S01 and S02 and Steps No. F1, E1, C1, and D1).

21) Regarding the manufacturing conditions, when any one of the following conditions (1) to (3) is satisfied, it was able to be verified that a hot forged material or a hot extruded material having excellent corrosion resistance, cavitation resistance, and erosion-corrosion resistance and having excellent strength, ductility, strength balance indices, impact resistance, and high temperature properties was obtained. Even when a continuously cast rod was used as the material forging, a forged product having excellent properties was obtained. A casting having corrosion resistance, cavitation resistance, and erosion-corrosion resistance was also verified (Alloy No. S01 and Steps No. A1 to A9, D1 to D7, F1 to F5, and P1 to P3).

(1) Hot working was performed at a hot working temperature of 600° C. to 740° C. Next, a heat treatment was performed on the hot worked material at 525° C. to 575° C. for 20 minutes to 480 minutes, or a heat treatment was performed on the hot worked material at 515° C. to 525° C. for 100 minutes to 480 minutes Next, the material was cooled in a temperature range from 460° C. to 400° C. at a cooling rate of 2.5° C./min to 500° C./min.

(2) A heat treatment was performed at a maximum reaching temperature of 610° C. or lower. Next, the material was cooled in a temperature range from 575° C. to 525° C. at a cooling rate of 2.5° C./min or lower. Next, the material was cooled in a temperature range from 460° C. to 400° C. at a cooling rate of 2.5° C./min to 500° C./min.

(3) During cooling after forging, the material was cooled in a temperature range from 575° C. to 525° C. at a cooling rate of 2.5° C./min or lower. Next, the material was cooled in a temperature range from 460° C. to 400° C. at a cooling rate of 2.5° C./min to 500° C./min.

22) Due to the appropriate heat treatment and the appropriate cooling conditions after hot forging, the amount of Sn and the amount of P in κ phase increased (Alloys No. S01, S02, and S03 and Steps No. A1, AH1, C0, C1, and D6).

23) When a cold working step was performed at a working ratio of 4% to 10% (heat treatment after cold drawing or cold drawing after heat treatment), the tensile strength was improved by 50 N/mm$^2$ or more, and the strength balance indices were significantly improved as compared to an original extruded material or a material on which cold working was not performed. When a heat treatment was performed at 525° C. to 575° C. after cold working, both tensile strength and impact resistance were improved as compared to a hot extruded material (Alloy No. S01 and Steps No. AH1, AH2, A1, and A10 to A12).

It was verified that, when an appropriate heat treatment was performed on a hot worked material or a cold worked material, acicular κ phase was present in α phase, and the amount of Sn in κ phase increased such that, although the amount of γ phase significantly decreased, excellent machinability was able to be secured and tensile strength, elongation, impact resistance, high temperature properties, corrosion resistance, cavitation resistance, and erosion-corrosion resistance were significantly improved (Alloys No. S01 to S03 and Steps No. AH1, A1, D7, C0, C1, EH1, E1, FH1, and F1).

In the step of performing a heat treatment on a hot worked material or a cold worked material, when the heat treatment temperature was low (505° C.) or when the holding time in the heat treatment at 515° C. or higher and lower than 525° C., a decrease in the amount of γ phase was small, the amount of κ1 phase was small, and corrosion resistance, cavitation resistance, erosion-corrosion resistance, impact resistance, ductility, high temperature properties, and strength balance indices deteriorated (Steps No. AH6, AH9, and DH7). When the heat treatment temperature was high, crystal grains of α phase were coarsened, the amount of κ1 phase was small, and a decrease in the amount of γ phase was small. Therefore, corrosion resistance, cavitation resistance, erosion-corrosion resistance, and machinability deteriorated, tensile strength was low, and f8 and f9 were also low (Steps No. AH5, AH10, and DH6).

It was able to be verified that, during low-temperature annealing after cold working or hot working, when a heat treatment was performed under conditions of temperature: 240° C. to 350° C., heating time: 10 minutes to 300 minutes, and $150 \leq (T-220) \times (t)^{1/2} \leq 1200$ (where T° C. represents the heating temperature and t min represents the heating time), a cold worked material or a hot worked material having excellent corrosion resistance in a harsh environment and having excellent impact resistance and high temperature properties was obtained (Alloy No. S01 and Steps No. B1 to B3).

Regarding the samples obtained by performing Step No. AH11 on Alloys No. S01 to S03, extrusion was not able to be performed to the end due to high deformation resistance. Therefore, the subsequent evaluation was stopped.

In Step No. BH1, low-temperature annealing was inappropriate due to insufficient correct, and there was a problem in quality.

As described above, in the alloy according to the embodiment in which the contents of the respective additive elements, the respective composition relational expressions, the metallographic structure, and the respective metallographic structure relational expressions are in the appropriate ranges, hot workability (hot extrusion, hot forging) is excellent, and corrosion resistance and machinability are also excellent. In addition, the alloy according to the embodiment can obtain excellent properties by adjusting the manufacturing conditions in hot extrusion and hot forging and the conditions in the heat treatment so that they fall in the appropriate ranges.

Example 2

Regarding an alloy according to Comparative Example of the embodiment, a Cu—Zn—Si copper alloy casting (Test No. T401/Alloy No. 5101) which had been used in a harsh water environment for 8 years was prepared. There was no detailed data on the water quality of the environment where the casting had been used and the like. Using the same method as in Example 1, the composition and the metallographic structure of Test No. T401 were analyzed. In addition, a corroded state of a cross-section was observed using the metallographic microscope. Specifically, the sample was embedded in a phenol resin material such that the exposed surface was maintained to be perpendicular to the longitudinal direction. Next, the sample was cut such that a cross-section of a corroded portion was obtained as the longest cut portion. Next, the sample was polished. The cross-section was observed using the metallographic microscope. In addition, the maximum corrosion depth was measured.

Next, a similar alloy casting was prepared with the same composition and under the same preparation conditions of Test No. T401 (Test No. T402/Alloy No. S102). Regarding the similar alloy casting (Test No. T402), evaluation (measurement) including analysis of the composition and the metallographic structure and the dezincification corrosion tests 1 to 3 were performed as described in Example 1. By comparing the corrosion of Test No. T401 which developed in actual water environment and that of Test No. T402 in the accelerated tests of the dezincification corrosion tests 1 to 3 to each other, the appropriateness of the accelerated tests of the dezincification corrosion tests 1 to 3 was verified.

In addition, by comparing the evaluation result (corroded state) of the dezincification corrosion test 1 of the alloy according to the embodiment described in Example 1 (Test No. T63/Alloy No. S02/Step No. C1) and the corroded state of Test No. T401 or the evaluation result (corroded state) of the dezincification corrosion test 1 of Test No. T402 to each other, the corrosion resistance of Test No. T63 was examined.

Test No. T402 was prepared using the following method.

Raw materials were dissolved to obtain substantially the same composition as that of Test No. T401 (Alloy No. S101), and the melt was cast into a mold having an inner diameters of 40 mm at a casting temperature of 1000° C. to prepare a casting. Next, the casting was cooled in the temperature range of 575° C. to 525° C. at a cooling rate of about 20° C./min, and subsequently was cooled in the temperature range from 460° C. to 400° C. at a cooling rate of about 15° C./min. As a result, a sample of Test No. T402 was prepared.

The analysis method of the composition and the metallographic structure, the measurement method of the mechanical properties and the like, and the methods of the dezincification corrosion tests 1 to 3 were as described in Example 1.

Figure 4:
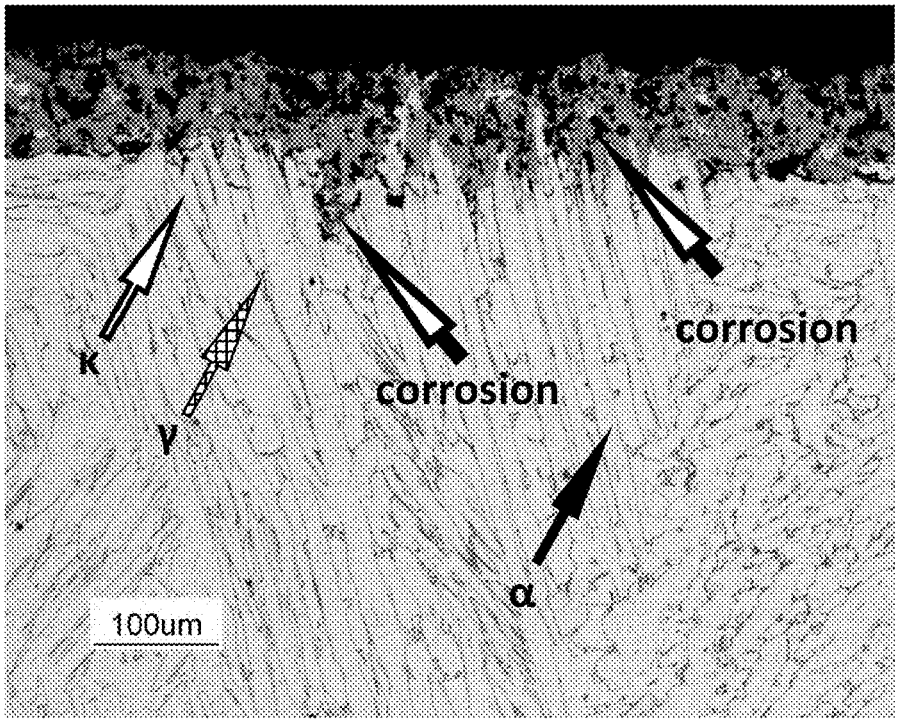
FIG. 4 is a metallographic micrograph of a cross-section of the alloy of Test No. T401 according to Example 2 after use in a harsh water environment for 8 years.
Figure 5:
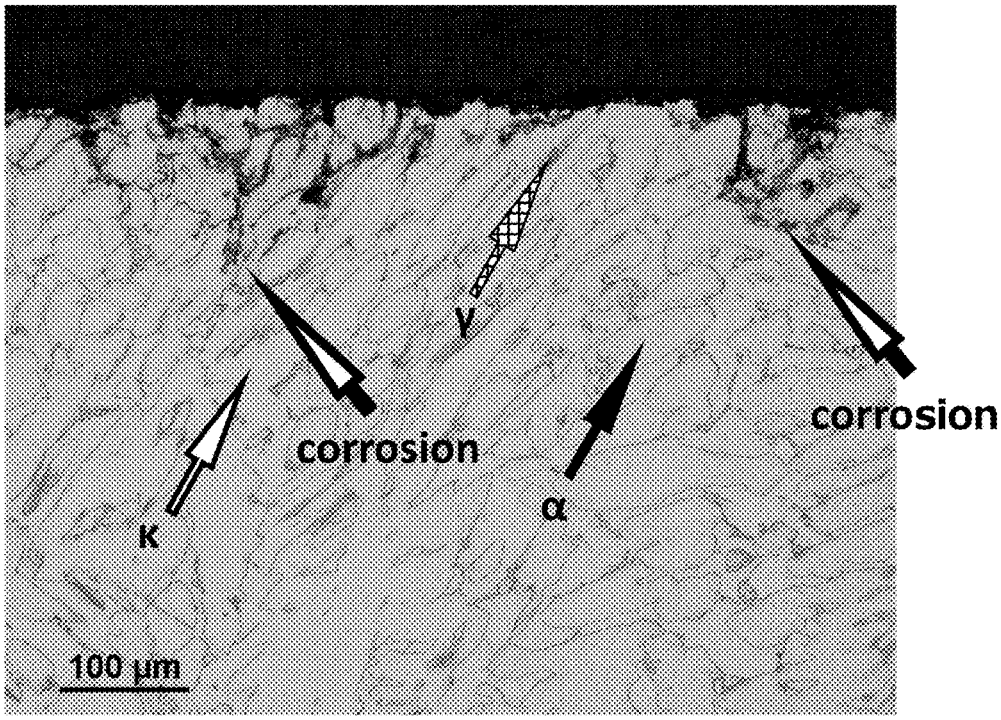
FIG. 5 is a metallographic micrograph of a cross-section of the alloy of Test No. T402 according to Example 2 after dezincification corrosion test 1.
Figure 6:
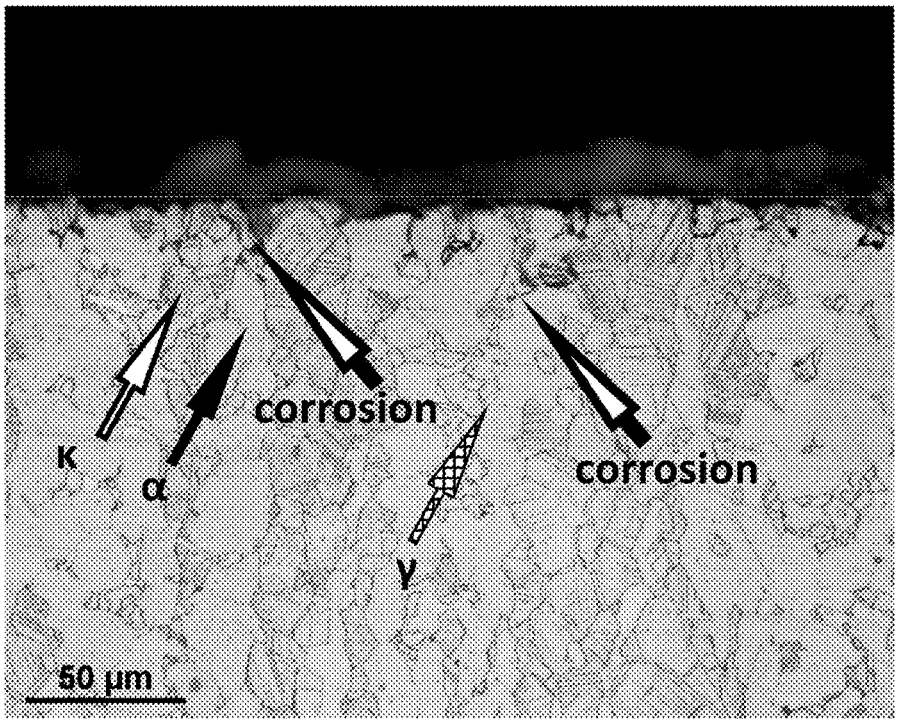
FIG. 6 is a metallographic micrograph of a cross-section of the alloy of Test No. T63 according to Example 2 after dezincification corrosion test 1.

The obtained results are shown in Tables 70 to 73 and FIGS. 4 to 6.

TABLE 70

| Alloy No. | Cu | Si | Sn | P | Pb | Others | f1 | f2 | f3 |
|---|---|---|---|---|---|---|---|---|---|
| S101 | 75.4 | 3.01 | 0.01 | 0.04 | 0.037 | Fe: 0.02, Ni: 0.01, Ag: 0.02 | 77.8 | 60.9 | 4.0 |
| S102 | 75.4 | 3.01 | 0.01 | 0.04 | 0.033 | Fe: 0.02, Ni: 0.02, Ag: 0.02 | 77.8 | 60.9 | 4.0 |

FIG. 4 shows a metallographic micrograph of the cross-section of Test No. T401.

Test No. T401 was used in a harsh water environment for 8 years, and the maximum corrosion depth of corrosion caused by the use environment was 138 μm.

In a surface of a corroded portion, dezincification corrosion occurred irrespective of whether it was α phase or κ phase (average depth of about 100 μm from the surface).

In the corroded portion where α phase and κ phase were corroded, more solid α phase was present at deeper locations.

The corrosion depth of α phase and κ phase was uneven without being uniform. Roughly, selective corrosion occurred in γ phase from a boundary portion of α phase and κ phase to the inside (a depth of about 40 μm from the corroded boundary between α phase and κ phase towards the inside: local corrosion which occurs to γ phase selectively).

FIG. 5 shows a metallographic micrograph of a cross-section of Test No. T402 after the dezincification corrosion test 1.

The maximum corrosion depth was 153 μm.

In a surface of a corroded portion, dezincification corrosion occurred irrespective of whether it was α phase or κ phase (average depth of about 100 μm from the surface).

In the corroded portion, more solid α phase was present at deeper locations.

The corrosion depth of α phase and κ phase was not uniform, but varied instead. Roughly, corrosion occurred selectively in γ phase from a boundary portion of α phase and κ phase to the inside (the length of the local corrosion that selectively occurred to γ phase from the corroded boundary between α phase and κ phase was about 45 μm).

It was found that the corrosion shown in FIG. 4 occurred in the harsh water environment for 8 years and the corrosion shown in FIG. 5 occurred in the dezincification corrosion test 1 were substantially the same in terms of corrosion form. In addition, because the amount of Sn and the amount of P did not fall within the ranges of the embodiment, both α phase and κ phase were corroded in a portion in contact with water or the test solution, and γ phase was selectively corroded here and there at deepest point of the corroded portion. The Sn concentration and the P concentration in κ phase were low.

The maximum corrosion depth of Test No. T401 was slightly less than the maximum corrosion depth of Test No. T402 in the dezincification corrosion test 1. However, the maximum corrosion depth of Test No. T401 was slightly more than the maximum corrosion depth of Test No. T402 in the dezincification corrosion test 2. Although the degree of corrosion in the actual water environment is affected by the water quality, the results of the dezincification corrosion tests 1 and 2 substantially matched the corrosion result in the actual water environment regarding both corrosion form and corrosion depth. Accordingly, it was found that the conditions of the dezincification corrosion tests 1 and 2 are

TABLE 71

| Test No. | Alloy No. | κ Phase Area Ratio (%) | γ Phase Area Ratio (%) | β Phase Area Ratio (%) | μ Phase Area Ratio (%) | f4 | f5 | f6 | f7 | Length of Long side of γ Phase (μm) | Length of Long side of μ Phase (μm) | Presence of Acicular κ Phase | Amount of Sn in κ Phase (mass %) | Amount of P in κ Phase (mass %) |
|---|---|---|---|---|---|---|---|---|---|---|---|---|---|---|
| T401 | S101 | 27.4 | 3.9 | 0 | 0 | 96.1 | 100 | 3.9 | 40.6 | 110 | 0 | X | 0.01 | 0.06 |
| T402 | S102 | 28.0 | 3.8 | 0 | 0 | 96.2 | 100 | 3.8 | 41.1 | 120 | 0 | X | 0.01 | 0.06 |

TABLE 72

| Test No. | Alloy No. | Hot Work-ability | Maximum Corrosion Depth (μm) | Corrosion Test 1 (μm) | Corrosion Test 2 (μm) | Corrosion Test 3 (ISO 6509) |
|---|---|---|---|---|---|---|
| T401 | S101 | — | 138 | — | — | ○ |
| T402 | S102 | ○ | — | 153 | 102 | ○ |

TABLE 73

| Test No. | Alloy No. | 150° C. Creep Strain (%) | Cavitation Resistance (Decrease in Weight) (g) | Erosion-Corrosion Resistance 1 (Decrease in Weight) (mg) | Erosion-Corrosion Resistance 2 (Decrease in Weight) (mg) |
|---|---|---|---|---|---|
| T401 | S101 | — | — | — | — |
| T402 | S102 | 0.46 | 0.0150 | 206 | 121 |

In the copper alloy casting used in a harsh water environment for 8 years (Test No. T401), at least the contents of Sn and P were out of the ranges of the embodiment.

appropriate and the evaluation results obtained in the dezincification corrosion tests 1 and 2 are substantially the same as the corrosion result in the actual water environment.

In addition, the acceleration rates of the accelerated tests of the dezincification corrosion tests 1 and 2 substantially matched that of the corrosion in the actual harsh water environment. This presumably shows that the dezincification corrosion tests 1 and 2 simulated a harsh environment.

The result of Test No. T402 in the dezincification corrosion test 3 (the dezincification corrosion test according to ISO6509) was "○" (good). Therefore, the result of the dezincification corrosion test 3 did not match the corrosion result in the actual water environment.

The test time of the dezincification corrosion test 1 was 2 months, and the dezincification corrosion test 1 was an about 75 to 100 times accelerated test. The test time of the dezincification corrosion test 2 was 3 months, and the dezincification corrosion test 2 was an about 30 to 50 times accelerated test. On the other hand, the test time of the dezincification corrosion test 3 (dezincification corrosion test according to ISO 6509) was 24 hours, and the dezincification corrosion test 3 was an about 1000 times or more accelerated test.

It is presumed that, by performing the test for a long period of time of 2 or 3 months using the test solution close to the actual water environment as in the dezincification corrosion tests 1 and 2, substantially the same evaluation results as the corrosion result in the actual water environment were obtained.

In particular, in the corrosion result of Test No. T401 in the harsh water environment for 8 years, or in the corrosion results of Test No. T402 in the dezincification corrosion tests 1 and 2, not only α phase and κ phase on the surface but also γ phase were corroded. However, in the corrosion result of the dezincification corrosion test 3 (dezincification corrosion test according to ISO 6509), substantially no γ phase was corroded. Therefore, it is presumed that, in the dezincification corrosion test 3 (dezincification corrosion test according to ISO 6509), the corrosion of α phase and κ phase on the surface and the corrosion of γ phase were not able to be appropriately evaluated, and the evaluation result did not match the corrosion result in the actual water environment.

FIG. 6 shows a metallographic micrograph of a cross-section of Test No. T63 (Alloy No. S02/Step No. A1) after the dezincification corrosion test 1.

In the vicinity of the surface, only γ phase exposed to the surface was corroded. α phase and κ phase were solid (were not corroded). In Test No. T63, it is presumed that, in addition to the amount of γ phase, the length of the long side of γ phase is one of the large factors that determine the corrosion depth.

In can be seen that, in the Test No. T63 according to the embodiment shown in FIG. 6, the corrosion of α phase and κ phase in the vicinity of the surface did not occur or was significantly suppressed as compared to Tests No. T401 and T402 shown in FIGS. 4 and 5. Based on the observation result of the corrosion form, the reason for this is presumed to be that the Sn content in κ phase reached 0.68% and corrosion resistance of κ phase was high.

INDUSTRIAL APPLICABILITY

The free-cutting copper alloy according to the present invention has excellent hot workability (hot extrudability and hot forgeability) and excellent corrosion resistance and machinability. Therefore, the free-cutting copper alloy according to the present invention is suitable for devices such as faucets, valves, or fittings for drinking water consumed by a person or an animal every day, in members for electrical uses, automobiles, machines and industrial plumbing such as valves, or fittings, or in devices and components that come in contact with liquid.

Specifically, the free-cutting copper alloy according to the present invention is suitable to be applied as a material that composes faucet fittings, water mixing faucet fittings, drainage fittings, faucet bodies, water heater components, EcoCute components, hose fittings, sprinklers, water meters, water shut-off valves, fire hydrants, hose nipples, water supply and drainage cocks, pumps, headers, pressure reducing valves, valve seats, gate valves, valve stems, unions, flanges, branch faucets, water faucet valves, ball valves, various other valves, and fittings for plumbing, through which drinking water, drained water, or industrial water flows, for example, components called elbows, sockets, bends, connectors, adaptors, tees, or joints.

In addition, the free-cutting copper alloy according to the present invention is suitable for solenoid valves, control valves, various valves, radiator components, oil cooler components, and cylinders used as automobile components, and is suitable for pipe fittings, valves, valve stems, heat exchanger components, water supply and drainage cocks, cylinders, or pumps used as mechanical members, and is suitable for pipe fittings, valves, or valve stems used as industrial plumbing members.

The invention claimed is:

1. A free-cutting copper alloy comprising:

76.0 mass % to 78.7 mass % of Cu;

3.1 mass % to 3.6 mass % of Si;

0.40 mass % to 0.85 mass % of Sn;

0.05 mass % to 0.14 mass % of P;

0.005 mass % or higher and lower than 0.020 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$75.0 \le f1 = [Cu] + 0.8 \times [Si] - 7.5 \times [Sn] + [P] + 0.5 \times [Pb] \le 78.2,$$

$$60.0 \le f2 = [Cu] - 4.8 \times [Si] - 0.8 \times [Sn] - [P] + 0.5 \times [Pb] \le 61.5,$$

and $$0.09 \le f3 = [P]/[Sn] \le 0.30$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$30 \le (\kappa) \le 65,$$

$$0 \le (\gamma) \le 2.0,$$

$$0 \le (\beta) \le 0.3,$$

$$0 \le (\mu) \le 2.0,$$

$$96.5 \le f4 = (\alpha) + (\kappa),$$

$$99.4 \leq f5 = (\alpha)+(\kappa)+(\gamma)+(\mu),$$

$$0 \leq f6 = (\gamma)+(\mu) \leq 3.0, \text{ and}$$

$$35 \leq f7 = 1.05\times(\kappa)+6\times(\gamma)^{1/2}+0.5\times(\mu) \leq 70$$

are satisfied,

κ phase is present in α phase, the length of the long side of γ phase is 50 μm or less, and the length of the long side of μ phase is 25 μm or less.

2. The free-cutting copper alloy according to claim 1, further comprising:

one or more element(s) selected from the group consisting of 0.01 mass % to 0.08 mass % of Sb, 0.02 mass % to 0.08 mass % of As, and 0.01 mass % to 0.10 mass % of Bi.

3. A free-cutting copper alloy comprising:

76.5 mass % to 78.3 mass % of Cu;

3.15 mass % to 3.5 mass % of Si;

0.45 mass % to 0.77 mass % of Sn;

0.06 mass % to 0.13 mass % of P;

0.006 mass % to 0.018 mass % of Pb; and a balance including Zn and inevitable impurities, wherein when a Cu content is represented by [Cu] mass %, a Si content is represented by [Si] mass %, a Sn content is represented by [Sn] mass %, a P content is represented by [P] mass %, and a Pb content is represented by [Pb] mass %, the relations of $$75.5 \leq f1 = [Cu]+0.8\times[Si]-7.5\times[Sn]+[P]+0.5\times[Pb] \leq 77.7,$$

$$60.2 \leq f2 = [Cu]-4.8\times[Si]-0.8\times[Sn]-[P]+0.5\times[Pb] \leq 61.3, \text{ and}$$

$$0.10 \leq f3 = [P]/[Sn] \leq 0.27$$

are satisfied, in constituent phases of metallographic structure, when an area ratio of α phase is represented by (α)%, an area ratio of β phase is represented by (β)%, an area ratio of γ phase is represented by (γ)%, an area ratio of κ phase is represented by (κ)%, and an area ratio of μ phase is represented by (μ)%, the relations of $$33 \leq (\kappa) \leq 60,$$

$$0 \leq (\gamma) \leq 1.5,$$

$$0 \leq (\beta) \leq 0.1,$$

$$0 \leq (\mu) \leq 1.0,$$

$$97.5 \leq f4 = (\alpha)+(\kappa),$$

$$99.6 \leq f5 = (\alpha)+(\kappa)+(\gamma)+(\mu),$$

$$0 \leq f6 = (\gamma)+(\mu) \leq 2.0, \text{ and}$$

$$38 \leq f7 = 1.05\times(\kappa)+6\times(\gamma)^{1/2}+0.5\times(\mu) \leq 65$$

are satisfied,

κ phase is present in α phase, the length of the long side of γ phase is 40 μm or less, and the length of the long side of μ phase is 15 μm or less.

4. The free-cutting copper alloy according to claim 1, wherein a total amount of Fe, Mn, Co, and Cr as the inevitable impurities is lower than 0.08 mass %.

5. The free-cutting copper alloy according to claim 1, wherein an amount of Sn in κ phase is 0.43 mass % to 0.90 mass %, and an amount of P in κ phase is 0.06 mass % to 0.22 mass %.

6. The free-cutting copper alloy according to claim 1, wherein a Charpy impact test value when a U-notched specimen is used is 12 J/cm$^2$ to 45 J/cm$^2$, and a creep strain after holding the copper alloy at 150° C. for 100 hours in a state where a load corresponding to 0.2% proof stress at room temperature is applied is 0.4% or lower.

7. The free-cutting copper alloy according to claim 1, wherein the free-cutting copper alloy is a hot worked material, a tensile strength S (N/mm$^2$) is 550 N/mm$^2$ or higher, an elongation E (%) is 12% or higher, a Charpy impact test value I (J/cm$^2$) when a U-notched specimen is used is 12 J/cm$^2$ to 45 J/cm$^2$, and $650 \leq f8 = S\times\{(E+100)/100\}^{1/2}$ or $655 \leq f9 = S\times\{(E+100)/100\}^{1/2}+I$ is satisfied.

8. The free-cutting copper alloy according to claim 1, that is for use in a water supply device, an industrial plumbing component, a device that comes in contact with liquid, a pressure vessel, a joint, or an automobile component or an electric appliance component that comes in contact with liquid.

9. A method of manufacturing the free-cutting copper alloy according to claim 1, the method comprising:

any one or both of a cold working step and a hot working step; and an annealing step that is performed after the cold working step or the hot working step, wherein in the annealing step, the copper alloy is held under any one of the following conditions (1) to (4):

(1) the copper alloy is held at a temperature of 525° C. to 575° C. for 20 minutes to 8 hours;

(2) the copper alloy is held at a temperature of 515° C. or higher and lower than 525° C. for 100 minutes to 8 hours;

(3) the maximum reaching temperature is 525° C. to 610° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and subsequently, the copper alloy is cooled in a temperature range from 460° C. to 400° C. at an average cooling rate of 2.5° C./min to 500° C./min.

10. A method of manufacturing the free-cutting copper alloy according to claim 1, the method comprising:

a casting step; and an annealing step that is performed after the casting step, wherein in the annealing step, the copper alloy is held under any one of the following conditions (1) to (4):

(1) the copper alloy is held at a temperature of 525° C. to 575° C. for 20 minutes to 8 hours;

(2) the copper alloy is held at a temperature of 515° C. or higher and lower than 525° C. for 100 minutes to 8 hours;

(3) the maximum reaching temperature is 525° C. to 610° C. and the copper alloy is held in a temperature range from 575° C. to 525° C. for 20 minutes or longer; or (4) the copper alloy is cooled in a temperature range from 575° C. to 525° C. at an average cooling rate of 0.1° C./min to 2.5° C./min, and subsequently, the copper alloy is cooled in a temperature range from 460° C. to 400° C. at an average cooling rate of 2.5° C./min to 500° C./min.

11. A method of manufacturing the free-cutting copper alloy according to claim 1, the method comprising:

a hot working step, wherein the material's temperature during hot working is 600° C. to 740° C., and in the process of cooling after hot plastic working, the material is cooled in a temperature range from 575° C. to 525° C. at an average cooling rate of 0.1° C./min to 2.5° C./min and subsequently is cooled in a temperature range from 460° C. to 400° C. at an average cooling rate of 2.5° C./min to 500° C./min.

12. A method of manufacturing the free-cutting copper alloy according to claim 1, the method comprising:

any one or both of a cold working step and a hot working step; and a low-temperature annealing step that is performed after the cold working step or the hot working step, wherein in the low-temperature annealing step, conditions are as follows:

the material's temperature is in a range of 240° C. to 350° C.;

the heating time is in a range of 10 minutes to 300 minutes; and when the material's temperature is represented by T° C. and the heating time is represented by t min, $150 \leq (T-220) \times (t)^{1/2} \leq 1200$ is satisfied.

* * * * *